US011090664B2

(12) United States Patent
Uchiyama et al.

(10) Patent No.: US 11,090,664 B2
(45) Date of Patent: Aug. 17, 2021

(54) FOAM DISCHARGE CONTAINER

(71) Applicant: Kao Corporation, Tokyo (JP)

(72) Inventors: Takumi Uchiyama, Sumida-ku (JP); Shinji Oguri, Wakayama (JP); Ryohei Aoyama, Sumida-ku (JP)

(73) Assignee: Kao Corporation, Tokyo (JP)

( * ) Notice: Subject to any disclaimer, the term of this patent is extended or adjusted under 35 U.S.C. 154(b) by 217 days.

(21) Appl. No.: 16/305,312

(22) PCT Filed: May 30, 2017

(86) PCT No.: PCT/JP2017/020057
§ 371 (c)(1),
(2) Date: Nov. 28, 2018

(87) PCT Pub. No.: WO2018/003375
PCT Pub. Date: Jan. 4, 2018

(65) Prior Publication Data

US 2020/0316619 A1 Oct. 8, 2020

(30) Foreign Application Priority Data

Jun. 30, 2016 (JP) ..... JP2016-130894
May 19, 2017 (JP) ..... JP2017-100242

(51) Int. Cl.
*B05B 1/02* (2006.01)
*B05B 7/00* (2006.01)
(Continued)

(52) U.S. Cl.
CPC ..... *B05B 1/02* (2013.01); *B05B 7/0025* (2013.01); *B65D 47/06* (2013.01); *A47K 5/12* (2013.01)

(58) Field of Classification Search
CPC ..... B05B 1/02; B05B 7/0025; B65D 47/06
(Continued)

(56) References Cited

U.S. PATENT DOCUMENTS 9,004,318 B2 4/2015 Kodama et al.
2001/0042761 A1* 11/2001 Ophardt ..... B05B 11/3087 222/190
(Continued)

FOREIGN PATENT DOCUMENTS

CN 1356952 A 7/2002
CN 201721750 U 1/2011
(Continued)

OTHER PUBLICATIONS

Decision of Refusal dated Nov. 5, 2019 in corresponding Japanese Patent Application No. 2017-100242 (with English Translation), citing document AO therein, 12 pages.
(Continued)

*Primary Examiner* — Paul R Durand
*Assistant Examiner* — Michael J. Melaragno
(74) *Attorney, Agent, or Firm* — Oblon, McClelland, Maier & Neustadt, L.L.P.

(57) ABSTRACT

A foamer mechanism (20) of a foam dispensing container has a gas-liquid contact chamber (21), a liquid agent flow passage (22) through which a liquid agent supplied from a liquid agent supply portion (28) to the gas-liquid contact chamber (21) passes, and a gas flow passage (23) through which a gas supplied from a gas supply portion (29) to the gas-liquid contact chamber (21) passes. The gas flow passage (23) has a gas opening (23*a*) that is open to the gas-liquid contact chamber (21). The liquid agent flow passage (22) branches into plural branch flow passages (for example, branches into a first branch flow passage (221) and plural second branch flow passages (222)). Each of the plural branch flow passages has a liquid agent opening (22*a*, 22*b*) that is open to the gas-liquid contact chamber (21). The liquid agent openings (22*a*, 22*b*) are respectively arranged at positions on the both sides sandwiching an extension region
(Continued)

(26) of an adjacent flow passage (231) which is a part of the gas flow passage (23) adjacent to the gas opening (23*a*).

19 Claims, 55 Drawing Sheets

(51) Int. Cl.
*B65D 47/06* (2006.01)
*A47K 5/12* (2006.01)

(58) Field of Classification Search
USPC ..... 222/190
See application file for complete search history.

(56) References Cited

U.S. PATENT DOCUMENTS

2003/0192135 A1 10/2003 Koike et al.
2005/0115988 A1* 6/2005 Law ..... B05B 11/3087 222/145.5
2006/0219738 A1 10/2006 Iizuka et al.
2007/0278247 A1* 12/2007 Banks ..... B05B 7/2497 222/132
2011/0272432 A1* 11/2011 Baughman ..... B05B 11/3087 222/136
2012/0205399 A1* 8/2012 Lane ..... A45D 19/02 222/190
2012/0241477 A1 9/2012 Uehira et al.
2013/0068794 A1 3/2013 Kodama et al.
2013/0175306 A1* 7/2013 Frailey ..... B01F 13/002 222/402.18
2015/0202645 A1* 7/2015 Tepas ..... B05B 11/3001 222/190
2016/0129459 A1* 5/2016 Mizushima ..... B05B 11/0064 222/190
2019/0111400 A1* 4/2019 King ..... B01F 5/0465
2019/0191936 A1* 6/2019 Aoyama ..... B05B 7/0037
2020/0048728 A1* 2/2020 Yamamoto ..... C21D 1/767

FOREIGN PATENT DOCUMENTS

CN 102689734 A 9/2012
CN 202492016 U 10/2012
JP 9-193953 A 7/1997
JP 2005-262202 A 9/2005
JP 2011-251693 A 12/2011
JP 2012-1216 A 1/2012
JP 2012-1242 A 1/2012
JP 2012-6601 A 1/2012
JP 2012-110799 A 6/2012
JP 2012110799 A * 6/2012 ..... B05B 11/3087
JP 2015-9850 A 1/2015

OTHER PUBLICATIONS

Combined Chinese Office Action and Search Report dated Sep. 23, 2019 in corresponding Chinese Patent Application No. 201780039536.6 (with English Translation and English Translation of Category of Cited Documents), citing documents AP-AR therein, 18 pages.
International Search Report dated Aug. 15, 2017 in PCT/JP2017/020057 filed May 30, 2017.

* cited by examiner

SECTION BY A-A

SECTION BY B-B

SECTION BY C-C

CUT END SURFACE VIEW BY D-D

SECTION BY E-E

CUT END SURFACE VIEW BY F-F

SECTION BY G-G

SECTION BY H-H

SECTION BY I-I

ABOVE SECTION BY J-J

BELOW SECTION BY J-J

BIRD'S-EYE VIEW OF SECTION BY J-J

SECTION BY K-K

ABOVE SECTION BY L-L

BELOW SECTION BY L-L

BIRD'S-EYE VIEW OF SECTION BY M-M

SECTION BY N-N

400

FOAM DISCHARGE CONTAINER

TECHNICAL FIELD

The present invention relates to a foam dispensing container.

BACKGROUND ART

As a foam dispensing container that foams and discharges contents, for example, there is a foam dispensing container described in Patent Document 1.

The foam dispensing container of Patent Document 1 has a liquid agent pump, and a gas pump arranged in a periphery of the liquid agent pump, wherein a liquid agent pressure-fed from the liquid agent pump and a gas pressure-fed from the gas pump flow into and interflow at a gas-liquid contact chamber (referred to as the interflowing space in Patent Document 1) via a ball valve arranged above the liquid agent pump. The liquid agent pressure-fed from the liquid agent pump goes substantially vertically upward from below the gas-liquid contact chamber and flows into the gas-liquid contact chamber, whereas the gas pressure-fed from the gas pump flows into the gas-liquid contact chamber from a periphery of the gas-liquid contact chamber.

CITATION LIST

PATENT DOCUMENT 1: Japanese Patent Application Publication No. 2005-262202

SUMMARY OF THE INVENTION

The present invention relates to a foam dispensing container, including a foamer mechanism that foams a liquid agent and produces a foam body, a liquid agent supply portion that supplies the liquid agent to the foamer mechanism, a gas supply portion that supplies a gas to the foamer mechanism, and a discharge port that discharges the foam body produced by the foamer mechanism, wherein the foamer mechanism has a gas-liquid contact chamber in which the liquid agent supplied from the liquid agent supply portion meets the gas supplied from the gas supply portion, a liquid agent flow passage through which the liquid agent supplied from the liquid agent supply portion to the gas-liquid contact chamber passes, and a gas flow passage through which the gas supplied from the gas supply portion to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, and the liquid agent openings are respectively arranged at positions on the both sides sandwiching an extension region of an adjacent flow passage which is a part of the gas flow passage adjacent to the gas opening.

BRIEF DESCRIPTION OF THE DRAWINGS

FIG. 4A is a plan view; FIG. 4B is a sectional view taken along line B-B of FIG. 4A; FIG. 4C is a side view; FIG. 4D is a sectional view taken along line D-D of FIG. 4A; FIG. 4E is a bottom view; and FIG. 4F is a perspective view.

FIG. 5A is a plan view; FIG. 5B is a sectional view taken along line B-B of FIG. 5A; FIG. 5C is a side view; FIG. 5D is a sectional view taken along line D-D of FIG. 5A; FIG. 5E is a bottom view; and FIG. 5F is a perspective view.

FIG. 6A is a plan view; FIG. 6B is a sectional view taken along line B-B of FIG. 6A; FIG. 6C is a side view;

FIG. 6D is a sectional view taken along line D-D of FIG. 6A;

FIG. 6E is a bottom view; and FIG. 6F is a perspective view.

FIG. 33A shows a structure when looking up; and FIG. 33B shows a structure when looking down.

FIG. 36A shows a structure when looking up; and FIG. 36B shows a structure when looking down.

FIG. 41A is a side view; FIG. 41B is a perspective view; FIG. 41C is a plan view; and FIG. 41D is a bottom view.

FIG. 42A is a side sectional view (sectional view taken along line A-A of FIG. 21); FIG. 42B is a perspective side-sectional view; FIG. 42C is a sectional view taken along line C-C of FIG. 21; and FIG. 42D is a perspective sectional view taken along line C-C of FIG. 21.

FIG. 43A is a side view; FIG. 43B is a perspective view; FIG. 43C is a plan view; and FIG. 43D is a bottom view.

FIG. 44A is a side sectional view (sectional view taken along line A-A of FIG. 21); and FIG. 44B is a sectional view taken along line B-B of FIG. 21.

DETAILED DESCRIPTION OF THE INVENTION

According to examination of the inventor, in a mechanism of the foam dispensing container having the structure of Patent Document 1, depending on a state of the contents, it is not always easy to sufficiently mix a liquid agent and a gas and produce a sufficiently uniform foam body, and there is still room for improvement in terms of the structure.

The present invention relates to a foam dispensing container and a foam dispensing cap having a structure capable of more favorably mixing a gas and a liquid and producing a sufficiently uniform foam body.

Hereinafter, preferred embodiments of the present invention will be described in conjunction with the accompanying drawings. The same reference signs will be given to similar constituent elements throughout all the figures, and the description of those constituent elements will not be repeated.

First Embodiment

Figure 1:
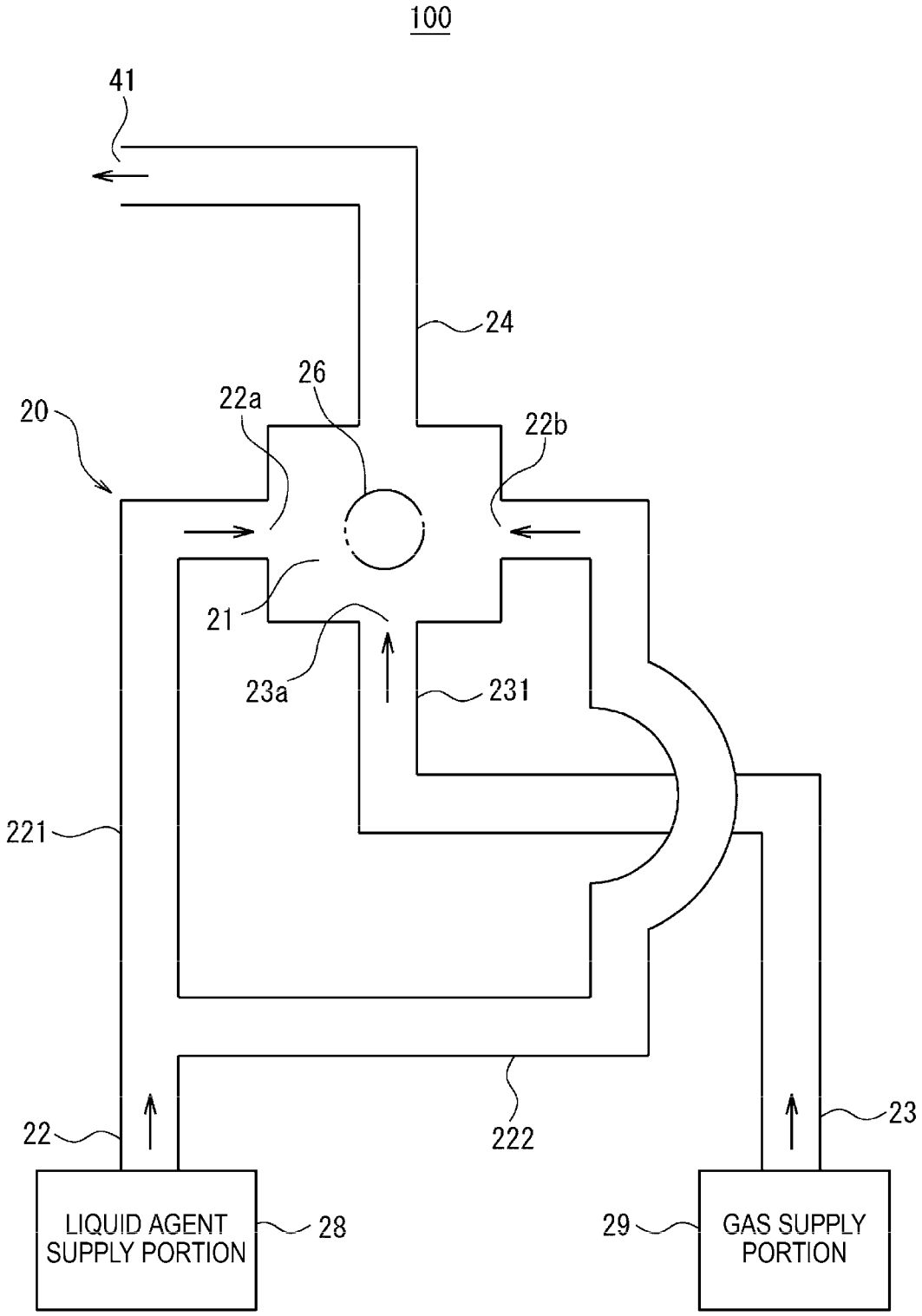
FIG. 1 is a schematic view of a foam dispensing container according to a first embodiment.

First, a foam dispensing container 100 according to a first embodiment will be described with reference to FIG. 1.

The foam dispensing container 100 according to this embodiment includes a foamer mechanism 20 that foams a liquid agent and produces a foam body, a liquid agent supply portion 28 that supplies the liquid agent to the foamer mechanism 20, a gas supply portion 29 that supplies a gas to the foamer mechanism 20, and a discharge port 41 that discharges the foam body produced by the foamer mechanism 20.

The foamer mechanism 20 has a gas-liquid contact chamber 21 in which the liquid agent supplied from the liquid agent supply portion 28 meets the gas supplied from the gas supply portion 29, a liquid agent flow passage 22 through which the liquid agent 101 supplied from the liquid agent supply portion 28 to the gas-liquid contact chamber 21 passes, and a gas flow passage 23 through which the gas supplied from the gas supply portion 29 to the gas-liquid contact chamber 21 passes.

The gas flow passage 23 has a gas opening 23*a* that is open to the gas-liquid contact chamber 21.

The liquid agent flow passage 22 branches into plural branch flow passages (for example, branches into two branch flow passages: a first branch flow passage 221 and a second branch flow passage 222). Each of the plural branch flow passages has a liquid agent opening 22*a*, 22*b* that is open to the gas-liquid contact chamber 21.

The liquid agent openings 22*a*, 22*b* are respectively arranged at positions on the both sides sandwiching an extension region 26 of an adjacent flow passage 231 which is a part of the gas flow passage 23 adjacent to the gas opening 23*a*.

Here, the gas-liquid contact chamber 21 is a region including a region where the extension region 26 of the adjacent flow passage 231 overlaps with extension regions of the branch flow passages (hereinafter, referred to as the overlapping region). Irrespective of the existence of wall surfaces that define the gas-liquid contact chamber 21, the gas-liquid contact chamber 21 may be defined only by imaginary surfaces including no wall surfaces. In such a way, the gas-liquid contact chamber 21 is the region including the overlapping region. Thus, the gas-liquid contact chamber 21 may be called a gas-liquid contact portion.

In the case of this embodiment, the liquid agent flow passage 22 branches into the two branch flow passages: the first branch flow passage 221 and the second branch flow passage 222. The gas-liquid contact chamber 21 is a region including an overlapping region where the extension region of the adjacent flow passage 231 overlaps with the extension region of the first branch flow passage 221 and an overlapping region where the extension region of the adjacent flow passage 231 overlaps with the extension region of the second branch flow passage 222.

The liquid agent openings (in the case of this embodiment, the liquid agent opening 22*a* and the liquid agent opening 22*b*) are ends of the respective branch flow passages (the first branch flow passage 221 and the second branch flow passage 222) connected to the gas-liquid contact chamber 21.

The gas opening 23*a* is an end of the gas flow passage 23 connected to the gas-liquid contact chamber 21.

The gas-liquid contact chamber 21 is enclosed by plural surfaces (flat surfaces or curved surfaces) including, for example, a surface including the gas opening 23*a*, a surface including the liquid agent opening 22*a*, a surface including the liquid agent opening 22*b*, and a surface including an opening which serves as an outlet for the foam body produced in the gas-liquid contact chamber 21 to flow out of the gas-liquid contact chamber 21 to a foam flow passage 24. These surfaces enclosing the gas-liquid contact chamber 21 may include wall surfaces or may be imaginary surfaces including no wall surfaces.

Each of the liquid agent openings (in the case of this embodiment, the liquid agent opening 22*a* and the liquid agent opening 22*b*) serves as part of or the entire surface to which the liquid agent opening belongs among the plural surfaces defining the gas-liquid contact chamber 21. In a case where the surface to which the liquid agent opening belongs includes a wall surface, the liquid agent opening serves as part of the surface. In a case where the surface to which the liquid agent opening belongs includes no wall surface, the liquid agent opening serves as the entire surface. Similarly, the gas opening 23*a* serves as part of or the entire surface to which the gas opening 23*a* belongs among the plural surfaces defining the gas-liquid contact chamber 21. In a case where the surface to which the gas opening 23*a* belongs includes a wall surface, the gas opening 23*a* serves as part of the surface. In a case where the surface to which the gas opening 23*a* belongs includes no wall surface, the gas opening 23*a* serves as the entire surface.

In the case of this embodiment, the first branch flow passage 221 is connected to part of one surface among the plural surfaces defining the gas-liquid contact chamber 21, the second branch flow passage 222 is connected to part of another surface, and the gas flow passage 23 is connected to part of the other surface. In such a way, in a case where each of the flow passages (the first branch flow passage 221, the second branch flow passage 222, and the gas flow passage 23) is connected to part of the surface defining the gas-liquid contact chamber 21, each of the openings (the liquid agent opening 22*a*, the liquid agent opening 22*b*, and the gas opening 23*a*) serves as part of the surface to which the opening belongs among the surfaces defining the gas-liquid contact chamber 21. The same is applied to the example of FIG. 46A, the example of FIG. 46B, the example of FIG. 47, and the example of FIG. 48 among the other modes to be described later.

Meanwhile, in the example of FIG. 53 (second embodiment), the example of FIGS. 25, 26, 36A, 36B, and 37 (third embodiment), the example of FIG. 54A, the example of FIG. 54B, and the example of FIG. 55 among the other modes to be described later, each of the branch flow passages (the first branch flow passage 221 and the second branch flow passage 222) is connected to the entirety of one surface among the surfaces defining the gas-liquid contact chamber 21. In such a case, each of the liquid agent openings serves as the entire surface to which the liquid agent opening belongs among the surfaces defining the gas-liquid contact chamber 21.

Figure 53:
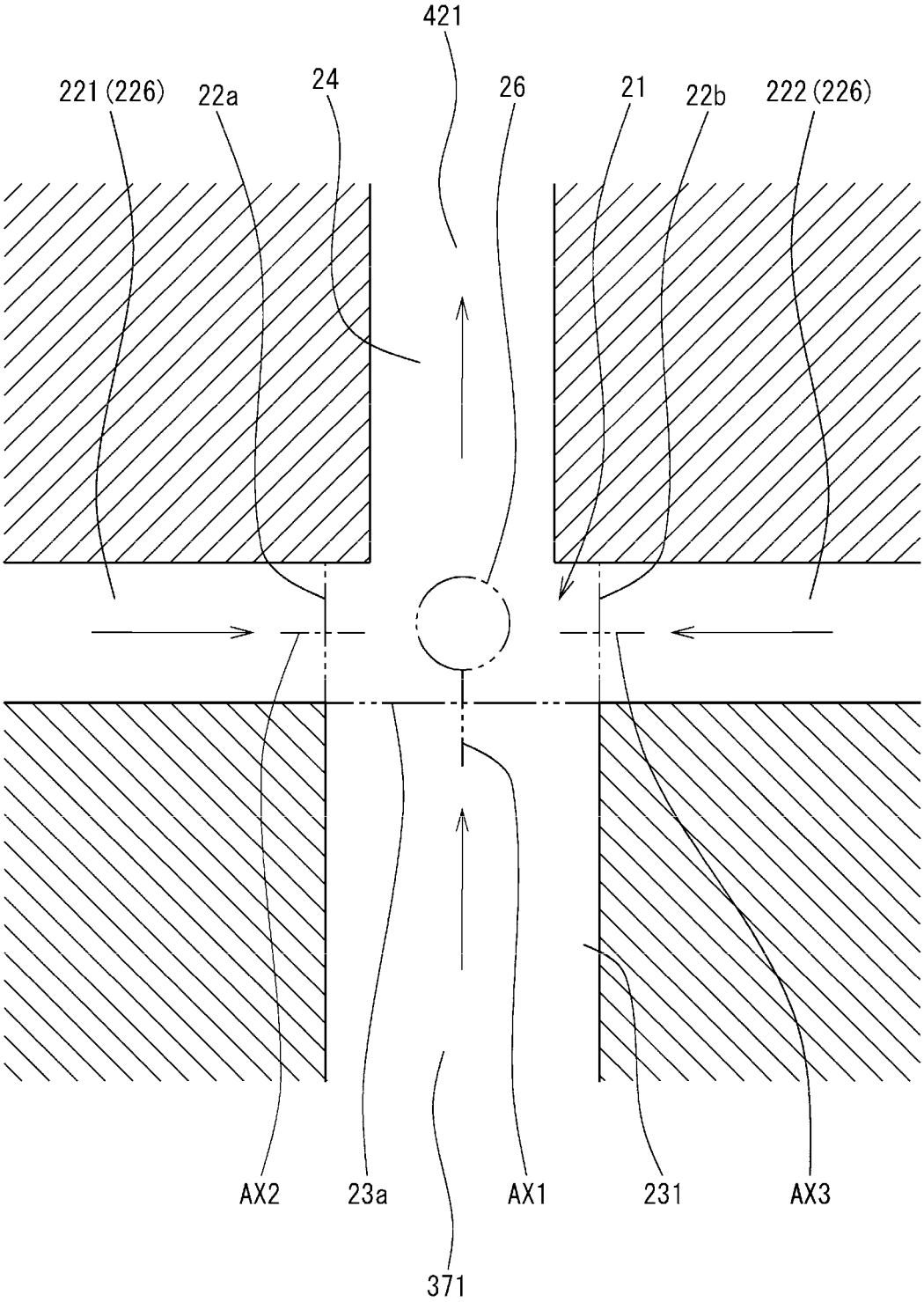
FIG. 53 is a sectional view taken along line A-A of FIG. 49.
Figure 55:
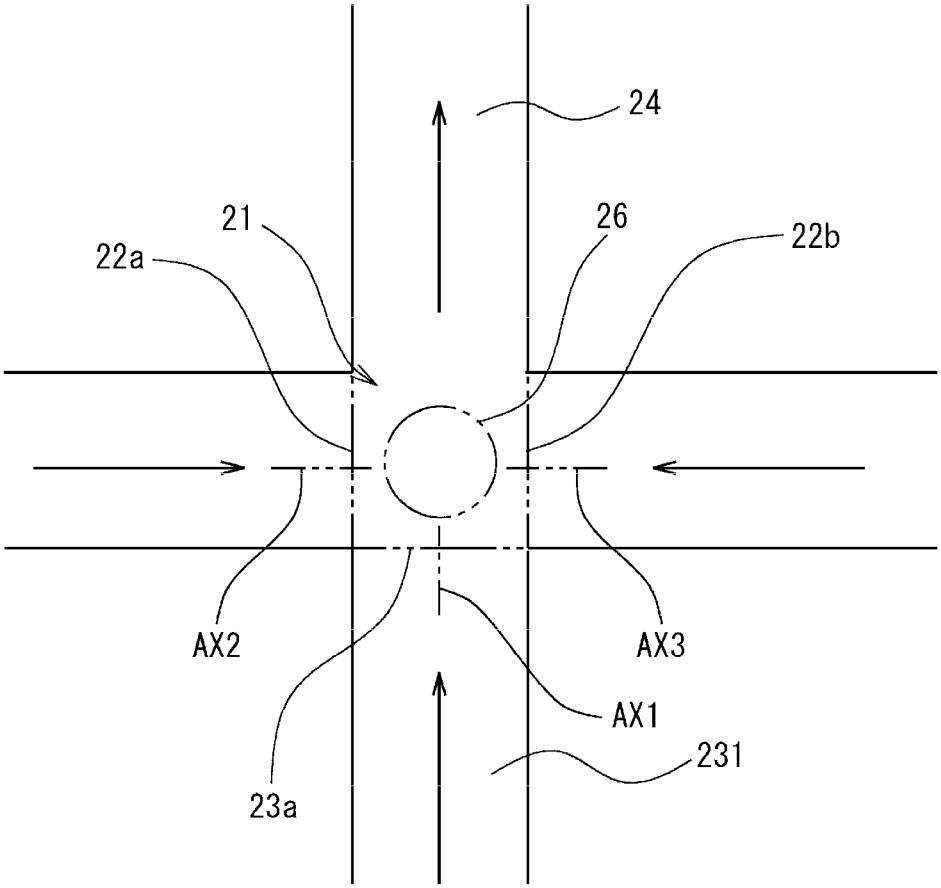
FIG. 55 is a schematic view for illustrating a foam dispensing container according to Modified Example 8.

In the example of FIG. 53 (second embodiment) and the example of FIG. 55, the gas opening 23*a* is connected to the entirety of one surface among the surfaces defining the gas-liquid contact chamber 21. Thus, the gas opening 23*a* serves as the entire surface to which the gas opening belongs among the surfaces defining the gas-liquid contact chamber 21.

Figure 54B:
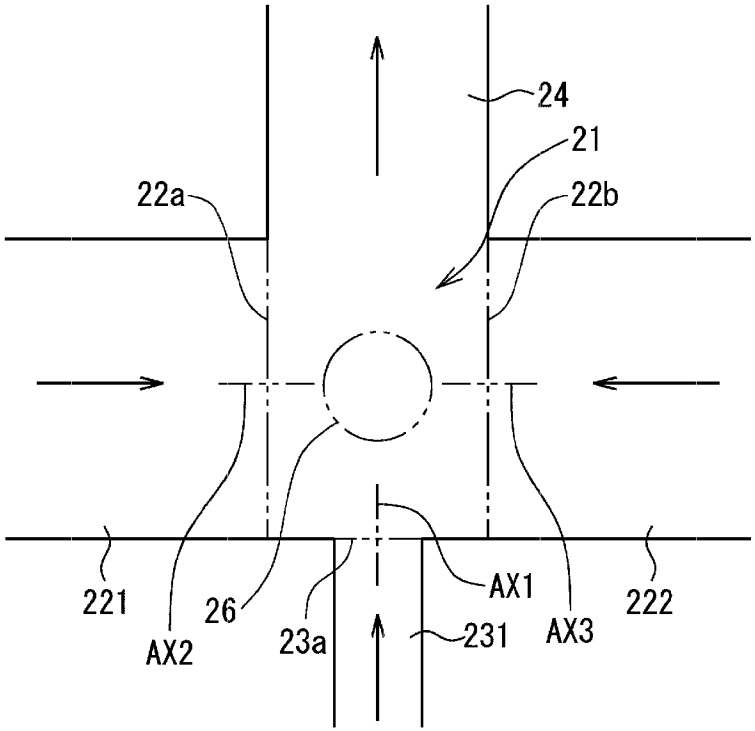
FIG. 54B is a schematic view for illustrating a foam dispensing container according to Modified Example 7.
Figure 54A:
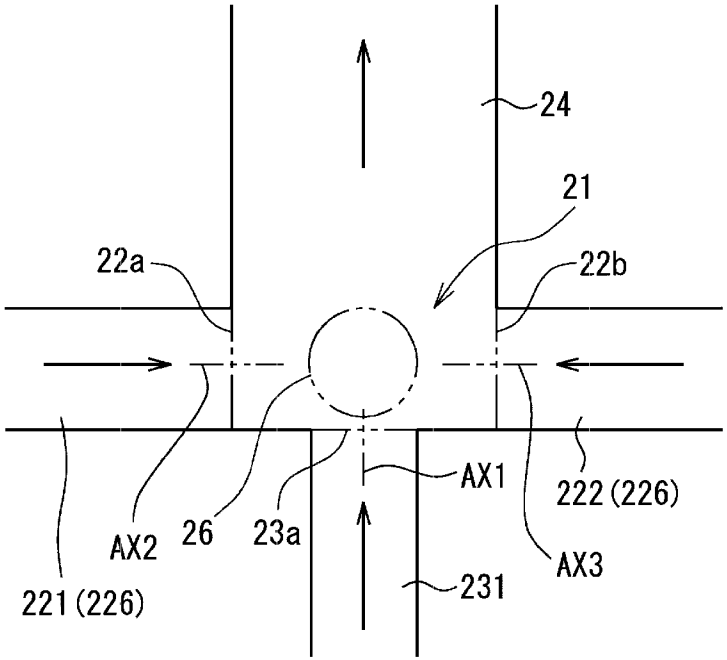
FIG. 54A is a schematic vertically-sectional view showing part of the foam dispensing container according to the second embodiment.

In the example of FIG. 54A and the example of FIG. 54B, the gas opening 23*a* is connected to part of one surface among the surfaces defining the gas-liquid contact chamber 21. Thus, the gas opening 23*a* serves as part of the surface to which the gas opening belongs among the surfaces defining the gas-liquid contact chamber 21.

Figure 45:
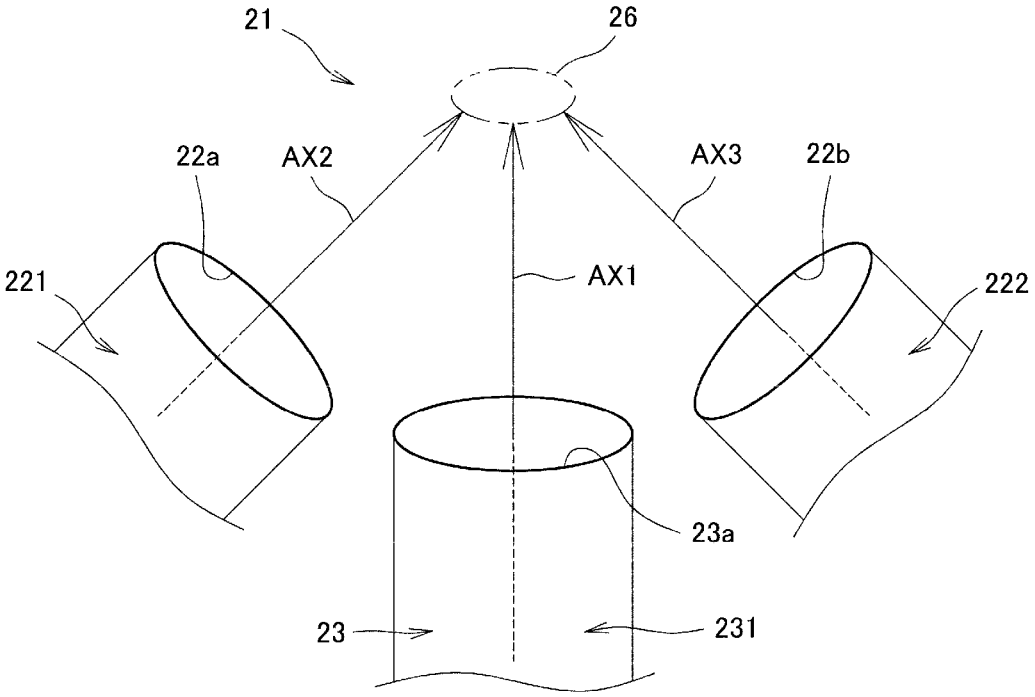
FIG. 45 is a schematic view for illustrating a foam dispensing container according to Modified Example 1.

The example shown in FIG. 45 is a more conceptual example where each of the openings may serve as the entire surface or part of the surface to which the opening belongs among the surfaces defining the gas-liquid contact chamber 21.

The region 26 may serve as a region which is part of the gas-liquid contact chamber 21 or may serve as the entire gas-liquid contact chamber 21. In the case of this embodiment, the region 26 is a region which is part of the gas-liquid contact chamber 21.

The region 26 is a region including the overlapping region described above. In the case of this embodiment, the region 26 is a region including the overlapping region where the extension region of the adjacent flow passage 231 overlaps with the extension region of the first branch flow passage 221 and the overlapping region where the extension region of the adjacent flow passage 231 overlaps with the extension region of the second branch flow passage 222.

When the liquid agent openings 22*a*, 22*b* are respectively arranged at the positions on the both sides sandwiching the extension region 26, the liquid agent openings 22*a*, 22*b* are respectively arranged in regions on the both sides sandwiching the region 26. In other words, the liquid agent openings 22*a*, 22*b* are respectively arranged in regions on the both sides sandwiching an extension line of the axis AX1 of the adjacent flow passage 231.

The liquid agent openings 22*a*, 22*b* are arranged in such a manner that the liquid agent flowing into the gas-liquid contact chamber 21 via the liquid agent openings 22*a*, 22*b* reaches the region 26 from the regions on the both sides sandwiching the region 26.

According to this embodiment, the liquid agent openings 22*a*, 22*b* are respectively arranged at the positions on the both sides sandwiching the extension region 26 of the adjacent flow passage 231 which is a part of the gas flow passage 23 adjacent to the gas opening 23*a*.

Thereby, it is possible to more favorably mix the gas and the liquid in the gas-liquid contact chamber 21. Thus, a sufficiently uniform foam body is more easily produced. Therefore, it is possible to easily foam even a liquid agent which is not easily foamed such as a highly-viscous liquid agent.

In such a way, according to this embodiment, it is possible to more favorably mix the gas and the liquid and produce a sufficiently uniform foam body.

Second Embodiment

Next, a second embodiment will be described with reference to FIGS. 2 to 17. A foam dispensing container 100 according to this embodiment is one example of a configuration more detailed than the foam dispensing container 100 according to the first embodiment described above (FIG. 1).

Hereinafter, in order to simplify the description of positional relationships between constituent elements of the foam dispensing container 100, for the sake of convenience, the lower direction in FIG. 2 will be the lower side, the opposite direction will be the upper side, the left direction in FIG. 2 will be the front side, the right direction in FIG. 2 will be the rear side, the near side on the paper plane in FIG. 2 will be the left side, and the far side on the paper plane in FIG. 2 will be the right side. However, these directions do not limit the directions of the time of manufacturing and using the foam dispensing container 100.

Figure 7:
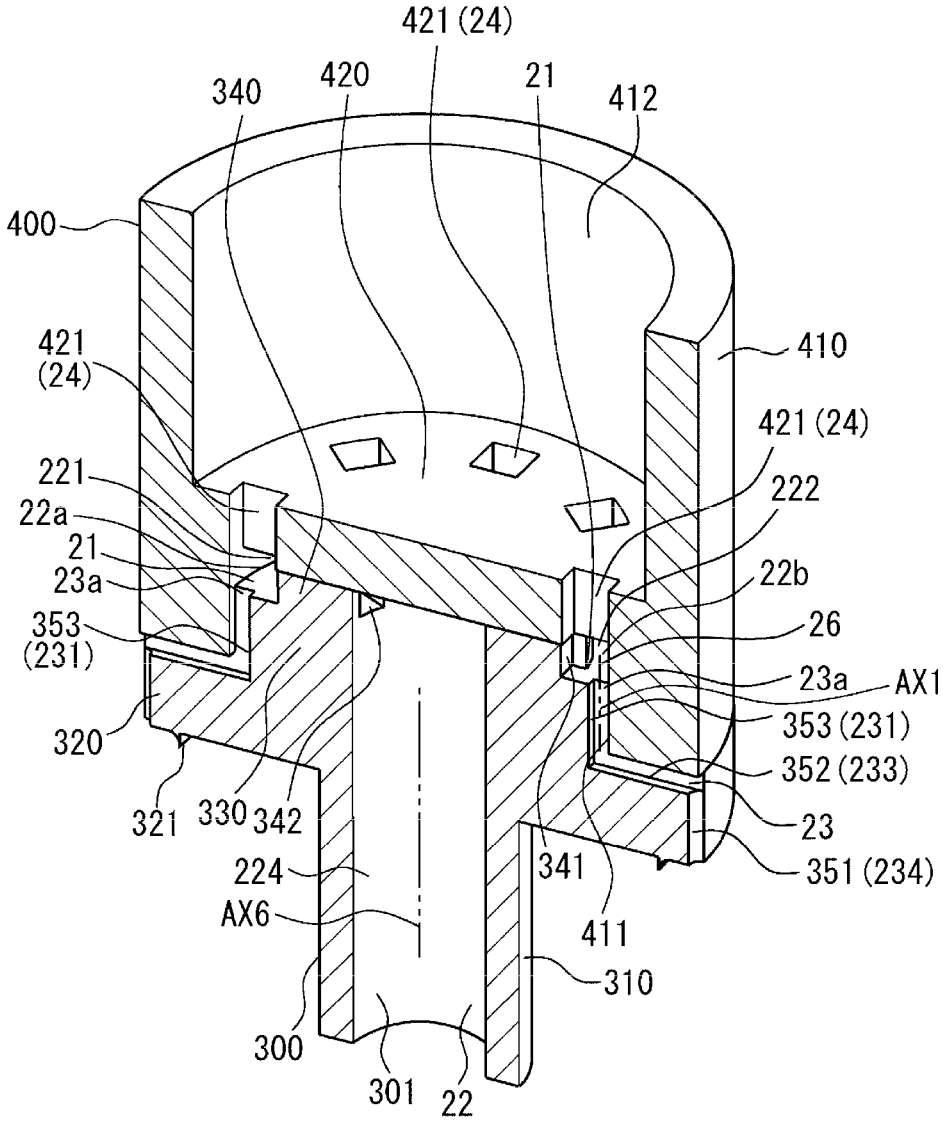
FIG. 7 is a perspective sectional view taken along line B-B of FIG. 6A.
Figure 8:
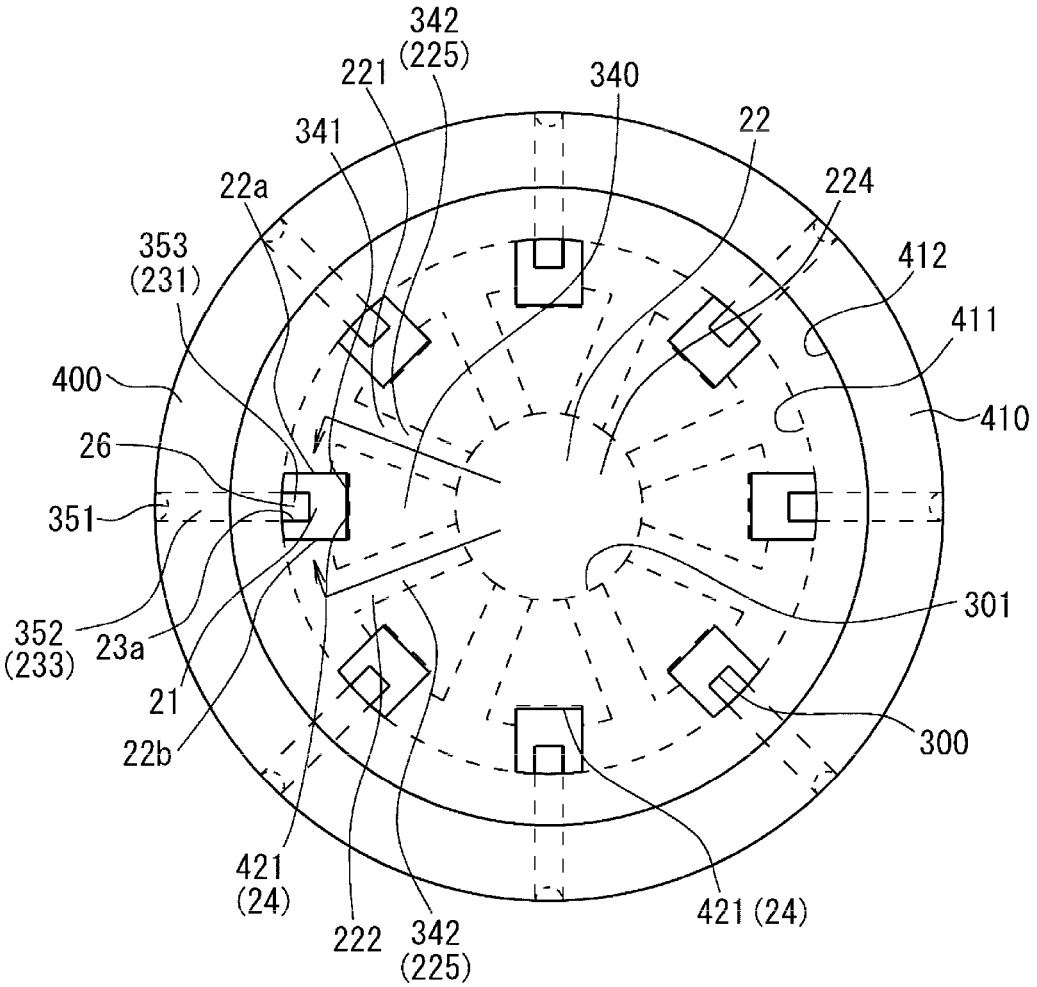
FIG. 8 is an enlarged view of FIG. 6A.
Figure 15:
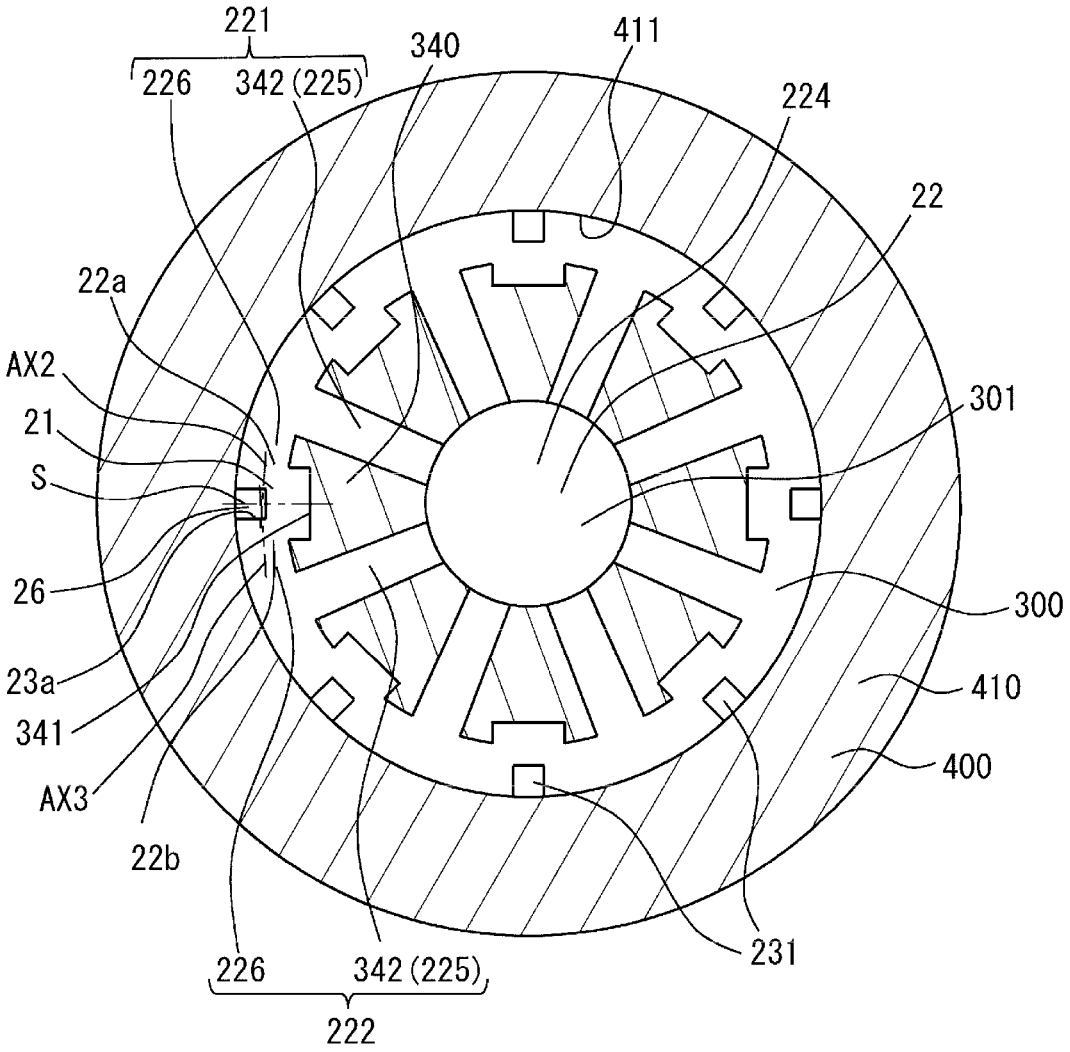
FIG. 15 is a sectional view taken along line F-F of FIG. 9, the view enlarging and showing a range narrower than FIGS. 10 to 14.

As shown in any of FIGS. 7 to 9, 15, and 16, a foamer mechanism 20 (FIG. 9) has gas-liquid contact chambers 21, a liquid agent flow passage 22, and a gas flow passage 23. For example, as shown in FIGS. 8 and 15, the plural gas-liquid contact chambers 21 are arranged in a periphery of an adjacent liquid agent flow passage 224 (to be described later) of the liquid agent flow passage 22 in a plan view.

In more detail, for example, eight gas-liquid contact chambers 21 are arranged at equal angle intervals in a periphery of a downstream end of the adjacent liquid agent flow passage 224.

The gas flow passage 23 has gas openings 23*a* that are respectively open to the gas-liquid contact chambers 21.

The liquid agent flow passage 22 branches into plural branch flow passages (as shown in FIG. 15, branches into two branch flow passages including first branch flow passages 221 and second branch flow passages 222 respectively corresponding to the gas-liquid contact chambers 21) from the downstream end of the adjacent liquid agent flow passage 224.

Each of the branch flow passages has a liquid agent opening 22*a*, 22*b* that is open to the gas-liquid contact chamber 21.

The liquid agent openings 22*a*, 22*b* are respectively arranged at positions on the both sides sandwiching an extension region 26 of an adjacent flow passage 231 (FIG. 7) which is a part of the gas flow passage 23 adjacent to the gas opening 23*a* (FIGS. 8 and 15). Each of these liquid agent openings 22*a*, 22*b* is directed to the region 26.

That is, each of the liquid agent openings 22*a*, 22*b* arranged at the positions on the both sides sandwiching the extension region 26 of the adjacent flow passage 231 is directed to the region 26.

Here, the region 26 in the gas-liquid contact chamber 21, is a region overlapping with the adjacent flow passage 231 when seen in the direction of the axis AX1 (FIGS. 7 and 9) of the adjacent flow passage 231. Here, it is preferable to meet the condition that no obstacles exist between the region 26 and the adjacent flow passage 231. However, some obstacles inhibiting a flow of the gas may exist between the region 26 and the adjacent flow passage 231.

The description that the liquid agent opening 22*a* is directed to the region 26 means that a part of the liquid agent opening 22*a* overlaps with the region 26 when seen in the direction of the axis AX2 (FIG. 15) of the liquid agent opening 22*a*. Here, it is preferable to meet the condition that no obstacles exist between the region 26 and the liquid agent opening 22*a*. However, some obstacles inhibiting a flow of the liquid agent may exist between the region 26 and the liquid agent opening 22*a*.

Similarly, the description that the liquid agent opening 22*b* is directed to the region 26 means that a part of the liquid agent opening 22*b* overlaps with the region 26 when seen in the direction of the axis AX3 (FIG. 15B) of the liquid agent opening 22*b*. Here, it is preferable to meet the condition that no obstacles exist between the region 26 and the liquid agent opening 22*b*. However, some obstacles allowing part of the flow of the liquid agent but inhibiting the remaining part may exist between the region 26 and the liquid agent opening 22*b*.

In more detail, for example, the region 26 is a region on the axis AX1 of the adjacent flow passage 231 in the gas-liquid contact chamber 21.

In the case of this embodiment, the liquid agent flow passage 22 includes the adjacent liquid agent flow passage 224 (FIGS. 7, 9, and 15) which is a part adjacent to the upstream sides of the plural branch flow passages (the first branch flow passages 221 and the second branch flow passages 222).

Figure 9:
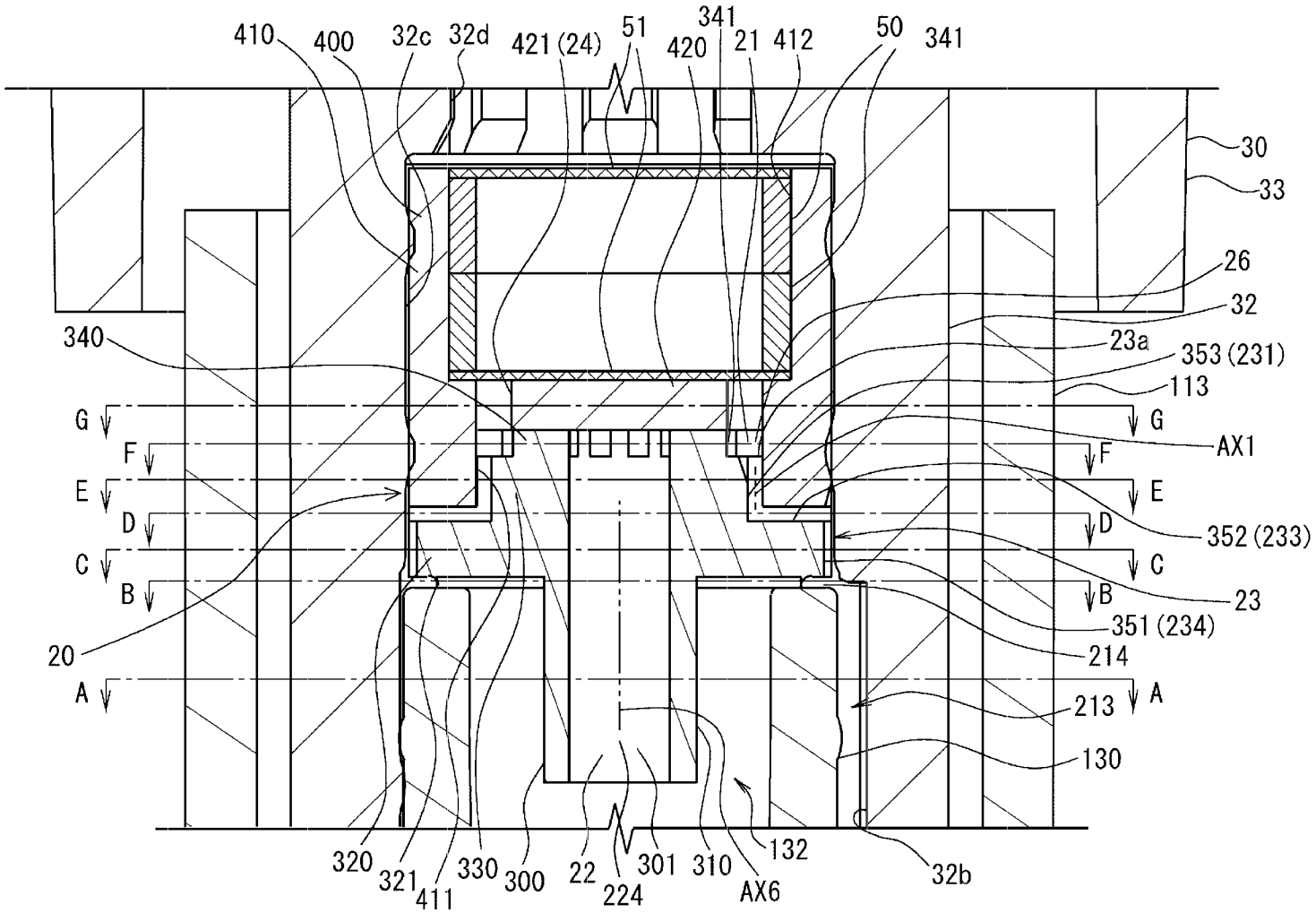
FIG. 9 is a partially enlarged view of FIG. 3.
Figure 10:
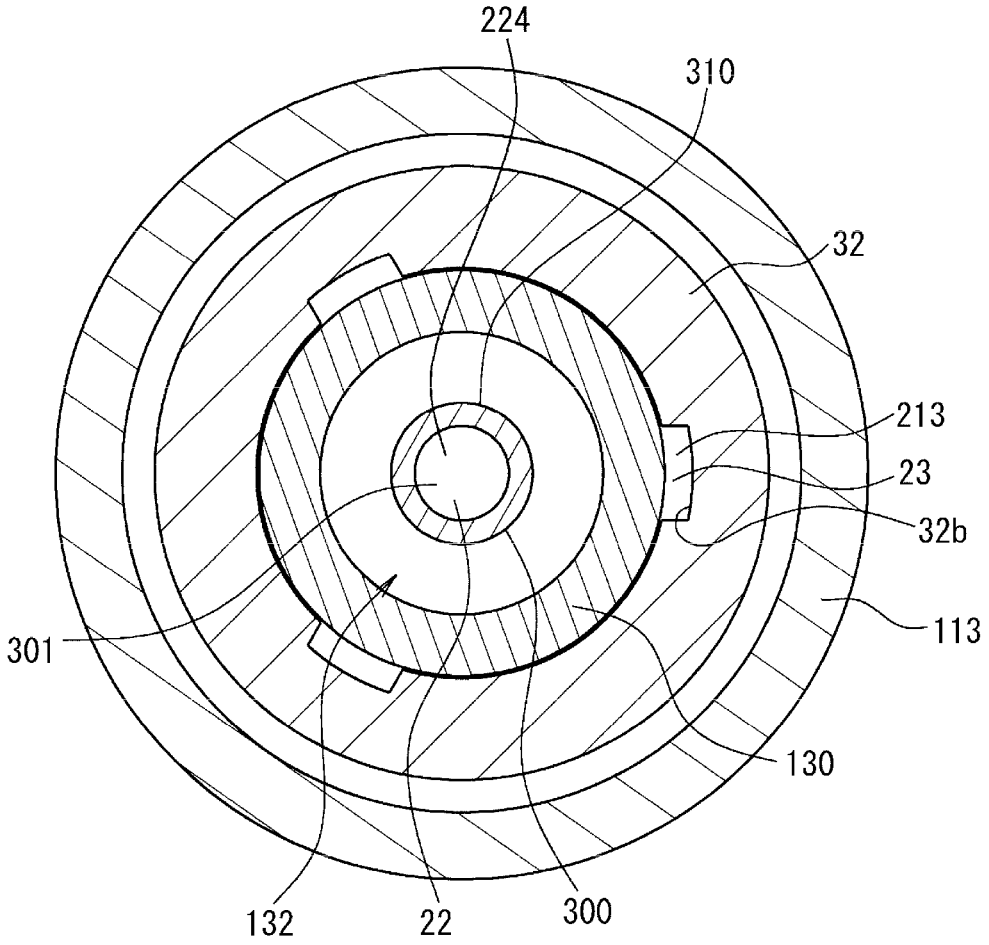
FIG. 10 is a sectional view taken along line A-A of FIG. 9.
Figure 11:
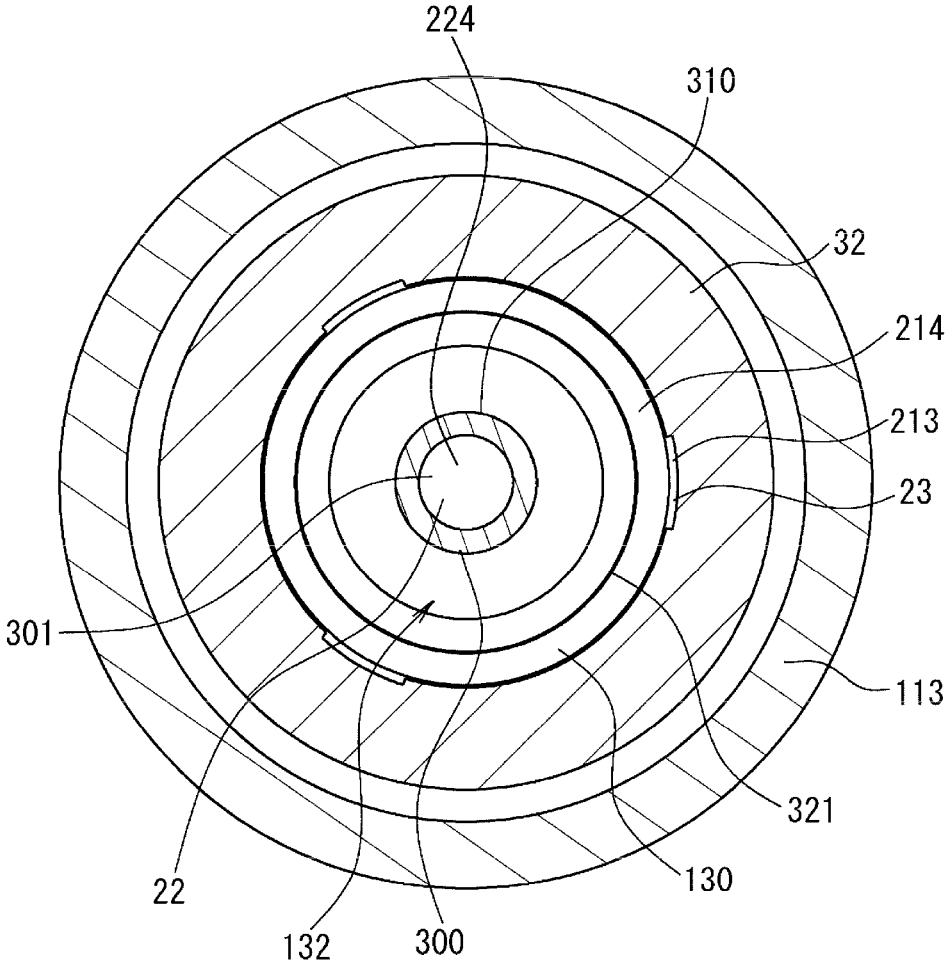
FIG. 11 is a sectional view taken along line B-B of FIG. 9.

The plural gas-liquid contact chambers 21 are arranged (arranged in a radial manner) as shown in FIG. 15, in a periphery of a downstream side end portion of the adjacent liquid agent flow passage 224 (for example, an upper end portion of the adjacent liquid agent flow passage 224 as shown in FIG. 9).

The plural branch flow passages (the first branch flow passages 221 and the second branch flow passages 222) extend toward the periphery (for example, extend in a radial manner) from the downstream side end portion of the adjacent liquid agent flow passage 224 in the in-plane direction crossing (for example, being orthogonal to) the adjacent liquid agent flow passage 224.

Here, in a plan view, each of the gas-liquid contact chambers 21 is arranged at a position separated from the downstream side end portion of the adjacent liquid agent flow passage 224, or at a position adjacent to the downstream side end portion of the adjacent liquid agent flow passage 224.

In more detail, in a plan view, eight gas-liquid contact chambers 21 are arranged at equal angle intervals (for example, at 45-degree intervals) in a periphery of the adjacent liquid agent flow passage 224.

As shown in FIG. 15, corresponding to each of the plural gas-liquid contact chambers 21, a pair of branch flow passages (the first branch flow passage 221 and the second branch flow passage 222), and a pair of liquid agent openings 22*a*, 22*b* in one-to-one correspondence with each of the pair of branch flow passages are arranged.

Each of the pair of branch flow passages includes a first part 225 extending in a radial manner from the downstream side end portion of the adjacent liquid agent flow passage 224 in the in-plane direction crossing the adjacent liquid agent flow passage 224, and a second part 226 extending in the in-plane direction which is the direction crossing the first part 225.

In more detail, the adjacent liquid agent flow passage 224 is formed by an internal space of a hole 301 of a tube portion 310 of a first member 300 to be described later, and the axis AX6 (FIGS. 7 and 9) of the adjacent liquid agent flow passage 224 extends in the up and down direction (in the vertical direction). The first part 225 and the second part 226 extend along a horizontal plane which is a plane orthogonal to the adjacent liquid agent flow passage 224.

The axis AX6 of the adjacent liquid agent flow passage 224 is arranged on the same axis as the axis AX5 of a liquid agent pump chamber 220 to be described later.

In this embodiment, the direction horizontally extending in a radial manner from certain position on the axis AX6 or an extension position of the axis AX6 may be called the radial direction. In the radial direction, the direction toward the axis AX6 is the radially inner side, and the direction away from the axis AX6 is the radially outer side. In addition, the direction circumferentially surrounding the axis AX6 or an extension line of the axis AX6 may be called the circumferential direction.

One of the pair of the branch flow passages (the first branch flow passage 221 and the second branch flow passage 222) corresponding to one gas-liquid contact chamber 21 (the first branch flow passage 221) shares a first part 225 with one of the branch flow passages of a gas-liquid contact chamber 21 adjacent to the above gas-liquid contact chamber 21 on one side, and the other branch flow passage shares a first part 225 with one of the branch flow passages of a gas-liquid contact chamber 21 adjacent to the above gas-liquid contact chamber 21 on the other side.

Figure 16:
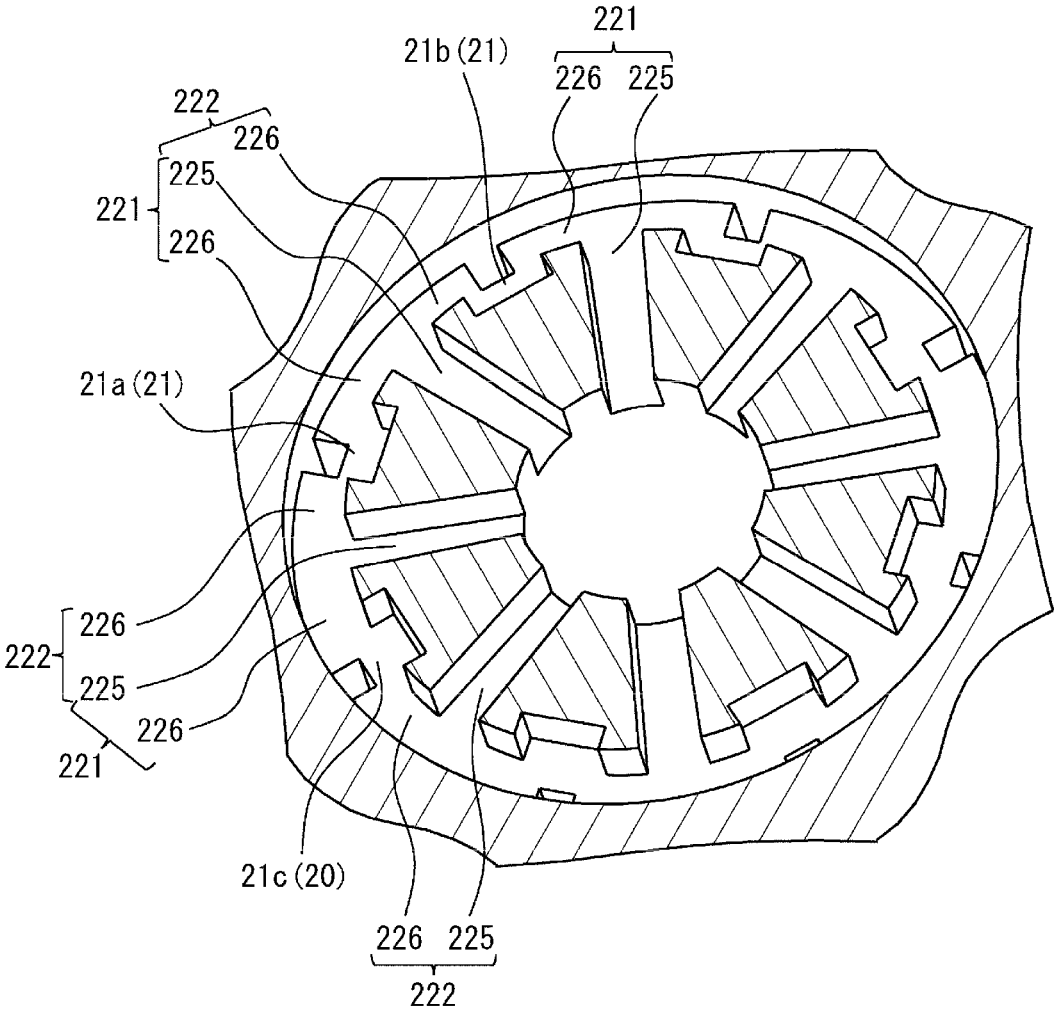
FIG. 16 is a perspective sectional view showing part of the region shown in FIG. 15.
Figure 17:
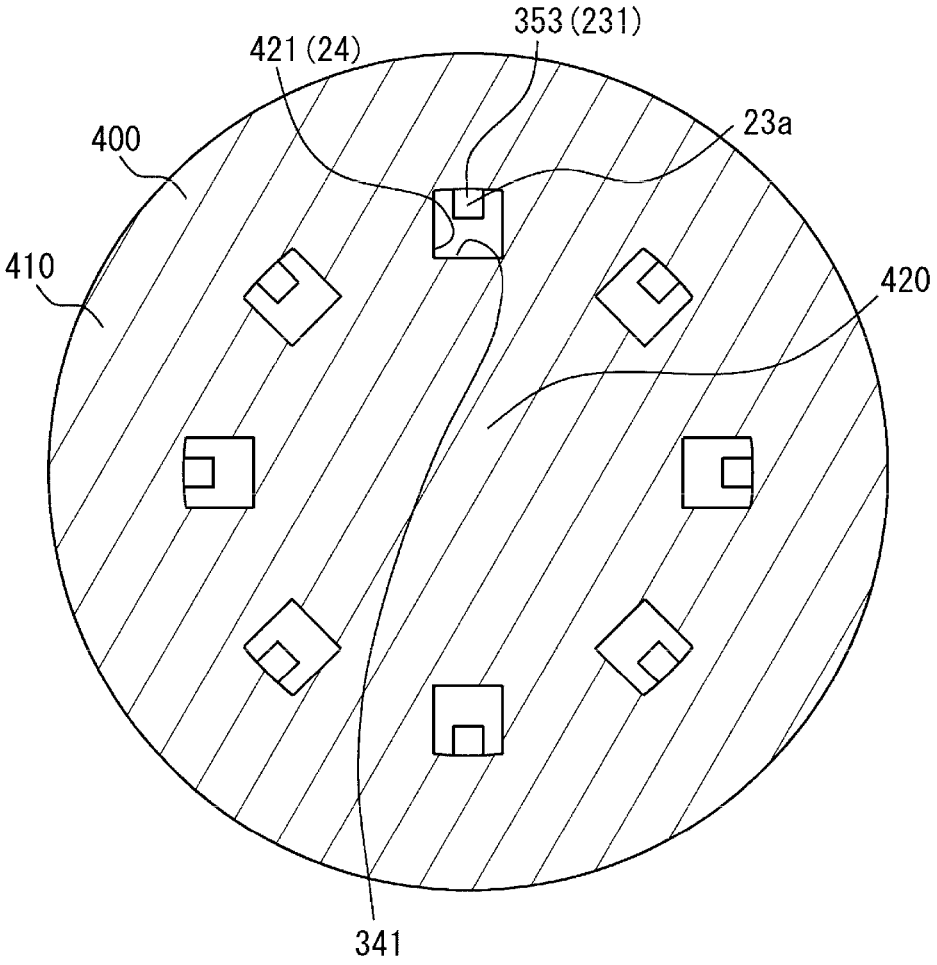
FIG. 17 is a sectional view taken along line G-G of FIG. 9, the view enlarging and showing a range narrower than FIGS. 10 to 14.

Now, a gas-liquid contact chamber 21*a* shown in FIG. 16 will be described. A first branch flow passage 221 serving as one of the first branch flow passage 221 and the second branch flow passage 222 corresponding to the gas-liquid contact chamber 21*a* shares a first part 225 with a second branch flow passage 222 serving as one of the branch flow passages of a gas-liquid contact chamber 21*b* which is a gas-liquid contact chamber 21 adjacent to the above gas-liquid contact chamber 21*a* on one side. A second branch flow passage 222 serving as the other branch flow passage of the first branch flow passage 221 and the second branch flow passage 222 corresponding to the gas-liquid contact chamber 21*a* shares a first part 225 with a first branch flow passage 221 serving as one of the branch flow passages of a gas-liquid contact chamber 21*c* which is a gas-liquid contact chamber 21 adjacent to the above gas-liquid contact chamber 21*a* on the other side.

Each of the first parts 225 branches into two second parts 226 running in opposite directions to each other. A downstream end of each of the second parts 226 forms the liquid agent opening 22*a* or the liquid agent opening 22*b*.

As described above, in the case of this embodiment, the foamer mechanism 20 includes eight gas-liquid contact chambers 21. Therefore, the foamer mechanism 20 includes eight first parts 225, and sixteen second parts 226.

In the case of this embodiment, the liquid agent openings 22*a*, 22*b* of the plural branch flow passages (the first branch flow passage 221 and the second branch flow passage 222) oppose each other across the gas-liquid contact chamber 21.

That is, when seen in the direction of the axis AX2 of the liquid agent opening 22*a*, a partial region of the liquid agent opening 22*a* overlaps with a partial region of the liquid agent opening 22*b*. When seen in the direction of the axis AX3 of the liquid agent opening 22*b*, the partial region of the liquid agent opening 22*b* overlaps with the partial region of the liquid agent opening 22*a*. The axis AX2 is a normal line of the liquid agent opening 22*a*, and the axis AX3 is a normal line of the liquid agent opening 22*b*.

In more detail, for example, the axis AX2 of the liquid agent opening 22*a* crosses the axis AX3 of the liquid agent opening 22*b*. The axis AX2 and the axis AX3 respectively horizontally extend.

In more detail, the liquid agent opening 22*a* and the liquid agent opening 22*b* are arranged plane-symmetrically with respect to a symmetric surface S shown in FIG. 15. The symmetric surface S is a vertical surface placed along the radial direction, the surface passing through the center of the gas opening 23*a*.

In the case of this embodiment, opening areas of the liquid agent openings 22*a*, 22*b* that are open to the gas-liquid contact chamber 21 are equal to each other.

In more detail, opening shapes of the liquid agent openings 22*a*, 22*b* that are open to the gas-liquid contact chamber 21 are equal to each other. For example, the liquid agent openings 22*a*, 22*b* are respectively formed in a rectangular shape. However, the shapes of the liquid agent openings 22*a*, 22*b* are not limited to this example but may be a circular shape, an oval shape, or a polygonal shape other than a rectangular shape.

As shown in FIGS. 7 and 9, the gas flow passage 23 includes axial gas flow passages 234 and radial gas flow passages 233 through which the gas supplied via axial flow passages 213 and a circulating flow passage 214 to be described later passes successively.

Figure 12:
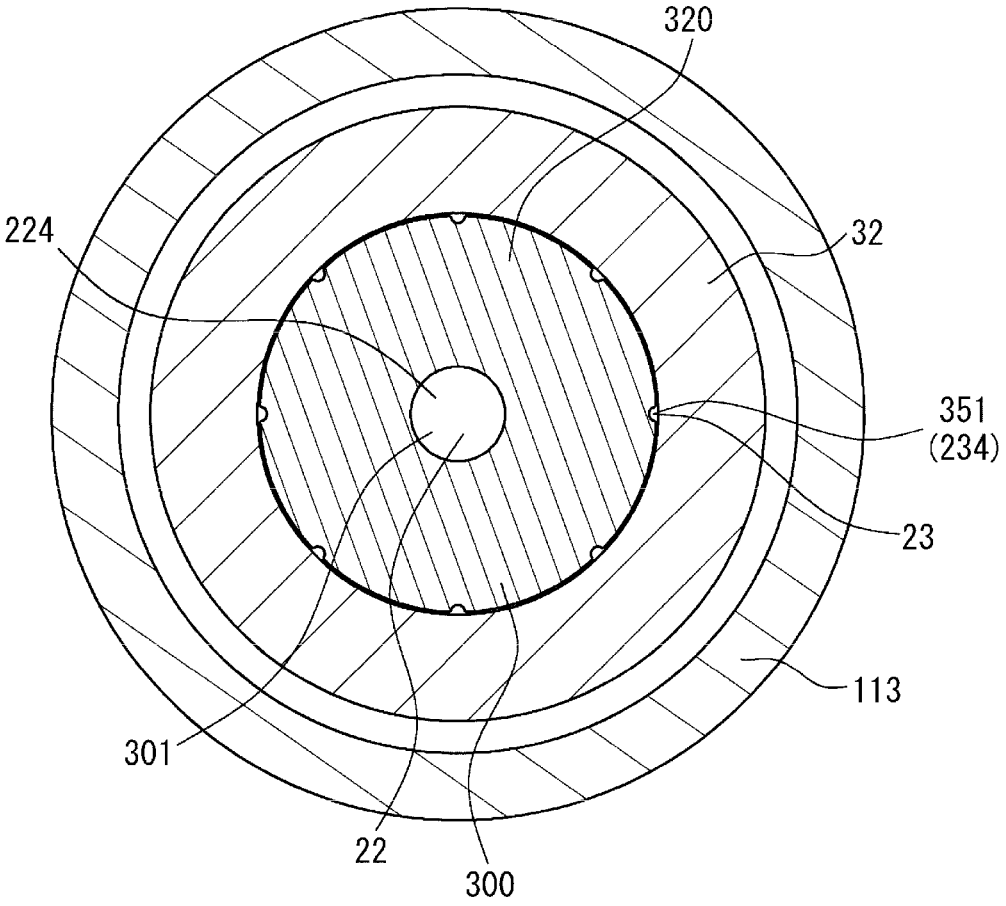
FIG. 12 is a sectional view taken along line C-C of FIG. 9.

As shown in FIG. 12, for example, eight axial gas flow passages 234 are arranged at equal angle intervals in the periphery of the adjacent liquid agent flow passage 224. The axial gas flow passages 234 extend in the up and down direction, and supply the gas upward.

Figure 13:
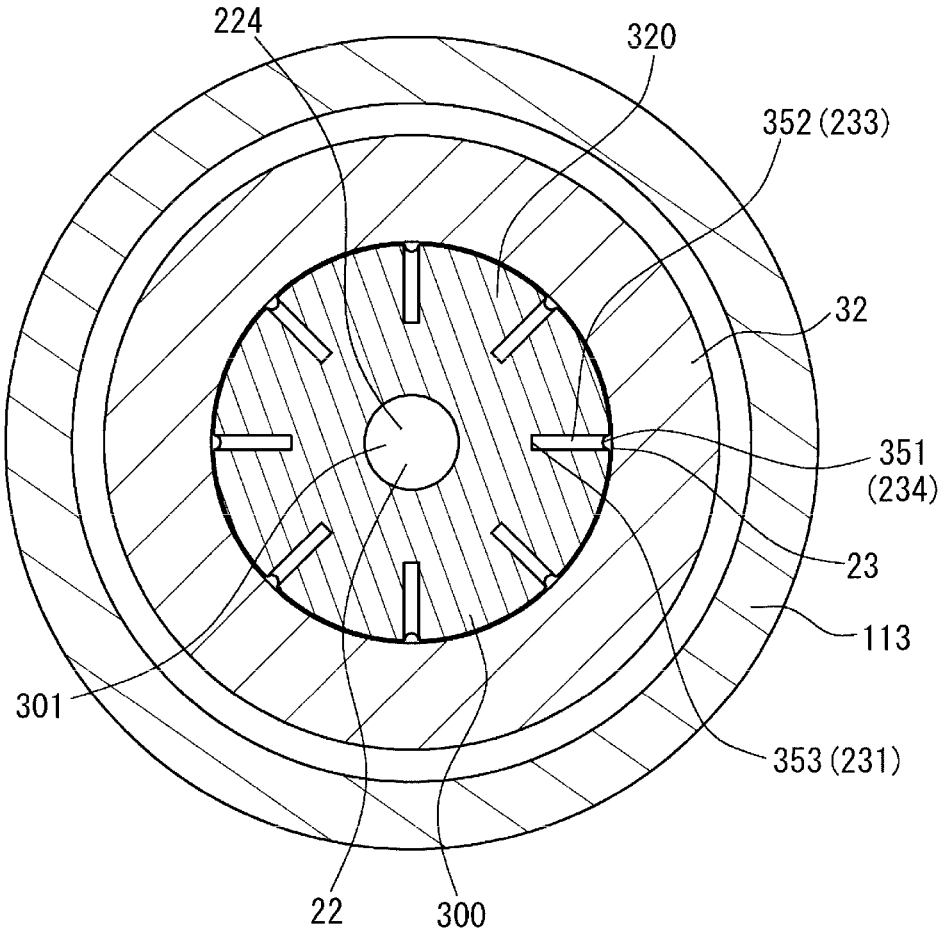
FIG. 13 is a sectional view taken along line D-D of FIG. 9.
Figure 14:
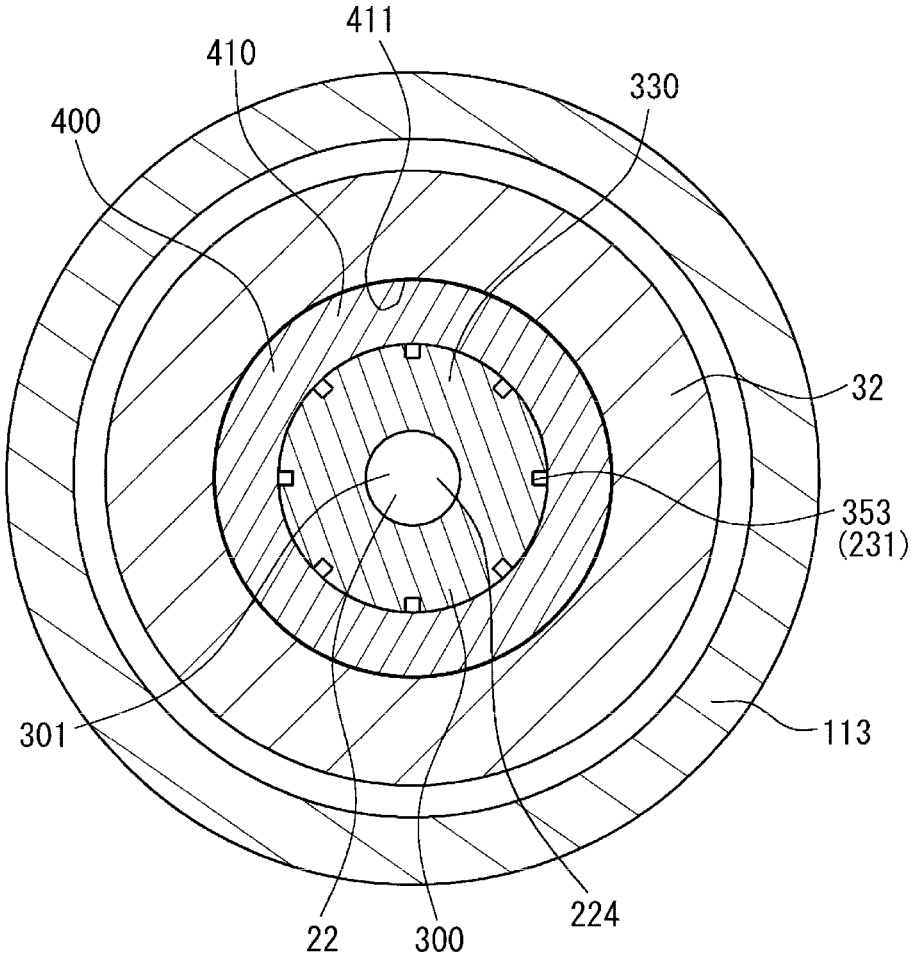
FIG. 14 is a sectional view taken along line E-E of FIG. 9.

As shown in FIGS. 7 and 9, the radial gas flow passages 233 respectively communicate with downstream ends (upper ends) of the axial gas flow passages 234. As shown in FIG. 13, for example, eight radial gas flow passages 233 are arranged at equal angle intervals in the periphery of the adjacent liquid agent flow passage 224. The radial gas flow passages 233 horizontally extend in a radial manner in the periphery of the adjacent liquid agent flow passage 224. The radial gas flow passages 233 supply the gas from the radially outer side to the inner side.

As shown in FIGS. 7 and 9, the adjacent flow passages 231 respectively communicate with downstream ends (end portions on the radially inner side) of each of the radial gas flow passages 233. As shown in FIG. 15, for example, eight adjacent flow passages 231 are arranged at equal angle intervals in the periphery of the adjacent liquid agent flow passage 224. Each of the adjacent flow passages 231 extend in the up and down direction and supply the gas upward.

That is, the adjacent flow passages 231 extend in parallel to the adjacent liquid agent flow passage 224. The plural (in the case of this embodiment, eight) adjacent flow passages 231 extend in parallel to the axial direction (the direction of the axis AX6) of the adjacent liquid agent flow passage 224.

In this embodiment, as a liquid agent 101, a hand soap may be provided as a typical example. However, the liquid agent is not limited to this but may be various items used in a foam form including a facial cleanser, a make-up remover, a dishwashing detergent, a hair liquid, a body wash, a shaving cream, skincare items such as a make-up foundation and beauty serum, a hair dye, and an antiseptic solution.

Viscosity of the liquid agent 101 before being formed is not particularly limited but may be set, for example, as equal to or more than about 1 mPa·s and equal to or less than 10 mPa·s at 20 degrees centigrade.

The foam dispensing container 100 according to this embodiment has the structure suitable for foaming of the highly-viscous liquid agent 101 in particular. For example, it is also possible to preferably foam the liquid agent 101 having viscosity equal to or more than 100 mPa·s at 20 degrees centigrade.

Figure 2:
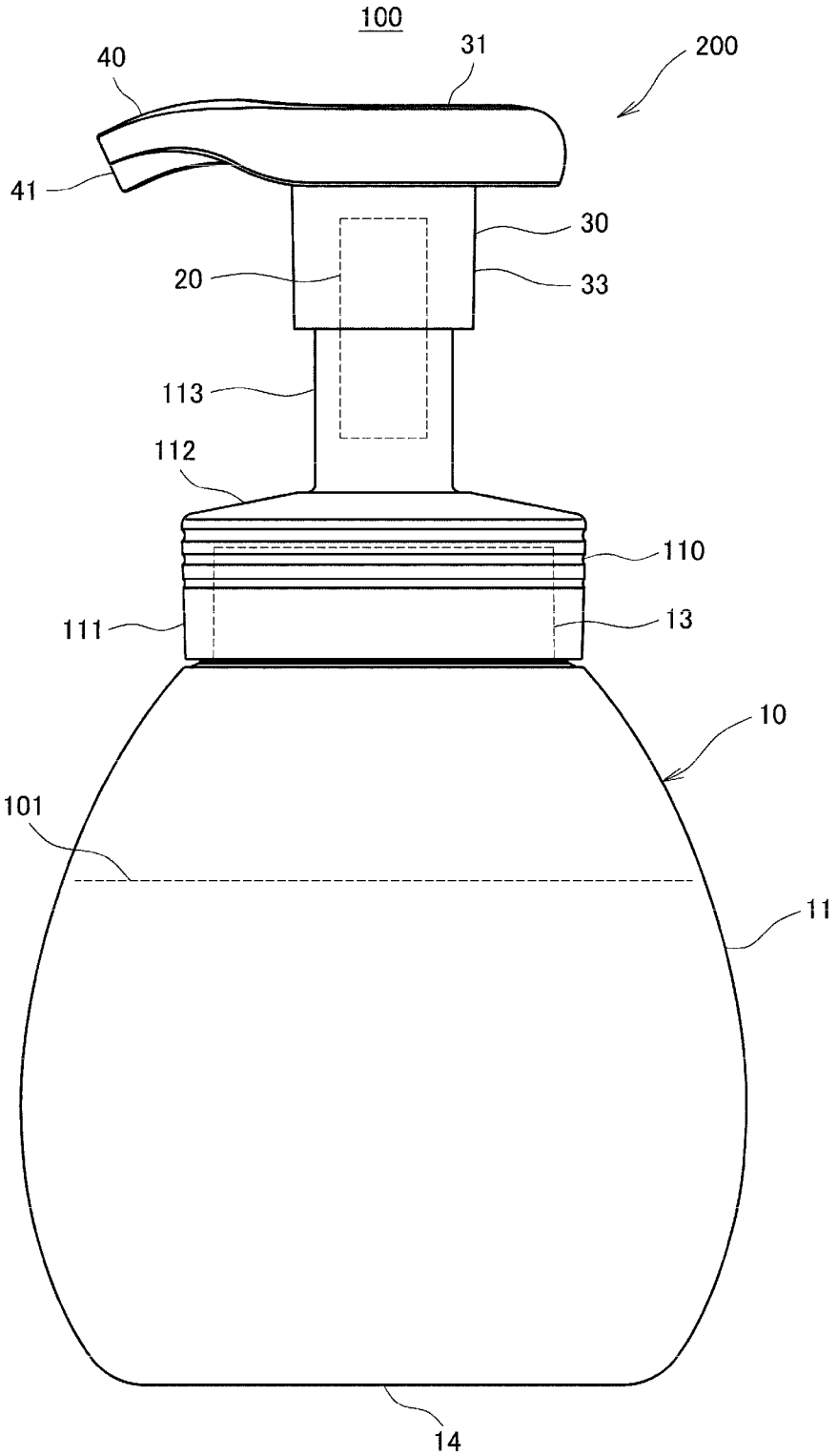
FIG. 2 is a side view of a foam dispensing container according to a second embodiment.

As shown in FIG. 2, the foam dispensing container 100 includes a container main body 10 that stores the liquid agent 101 and a foam dispensing cap 200 detachably mounted on the container main body 10.

The shape of the container main body 10 is not particularly limited. However, for example, as shown in FIG. 2, the container main body 10 is formed in a shape having a tubular trunk portion 11, a cylindrical neck portion 13 continuously connected to an upper side of the trunk portion 11, and a bottom portion 14 that closes a lower end of the trunk portion 11. An opening is formed in an upper end of the neck portion 13.

The liquid agent 101 is charged in the container main body 10. That is, the foam dispensing container 100 includes the liquid agent 101 charged in the container main body 10.

In the foam dispensing container 100, the liquid agent 101 stored in the container main body 10 is changed into a foam form by bringing the liquid agent 101 into contact with the air in the gas-liquid contact chambers 21 at normal pressure. In this specification, the liquid agent 101 in a foam form will be called a foam body in order to distinguish the foam body from the liquid agent 101 in a non-foam form stored in the container main body 10.

In the case of this embodiment, the foam dispensing container 100 is, for example, a mechanical pump container that foams the liquid agent 101, produces a foam body, and discharges the foam body upon pressing down an operation receiving portion 31 of a head member (head portion) 30. In the case of this embodiment, a liquid agent supply portion that supplies the liquid agent 101 to the foamer mechanism 20 is, for example, a liquid agent cylinder of a liquid agent pump, and a gas supply portion that supplies the gas to the foamer mechanism 20 is, for example, a gas cylinder of a gas pump.

However, unlike this embodiment, a foam dispensing container may be a so-called squeeze bottle in which a foam body is discharged by pressing and squeezing a container main body.

Here, the liquid agent supply portion (liquid agent cylinder) is formed to be long in one direction (the up and down direction). The adjacent liquid agent flow passage 224 is arranged on the same axis as the long axis direction of the liquid agent supply portion. That is, the axis AX6 of the adjacent liquid agent flow passage 224 has the same axis as the axis AX5 of the liquid agent pump chamber 220 (see FIG. 3).

Figure 3:
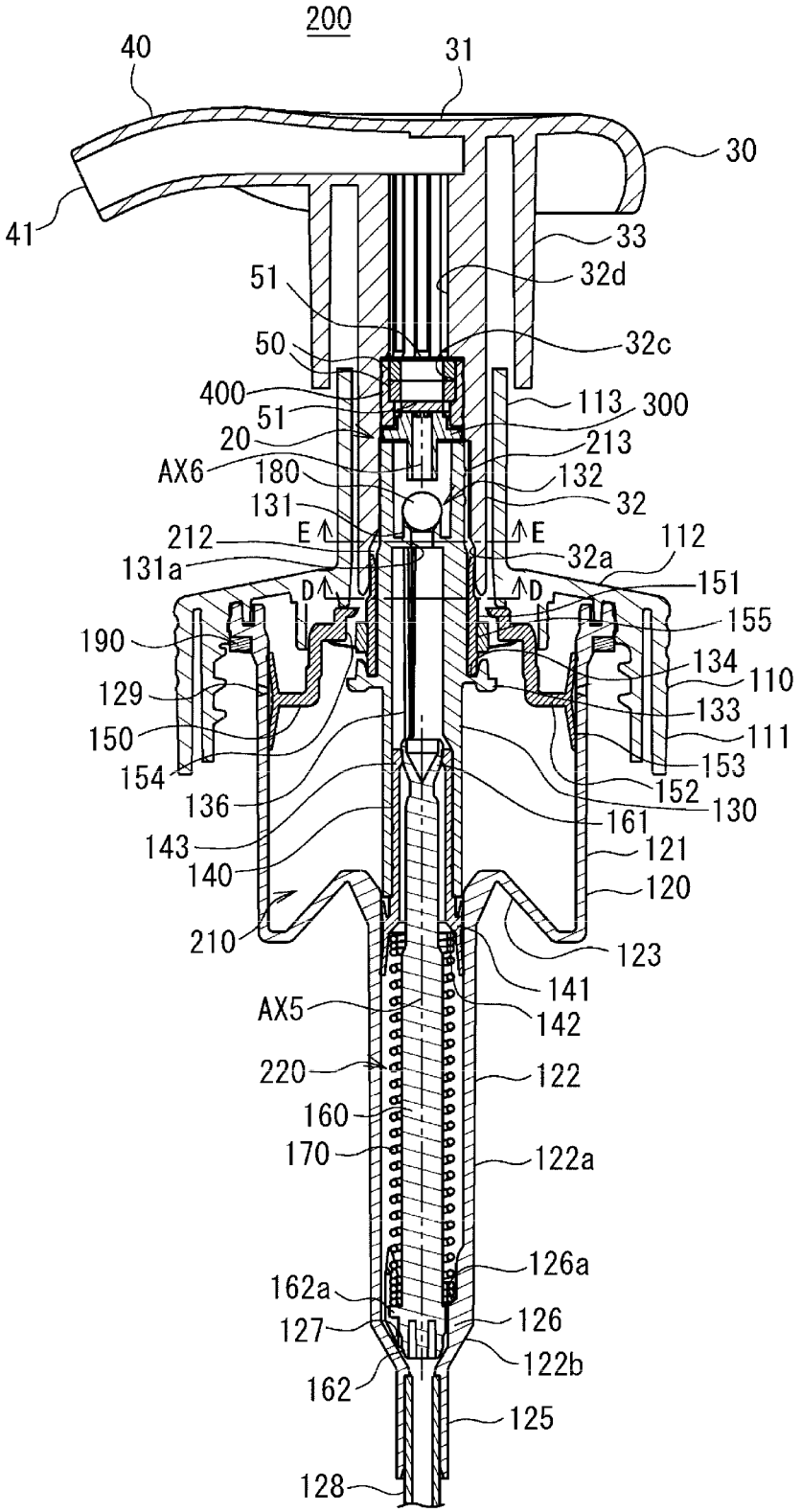
FIG. 3 is a side sectional view of a foam dispensing cap according to the second embodiment.

As shown in FIG. 3, the foam dispensing cap 200 includes a cap member 110 having a cylindrical mounting portion 111 which is detachably mounted on the neck portion 13 by a securing method such as screwing, a cylinder member 120 fixed to the cap member 110 to form a cylinder of the liquid agent pump and the gas pump, and the head member 30 having the operation receiving portion 31 that receives a press-down operation.

By mounting the mounting portion 111 on the neck portion 13, the entire foam dispensing cap 200 is mounted on the neck portion 13. The mounting portion 111 may be formed in a double-tube structure as shown in FIG. 3 and an inner tubular portion of the double-tube structure may be screwed to the neck portion 13, or may be formed in a single tube shape. By mounting the foam dispensing cap 200 to the neck portion 13, an opening of the neck portion 13 is closed by the foam dispensing cap 200.

The cap member 110 includes an annular closing portion 112 that closes an upper end portion of the mounting portion 111, and a standing tube portion 113 formed in a cylindrical shape having a smaller diameter than the mounting portion 111, the standing tube portion standing upward from a central portion of the annular closing portion 112.

The cylinder member 120 includes a cylindrical gas cylinder forming portion 121 fixed to a lower surface side of the annular closing portion 112 of the cap member 110, a cylindrical liquid agent cylinder forming portion 122 having a smaller diameter than the gas cylinder forming portion 121, and an annular coupling portion 123. The annular coupling portion 123 couples a lower end portion of the gas cylinder forming portion 121 and an upper end portion of the liquid agent cylinder forming portion 122. The liquid agent cylinder forming portion 122 is suspended down from the gas cylinder forming portion 121.

The gas cylinder forming portion 121, the liquid agent cylinder forming portion 122, the mounting portion 111, and the standing tube portion 113 are arranged on the same axis.

An upper end portion of the gas cylinder forming portion 121 is fixed to the annular closing portion 112 by fitting, etc., to the lower surface side of the annular closing portion 112.

The cylinder (gas cylinder) of the gas pump includes the gas cylinder forming portion 121 and the annular coupling portion 123.

A piston of the gas pump is formed by a gas piston 150 to be described later.

Hereinafter, a part of an internal space of the gas cylinder forming portion 121 between the gas piston 150 and the annular coupling portion 123 will be called a gas pump chamber 210.

The volume of the gas pump chamber 210 is increased/decreased in accordance with upward/downward movement of the gas piston 150.

Meanwhile, the cylinder (liquid agent cylinder) of the liquid agent pump includes the liquid agent cylinder forming portion 122.

A piston of the liquid agent pump includes a liquid piston 140 to be described later.

The liquid agent pump chamber 220 is a space between a liquid agent discharge valve and a liquid agent suction valve to be described later. The volume of the liquid agent pump chamber 220 is increased/decreased in accordance with upward/downward movement of the liquid piston 140 and a piston guide 130 to be described later.

The liquid agent cylinder (liquid agent supply portion) is formed to pressurize the liquid agent 101 inside and supply the liquid agent 101 to the foamer mechanism 20.

The gas cylinder (gas supply portion) is arranged in a periphery of the liquid agent cylinder, and formed to pressurize the gas inside and supply the gas to the foamer mechanism 20.

In more detail, the foam dispensing container 100 includes the head member 30 held in the mounting portion 111 upward/downward-movably with respect to the mounting portion 111, the head member to be pressed down relatively with respect to the mounting portion 111. The foamer mechanism 20 and a discharge port 41 are held in the head member 30.

When the head member 30 is pressed down relatively with respect to the mounting portion 111, the liquid agent 101 inside the liquid agent supply portion (inside the liquid agent pump chamber 220) and the gas inside the gas supply portion (inside the gas pump chamber 210) are respectively pressurized and supplied to the foamer mechanism 20.

The liquid agent cylinder forming portion 122 includes a straight portion 122*a* formed in a straight shape extending in the up and down direction, and a reduced-diameter portion 122*b* continuously connected to a lower part of the straight portion 122*a*, the reduced-diameter portion having a diameter which is gradually reduced toward the lower part.

A spring receiving portion 126*a* that receives a lower end of a coil spring 170 is formed in an inner circumference of a lower end portion of the straight portion 122*a*. This spring receiving portion 126*a* is formed by upper side end surfaces of plural ribs 126 formed at predetermined angle intervals such as equal angle intervals in an inner circumference of a lower end portion of the liquid agent cylinder forming portion 122.

A lower portion on an inner circumferential surface of the reduced-diameter portion 122*b* forms a valve seat 127 which can closely contact with a valve body 162 formed by a lower end portion of a poppet 160 to be described later in a liquid-tight manner.

Further, the cylinder member 120 includes a cylindrical tube holding portion 125 continuously connected to a lower part of the liquid agent cylinder forming portion 122. By inserting an upper end portion of a dipping tube 128 into this tube holding portion 125, the dipping tube 128 is held at a lower end portion of the cylinder member 120. It is possible to suction the liquid agent 101 in the container main body 10 into the liquid agent pump chamber 220 via this dipping tube 128.

A packing 190 is externally fitted onto an upper end portion of the cylinder member 120. By airtightly contacting the packing 190 to the upper end of the neck portion 13 in a circular manner in a state where the cap member 110 is mounted on the container main body 10 by being screwed, an internal space of the container main body 10 is sealed.

A through hole 129 passing through the gas cylinder forming portion 121 from the interior to the exterior is formed in the gas cylinder forming portion 121. In a state where the head member 30 is positioned at a top dead point, the through hole 129 is closed by an outer circumferential ring portion 153 of the gas piston 150 to be described later.

The head member 30 has the operation receiving portion 31 that receives the press-down operation, and double tubular portions suspended downward from the operation receiving portion 31, that is, an inner tube portion 32 and an outer tube portion 33. Upper ends of the inner tube portion 32 and the outer tube portion 33 are closed by the operation receiving portion 31.

The inner tube portion 32 extends downward longer than the outer tube portion 33. The inner tube portion 32 is inserted into the standing tube portion 113 of the cap member 110.

The inner tube portion 32 is held in the mounting portion 111 indirectly (via the cylinder member 120, the coil spring 170, etc.)

It is possible to make the press-down operation to the head member 30 against bias of the coil spring 170 within a range from the top dead point to a bottom dead point. When the press-down operation is cancelled, the head member is restored to the top dead point in accordance with the bias of the coil spring 170.

The head member 30 moves upward and downward relatively with respect to the cap member 110. At the time of this upward/downward movement, the inner tube portion 32 is guided by the standing tube portion 113. An inner diameter of the outer tube portion 33 is set to be larger than an outer diameter of the standing tube portion 113. When the head member 30 is pressed down, the standing tube portion 113 is housed in a gap between the outer tube portion 33 and the inner tube portion 32.

The head member 30 integrally has a nozzle portion 40. The nozzle portion 40 projects forward from the operation receiving portion 31. An internal space of the nozzle portion 40 communicates with an internal space of the inner tube portion 32 at an upper end portion of the inner tube portion 32. The discharge port 41 is formed at a leading end of the nozzle portion 40.

In a state where the head member 30 is not pressed down (normal state), by an action of the coil spring 170, an up-down position of the head member 30 with respect to the cap member 110 and the cylinder member 120 is maintained at an upper limit position (top dead point) (FIG. 3). This upper limit position is, for example, a position where an upper end of a piston portion 152 of the gas piston 150 to be described later is abutted with the annular closing portion 112 of the cylinder member 120.

Meanwhile, by a user performing an operation to press down the head member 30 against the bias of the coil spring 170, the head member 30 is lowered relatively with respect to the cap member 110 and the cylinder member 120. A lower limit position (bottom dead point) of the head member 30 is, for example, a position where a lower end of a flange portion 133 of the piston guide 130 to be described later is abutted with the annular coupling portion 123 of the cylinder member 120.

Here, the foamer mechanism 20 is housed in the inner tube portion 32 of the head member 30, and held in the inner tube portion 32. The head member 30 is held in the mounting portion 111 indirectly via the cylinder member 120, the coil spring 170, the liquid piston 140, and the piston guide 130. The head member 30 includes the discharge port 41.

That is, the foam dispensing container 100 includes the container main body 10 that stores the liquid agent 101, and the mounting portion 111 mounted on the container main body 10, and the foamer mechanism 20 and the discharge port 41 are held in the mounting portion 111.

The foam dispensing cap 200 further includes the piston guide 130, the liquid piston 140, the gas piston 150, a suction valve member 155, the poppet 160, the coil spring 170, and a ball valve 180.

Among those elements, the piston guide 130 is fixed to the head member 30, and the liquid piston 140 is fixed to the head member 30 via the piston guide 130. Therefore, the head member 30, the piston guide 130, and the liquid piston 140 are integrally moved upward/downward.

The gas piston 150 is externally fitted onto the piston guide 130 in a movably inserted state, and is movable upward/downward relatively with respect to the piston guide 130. The suction valve member 155 is fixed to the gas piston 150.

The poppet 160 is inserted into the liquid piston 140 and is movable upward/downward relatively with respect to the liquid piston 140.

The coil spring 170 is externally fitted onto the poppet 160 in a movably inserted state.

The ball valve 180 is held upward/downward-movably between a valve seat portion 131 to be described later and a lower end of the tube portion 310 of the first member 300 to be described later.

The piston guide 130 is formed in a cylindrical shape (circular pipe shape) elongated in the up and down direction. An upper end portion of the piston guide 130 is inserted into a lower end portion of the inner tube portion 32 of the head member 30 and fixed to the inner tube portion 32. The piston guide 130 is suspended downward from a lower end of the inner tube portion 32 of the head member 30.

The cylindrical valve seat portion 131 is formed inside the upper end portion of the piston guide 130, and the ball valve 180 is arranged on this valve seat portion 131. The liquid agent discharge valve is formed by the ball valve 180 and the valve seat portion 131. An internal space of a part of the piston guide 130, the part being above the valve seat portion 131 forms a housing space 132 that houses the ball valve 180 and the tube portion 310 of the first member 300. The housing space 132 communicates with an internal space of the piston guide 130 on the lower side from the valve seat portion 131 (that is, the liquid agent pump chamber 220) via a through hole 131*a* formed in the center of the valve seat portion 131.

The flange portion 133 is formed at an up-down central portion of the piston guide 130. A ring-shaped valve forming groove 134 is formed on an upper surface of the flange portion 133.

A tubular portion 151 of the gas piston 150 is externally fitted onto an upper portion of the piston guide 130 in a movably inserted state. The upper portion of the piston guide 130 here indicates a part of the piston guide 130 on the upper side from the flange portion 133, the part of the piston guide 130 being on the lower side from a part inserted into and fixed to the inner tube portion 32.

A gas discharge valve is formed by the valve forming groove 134 on the upper surface of the flange portion 133 and a lower end portion of the tubular portion 151 of the gas piston 150.

Figure 27:
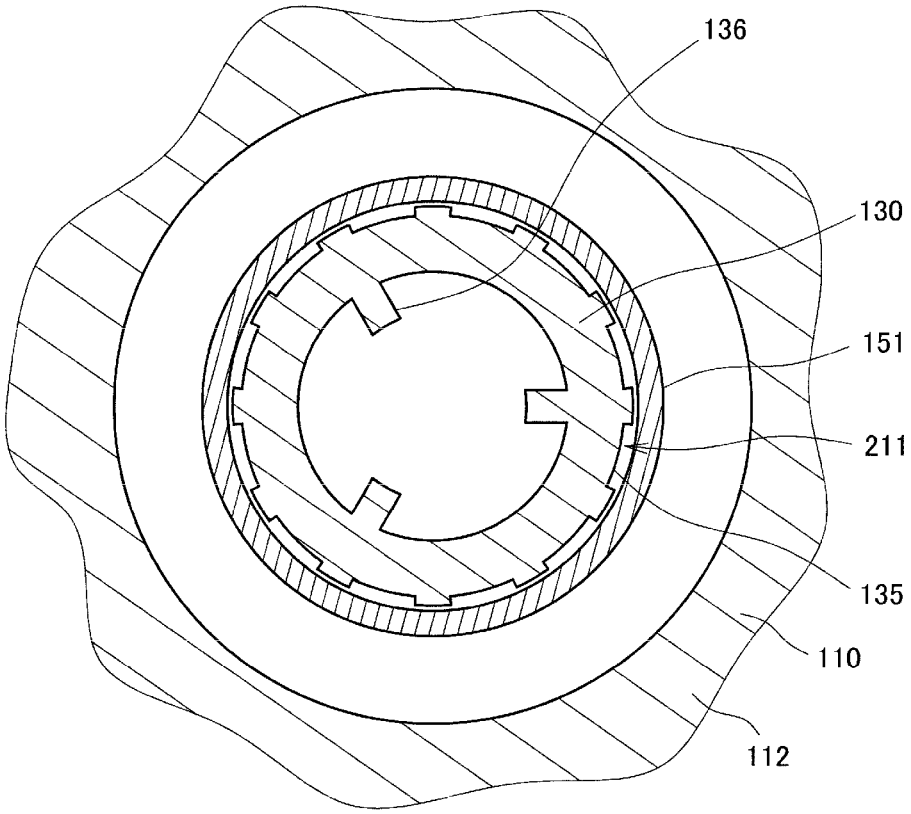
FIG. 27 is a sectional view taken along line D-D of FIGS. 3 and 22.

Further, plural flow passage forming grooves 135 (FIG. 27) respectively extending in the up and down direction are formed on an outer circumferential surface of a part of the piston guide 130 onto which the tubular portion 151 is externally fitted. A gap between the flow passage forming grooves 135 and an inner circumferential surface of the tubular portion 151 of the gas piston 150 forms a flow passage 211 (FIG. 27) through which the gas flowing out of the gas pump chamber 210 via the gas discharge valve passes.

The outer diameter size of a part of the piston guide 130 on the lower side from the flange portion 133 is set to be slightly smaller than the inner diameter size of the straight portion 122*a* of the liquid agent cylinder forming portion 122. The part is guided by the straight portion 122*a* when the piston guide 130 is moved upward/downward.

Plural ribs 136 respectively extending in the up and down direction are formed on an inner circumferential surface of a part of the piston guide 130 on the lower side from the valve seat portion 131 (the part being on the upper side from a part to which the liquid piston 140 is inserted and fixed (for example, pressure-fixed)). These ribs 136 are able to be brought into contact with the poppet 160 in a pressed contact state.

The liquid piston 140 is formed in a cylindrical shape (circular pipe shape). An outer circumferential piston portion 141 formed in a shape projecting radially outward is formed at a lower end portion of the liquid piston 140.

A part of the liquid piston 140 on the upper side from the outer circumferential piston portion 141 is inserted into and fixed to (for example, pressure-fixed to) a lower end portion of the piston guide 130.

The outer circumferential piston portion 141 of the liquid piston 140 is inserted into the straight portion 122*a* of the liquid agent cylinder forming portion 122. The outer diameter size of the outer circumferential piston portion 141 is set to be equal to the inner diameter size of the straight portion 122*a*. The outer circumferential piston portion 141 is in liquid-tight contact with an inner circumferential surface of the straight portion 122*a* in a circular manner, and slides with respect to the inner circumferential surface of the straight portion 122*a* when the outer circumferential piston portion 141 is moved upward/downward.

An inner circumferential surface of the outer circumferential piston portion 141 includes an obliquely-stepped spring receiving portion 142 that receives an upper end of the coil spring 170.

An upper end portion of the liquid piston 140 serves as a constriction portion 143 having a smaller inner diameter than the other portions.

The gas piston 150 includes the tubular portion 151 formed in a cylindrical shape and externally fitted onto the upper portion of the piston guide 130 (the part on the upper side from the flange portion 133) in a movably inserted state, and the piston portion 152 projecting radially outward from the tubular portion 151.

The tubular portion 151 is slidable upward/downward relatively with respect to the upper portion of the piston guide 130.

An upper end portion of the tubular portion 151 is inserted into the lower end portion of the inner tube portion 32. A lower end portion of the tubular portion 151 is formed in a shape with which the lower end portion is fittable into the valve forming groove 134 on the upper surface of the flange portion 133 of the piston guide 130.

The outer circumferential ring portion 153 is formed in a peripheral edge portion of the piston portion 152. The outer circumferential ring portion 153 is airtight contact with an inner circumferential surface of the gas cylinder forming portion 121 in a circular manner, and slides with respect to the inner circumferential surface of the gas cylinder forming portion 121 when the gas piston 150 is moved upward/downward.

A lower limit position of relative movement (upward/downward movement) of the tubular portion 151 with respect to the piston guide 130 is a position where the lower end portion of the tubular portion 151 is abutted with the valve forming groove 134 and the gas discharge valve is brought into a closed state.

Meanwhile, an inner circumferential surface of the lower end portion of the inner tube portion 32 includes an upward movement regulating portion 32*a* that regulates upward movement of the tubular portion 151 with respect to the piston guide 130 and the inner tube portion 32. That is, an upper limit position of the relative movement (upward/ downward movement) of the tubular portion 151 with respect to the piston guide 130 is a position where, after the gas discharge valve is brought into an open state by separating the lower end portion of the tubular portion 151 from the valve forming groove 134, the movement of the upper end portion of the tubular portion 151 is regulated by the upward movement regulating portion 32*a*.

Plural suction openings 154 passing through the piston portion 152 in the up and down direction are formed in a part of the piston portion 152 in the vicinity of the tubular portion 151.

The annular suction valve member 155 is externally fitted onto a lower portion in the tubular portion 151 of the gas piston 150. The suction valve member 155 has a valve body which is an annular film projecting radially outward.

A gas suction valve is formed by the valve body of the suction valve member 155 and a lower surface of the piston portion 152.

When the head member 30 is pressed down, that is, when the gas pump chamber 210 contracts, by closely contacting the valve body of the suction valve member 155 to the lower surface of the piston portion 152, the suction openings 154 are closed from the lower side.

Meanwhile, when the head member 30 moves upward, that is, when the gas pump chamber 210 is extended, by separating the valve body of the suction valve member 155 from the lower surface of the piston portion 152, the external air is taken into the gas pump chamber 210 via the suction openings 154.

The poppet 160 is a rod-shaped member elongated in the up and down direction, and is inserted from the interior of the piston guide 130 through to the interior of the liquid agent cylinder forming portion 122 in a state where the poppet passes through the liquid piston 140.

An upper end portion 161 of the poppet 160 is formed to have a larger diameter than an up-down intermediate portion of the poppet 160, and brought into contact with the plural ribs 136 of the piston guide 130 in a pressed contact state. The upper end portion 161 of the poppet 160 is formed to have a larger diameter than an inner diameter of the constriction portion 143 of the liquid piston 140, and downward movement is regulated by the constriction portion 143.

A lower end portion of the poppet 160 forms the valve body 162. The valve body 162 is formed to have a larger diameter than the up-down intermediate portion of the poppet 160. A lower surface of the valve body 162 includes a conical part which can be brought into close contact with the valve seat 127 of the cylinder member 120 in a liquid-tight manner. The liquid agent suction valve is formed by the valve body 162 and the valve seat 127. A spring receiving portion 162*a* that receives downward bias from the coil spring 170 is formed at an upper end portion of the valve body 162.

The coil spring 170 is externally fitted onto the intermediate portion of the poppet 160 in a movably inserted state. The coil spring 170 is a compression type coil spring which is held between the spring receiving portion 126*a* of the cylinder member 120 and the spring receiving portion 142 of the liquid piston 140 in a compressed state. Therefore, the coil spring 170 obtains a reactive force from the cylinder member 120 and biases the liquid piston 140, the piston guide 130, and the head member 30 upward.

The lower end of the coil spring 170 biases not only the spring receiving portion 126*a* but also the spring receiving portion 162*a* of the poppet 160 downward.

Here, the shapes and size of the poppet 160 and the cylinder member 120 are set in such a manner that the poppet 160 is movable to the slightly lower side from a position where a height position of the spring receiving portion 162*a* matches with a height position of the spring receiving portion 126*a* of the cylinder member 120. When the head member 30 is pressed down and the piston guide 130 is lowered, the poppet 160 follows the piston guide 130 due to friction between the plural ribs 136 of the piston guide 130 and the upper end portion 161 of the poppet 160, and thereby, the lower surface of the valve body 162 of the poppet 160 is brought into close contact with the valve seat 127 of the cylinder member 120 in a liquid-tight manner. At this time, the spring receiving portion 162*a* is separated from the lower end of the coil spring 170 and lowered. After that, when the lower surface of the valve body 162 is brought into close contact with the valve seat 127 and then the head member 30, the piston guide 130, and the liquid piston 140 are further integrally lowered, lowering of the valve body 162 is regulated by the valve seat 127. Therefore, while the plural ribs 136 of the piston guide 130 frictionally slide with respect to the upper end portion 161 of the poppet 160, the piston guide 130 is lowered relatively with respect to the poppet 160.

Meanwhile, when the press-down operation on the head member 30 is cancelled and the liquid piston 140, the piston guide 130, and the head member 30 integrally move upward in accordance with the bias of the coil spring 170, first, the poppet 160 follows the piston guide 130 and moves upward until the spring receiving portion 162*a* is abutted with the lower end of the coil spring 170. Thereby, the valve body 162 is separated from the valve seat 127. After that, the liquid piston 140, the piston guide 130, and the head member 30 continuously follow the bias of the coil spring 170 and integrally move upward. At this time, upward movement of the poppet 160 is regulated by the coil spring 170. Thus, while the upper end portion 161 of the poppet 160 frictionally slides with respect to the plural ribs 136 of the piston guide 130, the piston guide 130 moves upward relatively with respect to the poppet 160.

In such a way, the valve body 162 of the poppet 160 is allowed to make slight upward/downward movement in a gap between the lower end of the coil spring 170 and the valve seat 127. In accordance with the upward/downward movement of the valve body 162, the liquid agent suction valve of a lower end portion of the liquid agent pump chamber 220 is opened/closed.

Here, routes for supplying the gas and the liquid agent 101 from the gas pump chamber 210 and the liquid agent pump chamber 220 to the foamer mechanism 20 will be respectively described.

By the press-down operation on the head member 30, the liquid agent pump chamber 220 contracts. At this time, by pressurizing the liquid agent 101 in the liquid agent pump chamber 220, the liquid agent discharge valve formed by the ball valve 180 and the valve seat portion 131 is opened, the liquid agent 101 in the liquid agent pump chamber 220 flows into the housing space 132 via the liquid agent discharge valve, and is further supplied into the hole 301 of the tube portion 310 of the first member 300 arranged above the housing space 132, that is, to the adjacent liquid agent flow passage 224 of the liquid agent flow passage 22 of the foamer mechanism 20.

By the press-down operation on the head member 30, the gas pump chamber 210 also contracts. At this time, by pressurizing the gas in the gas pump chamber 210 and the gas piston 150 slightly moving upward with respect to the piston guide 130, the gas discharge valve formed by the lower end portion of the tubular portion 151 and the valve forming groove 134 is opened, and the gas in the gas pump chamber 210 is fed upward via the gas discharge valve and the flow passage 211 (FIG. 27) between the tubular portion 151 and the piston guide 130.

A tubular gas flow passage 212 (FIGS. 3 and 28) formed by a gap between the inner circumferential surface of the lower end portion of the inner tube portion 32 and the outer circumferential surface of the piston guide 130 is arranged above the tubular portion 151 of the gas piston 150. An upper end of the flow passage 211 communicates with a lower end of the tubular gas flow passage 212.

Further, on the upper side of the tubular gas flow passage 212, the plural axial flow passages 213 respectively extending in the up and down direction are intermittently formed in a periphery of the upper end portion of the piston guide 130. In the case of this embodiment, three axial flow passages 213 are arranged at equal angle intervals (FIGS. 3, 9, 10, and 11). In more detail, for example, three grooves 32*b* extending in the up and down direction are formed on the inner circumferential surface of the lower end portion of the inner tube portion 32, and the axial flow passages 213 are formed by gaps between the three grooves 32*b* and an outer circumferential surface of the upper end portion of the piston guide 130. The tubular gas flow passage 212 communicates with the respective axial flow passages 213.

On the upper side of the axial flow passages 213, the circulating flow passage 214 (FIGS. 9 and 11) arranged in a circular manner along a peripheral edge of a lower end portion of a first disc-shaped portion 320 of the first member 300 to be described later is provided. Upper end portions of the axial flow passages 213 communicate with the circulating flow passage 214.

Further, on the upper side of the circulating flow passage 214, plural axial gas flow passages 234 (FIGS. 9 and 12) extending in the up and down direction along an outer circumferential surface of the first disc-shaped portion 320 of the first member 300 are arranged. The circulating flow passage 214 communicates with lower end portions of these axial gas flow passages 234.

On the upper side of the respective axial gas flow passages 234, plural radial gas flow passages 233 (FIGS. 9 and 13) extending in the radial direction along an upper surface of the first disc-shaped portion 320 of the first member 300 are arranged. Upper end portions of the axial gas flow passages 234 respectively communicate with the radially outer side ends of these radial gas flow passages 233.

That is, the gas fed upward via the flow passage 211 is supplied to the radial gas flow passages 233 through the tubular gas flow passage 212, the axial flow passages 213, the circulating flow passage 214, and the axial gas flow passages 234 in this order.

At a position on an extension of the adjacent flow passage 231 while sandwiching the gas-liquid contact chamber 21 in between, the foam flow passage 24 (FIG. 17) communicating with the gas-liquid contact chamber 21 and extending in the extension direction of the adjacent flow passage 231 is arranged (see FIG. 7).

Here, FIG. 54A is a schematic vertically-sectional view showing part of the foam dispensing container according to the second embodiment. FIG. 54A shows a section cut on a plane passing through the foam flow passage 24, the second part 226 of the first branch flow passage 221, the second part 226 of the second branch flow passage 222, and the adjacent flow passage 231.

In the case of this embodiment, the liquid agent openings 22*a*, 22*b* are respectively directed to the region 26, and the liquid agent openings 22*a*, 22*b* oppose each other.

In the case of this embodiment, the width of the foam flow passage 24 is greater than the width of the adjacent flow passage 231. When seen in the axis AX1 of the adjacent flow passage 231 (that is, in a plan view), the foam flow passage 24 contains the adjacent flow passage 231.

In the case of this embodiment, the width of the foam flow passage 24 is greater than width of each of the branch flow passages (the first branch flow passage 221 and the second branch flow passage 222).

A parts configuration for realizing the foamer mechanism 20 formed as above is not particularly limited. However, as an example, it is possible to form the foamer mechanism 20 by combining the first member 300 (FIGS. 4A to 4F), a second member 400 (FIGS. 5A to 5F), and two mesh holding rings 50 to be described later, respectively.

As shown in any of FIGS. 4A to 4F, the first member 300 includes the tube portion 310, the first disc-shaped portion 320 continuously connected to an upper side of the tube portion 310, a second disc-shaped portion 330 continuously connected to an upper side of the first disc-shaped portion 320, and plural projection portions 340 provided on an upper surface of the second disc-shaped portion 330.

For example, the tube portion 310 is formed in a cylindrical shape.

The first disc-shaped portion 320 is formed in a disc shape having a larger diameter than the tube portion 310, and arranged on the same axis as the tube portion 310.

The second disc-shaped portion 330 is formed in a disc shape having a smaller diameter than the first disc-shaped portion 320 and a larger diameter than the tube portion 310, and arranged on the same axis as the tube portion 310 and the first disc-shaped portion 320.

The first member 300 has the hole 301 passing through the first member 300 from a lower end to an upper end. The axis of the hole 301 matches with the axes of the tube portion 310, the first disc-shaped portion 320, and the second disc-shaped portion 330. The axis of the tube portion 310 extends in the up and down direction (vertical direction).

As described above, the adjacent liquid agent flow passage 224 of the liquid agent flow passage 22 is formed by an internal space of the hole 301. The adjacent liquid agent flow passage 224 is a pillar-shaped space (for example, columnar space).

The plural projection portions 340 are arranged at equal angle intervals in a periphery of the hole 301 in a radial manner.

The respective projection portions 340 are separated from each other in the circumferential direction, and a gap 342 between the adjacent projection portions 340.

Figure 4A:
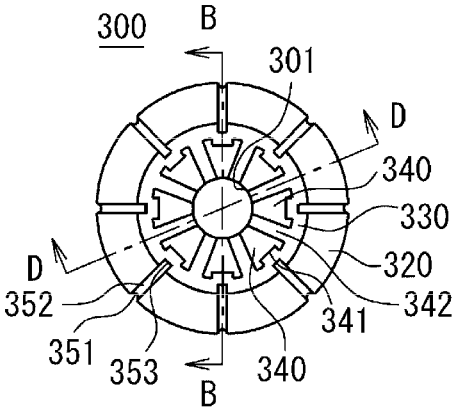
FIGS. 4A to 4F are views showing a first member provided in the foam dispensing cap according to the second embodiment.
Figure 4B:
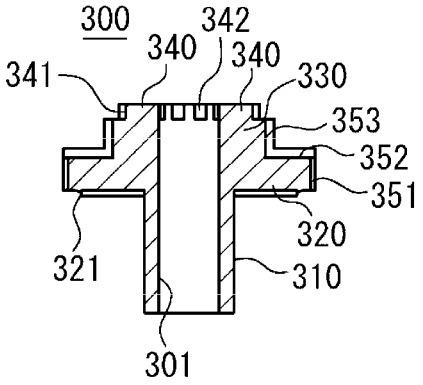
Figure 4C:
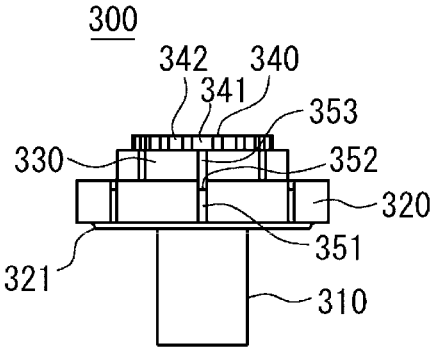
Figure 4D:
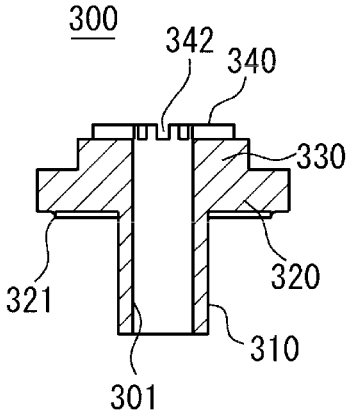
Figure 4E:
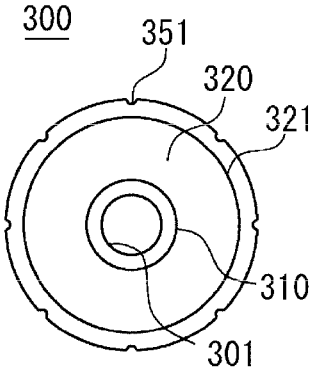
Figure 4F:
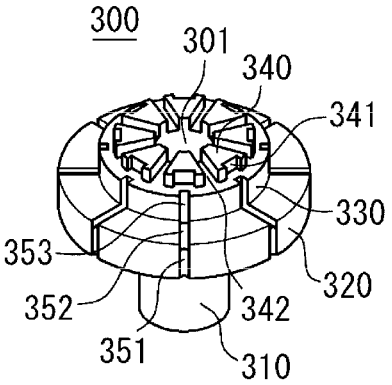
Figure 5A:
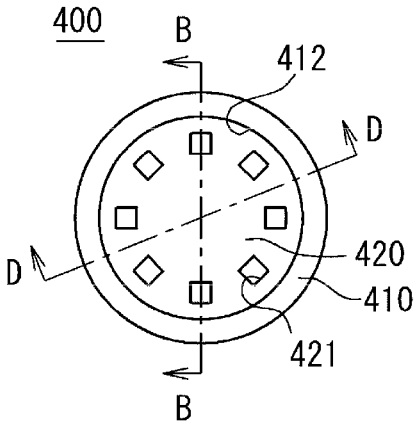
FIGS. 5A to 5F are views showing a second member provided in the foam dispensing cap according to the second embodiment.
Figure 5B:
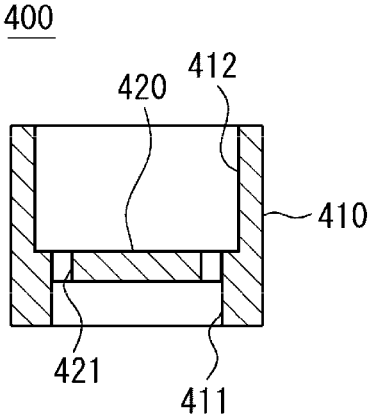
Figure 5C:
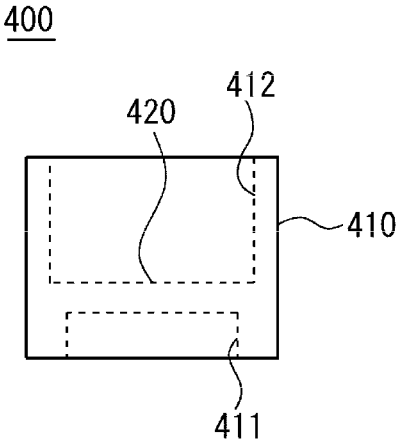
Figure 5D:
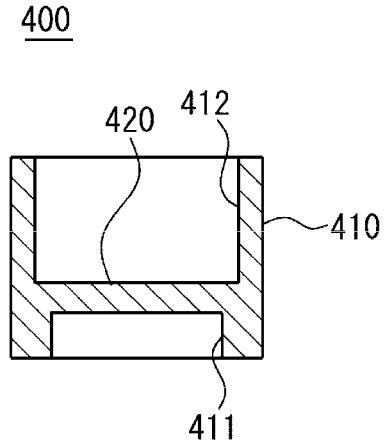
Figure 5E:
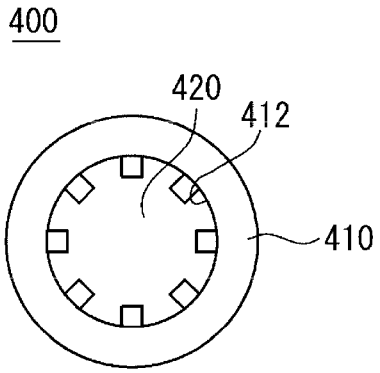
Figure 5F:
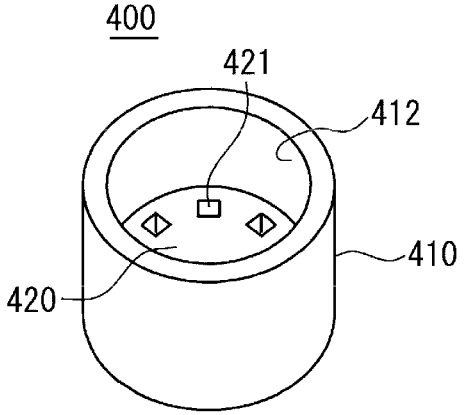

The planar shape of each of the projection portions 340 is, for example, an isosceles triangular shape (or a fan shape). In a plan view, the projection portion 340 is formed in a shape in which a tip of the isosceles triangle is cut out. Equal sides of the isosceles triangle (or radiuses of the fan shape) of the projection portion 340 are respectively arranged in a radial manner (FIG. 4A). A bottom side of the projection portion 340 (or an arc of the projection portion 340) is arranged on the radially inner side from grooves 353 to be described later of the second disc-shaped portion 330. A recessed portion 341 recessed toward the radially inner side is formed in the bottom side of the projection portion 340. The recessed portion 341 is to sufficiently ensure the volume of the gas-liquid contact chamber 21.

Side circumferential surfaces (including the recessed portion 341 and the part where the tip is cut out) of the projection portion 340 respectively stand vertically.

In the projection portion 340, the side surface of the part where the tip of the isosceles triangle is cut out is arranged on an extension of the hole 301.

A ring-shaped annular rib 321 is formed on a lower surface of the first disc-shaped portion 320.

Plural (for example, eight) grooves 351 extending in the up and down direction from a lower end of the first disc-shaped portion 320 to an upper end are formed on a side circumferential surface of the first disc-shaped portion 320.

Plural (for example, eight) grooves 352 extending in the radial direction are formed on the upper surface of the first disc-shaped portion 320.

The plural (for example, eight) grooves 353 extending in the up and down direction from a lower end of the second disc-shaped portion 330 to an upper end are formed on a side circumferential surface of the second disc-shaped portion 330.

One ends (radially outer side ends) of the grooves 352 are connected to upper ends of the grooves 351, and the other ends (radially inner side ends) of the grooves 352 are connected to lower ends of the grooves 353.

An upper end of each of the grooves 353 and the widthwise center of the recessed portion 341 of the projection portion 340 are arranged on the same straight line in the radial direction.

As shown in any of FIGS. 5A to 5F, the second member 400 includes, for example, a cylindrical tube portion 410, and a disc plate-shaped plate portion 420.

The axis of the tube portion 410 extends in the up and down direction (vertical direction).

The plate portion 420 is horizontally arranged inside the tube portion 410 at a position in the middle of an upper end and a lower end of the tube portion 410. The plate portion 420 is arranged, for example, on the lower side from the up-down center of the tube portion 410.

In the tube portion 410, a space on the lower side from the plate portion 420 is a recessed portion 411, and a space on the upper side from the plate portion 420 is a recessed portion 412.

An inner diameter of the recessed portion 412 is set to be larger than an inner diameter of the recessed portion 411.

Plural (for example, eight) holes 421 passing through the plate portion 420 in the up and down direction from the recessed portion 411 to the recessed portion 412 are formed in the plate portion 420.

The holes 421 are arranged at equal angle intervals in a periphery of the axis of the tube portion 410.

As shown in any of FIGS. 6A to 6F, an inner diameter of the recessed portion 411 is set to be equal to an outer diameter of the second disc-shaped portion 330. By fitting the second disc-shaped portion 330 into the recessed portion 411, the first member 300 and the second member 400 are assembled to each other.

Figure 6A:
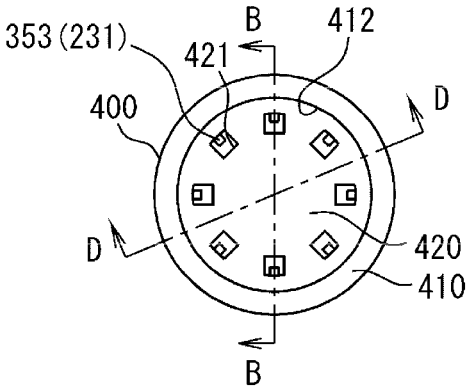
FIGS. 6A to 6F are views showing a state where the first member and the second member provided in the foam dispensing cap according to the second embodiment are assembled to each other.
Figure 6B:
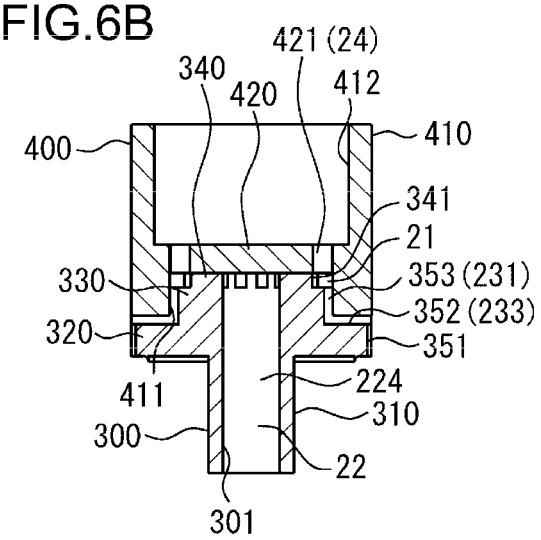
Figure 6C:
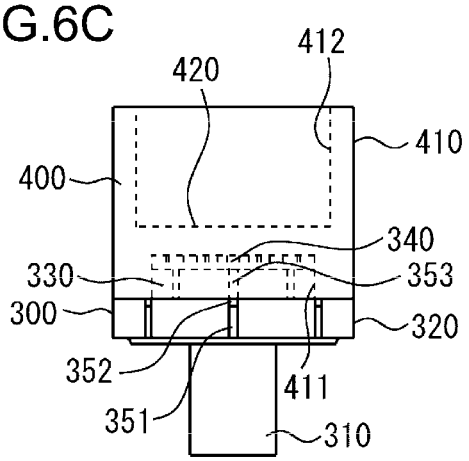
Figure 6D:
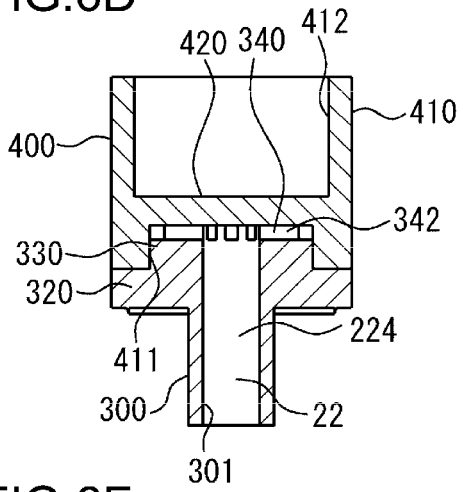
Figure 6E:
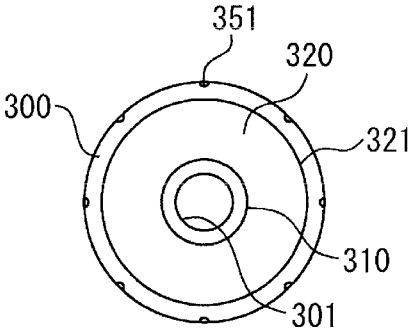
Figure 6F:
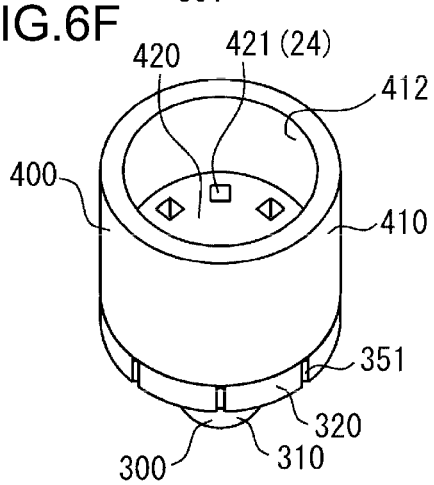

Each of the grooves 353 is housed inside each of the holes 421 in a plan view (FIG. 6A). In more detail, for example, the groove 353 is arranged in the circumferential center of the hole 421. In more detail, for example, the groove 353 is arranged in a radially outer side end portion of the hole 421.

In order to regulate displacement of a relative angle between the first member 300 and the second member 400 in the circumferential direction, the first member 300 and the second member 400 may be fitted to each other by a key groove or a projection which is not shown in the drawings.

The upper surface of the first disc-shaped portion 320 is in close contact with a lower end surface of the tube portion 410 in an airtight manner.

The side circumferential surface of the second disc-shaped portion 330 is in close contact with an inner circumferential surface of the tube portion 410 in an airtight manner.

An upper surface of each of the projection portions 340 is in close contact with a lower surface of the plate portion 420 in an airtight manner.

As shown in FIG. 7, the radial gas flow passages 233 are formed by gaps between the grooves 352 and the lower end surface of the tube portion 410. The adjacent flow passages 231 are formed by gaps between the grooves 353 and the inner circumferential surface of the tube portion 410.

As shown in FIG. 8, the first part 225 of the first branch flow passage 221 and the second branch flow passage 222 is formed by the gap 342. An upper end of the first part 225 is defined by the lower surface of the plate portion 420, and a lower end of the first part 225 is defined by the upper surface of the second disc-shaped portion 330.

The inner circumferential surface of the tube portion 410 is arranged in a periphery of the plural projection portions 340 in a circular manner.

The second part 226 of each of the first branch flow passages 221 and each of the second branch flow passages 222 is defined by a part of the upper surface of the second disc-shaped portion 330 on the radially outer side from each of the projection portions 340, the lower surface of the plate portion 420, a part of the side circumferential surface of the projection portion 340, the part corresponding to the bottom side of the isosceles triangle described above where the recessed portion 341 is not formed, and the inner circumferential surface of the tube portion 410.

Each of the gas-liquid contact chambers 21 is formed by a region positioned at a gap across which the recessed portion 341 and the tube portion 410 oppose each other out of a gap between the part of the second disc-shaped portion 330 on the radially outer side from each of the projection portions 340 and the lower surface of the plate portion 420. In the case of this embodiment, the gas-liquid contact chamber 21 is a region of rectangular parallelepiped.

The foam flow passage 24 is formed by an internal space of each of the holes 421 of the plate portion 420.

As shown in FIG. 9, a holding portion 32*c*, that houses and holds the first member 300 and the second member 400 in a state where the members are assembled to each other, are formed inside the inner tube portion 32. An internal space of the holding portion 32*c* is a columnar space. The first member 300 and the second member 400 in a state where the members are assembled to each other are fitted in and fixed to the holding portion 32*c*.

The outer circumferential surface of the first disc-shaped portion 320 and an outer circumferential surface of the tube portion 410 are respectively airtightly contacted with an inner circumferential surface of the holding portion 32*c*.

The annular rib 321 on the lower surface of the first disc-shaped portion 320 of the first member 300 is airtightly contacted with a ring-shaped upper end surface of the piston guide 130.

Here, the circulating flow passage 214 is formed by a region of the internal space of the inner tube portion 32 on the radially outer side from the annular rib 321.

The axial gas flow passages 234 are formed by gaps between the grooves 351 on the side circumferential surface of the first disc-shaped portion 320 of the first member 300 and an inner circumferential surface of the inner tube portion 32.

As shown in FIG. 9, each of the mesh holding rings 50 is a cylindrical member, and a mesh 51 is provided in an opening on one side in the axial direction.

For example, two mesh holding rings 50 are fitted into the recessed portion 412 of the second member 400 in a state where the mesh holding rings are stacked one on top of the other. The mesh 51 of the lower mesh holding ring 50 among the two mesh holding rings 50 is positioned at a lower end of the mesh holding ring 50, and the mesh 51 of the upper mesh holding ring 50 is positioned at an upper end of the mesh holding ring 50.

Foam produced in the gas-liquid contact chambers 21 flows into an internal space of the mesh holding rings 50 via the foam flow passages 24 and the mesh 51 of the lower side mesh holding ring 50, and flows out to the upper side via the mesh 51 of the upper mesh holding ring 50.

A space above the second member 400 in the internal space of the inner tube portion 32 forms a flow passage 32*d* through which the foam flowing in from the mesh holding rings 50 passes. An upper end of the flow passage 32*d* communicates with the discharge port 41 via the internal space of the nozzle portion 40.

The foam dispensing container 100 is formed as above.

The foam dispensing cap 200 is formed by parts of the foam dispensing container 100 excluding the container main body 10.

That is, the foam dispensing cap 200 includes the mounting portion 111 mounted on the container main body 10 that stores the liquid agent 101, the foamer mechanism 20 held in the mounting portion 111, the foamer mechanism that foams the liquid agent 101 and produces the foam body, and the discharge port 41 held in the mounting portion 111, the discharge port that discharges the foam body produced by the foamer mechanism 20. The configuration of the foamer mechanism 20 is as described above.

Next, an outline of actions will be described.

In order to discharge the foam body from the foam dispensing container 100, the press-down operation is performed on the operation receiving portion 31 of the head member 30.

Thereby, by reducing the gas pump chamber 210, the gas in the gas pump chamber 210 is supplied (pressure-fed) to the foamer mechanism 20, and by reducing the liquid agent pump chamber 220, the liquid agent in the liquid agent pump chamber 220 is supplied (pressure-fed) to the foamer mechanism 20. The liquid agent 101 and the gas are brought into contact and mixed with each other in the gas-liquid contact chambers 21 and rough foam is produced. Further, this rough foam is supplied to a region where the two-step meshes 51 are arranged through the foam flow passages 24, and by passing through these two-step meshes 51, the rough foam becomes a fine and uniform foam body. This foam body is discharged from the discharge port 41 of the nozzle portion 40 through the interior of the flow passage 32*d* and the interior of the nozzle portion 40.

Next, details of the actions will be described.

First, in the normal state where the press-down operation is not performed on the head member 30, as shown in FIG. 3, the head member 30 exists at the top dead point position.

In this state, the spring receiving portion 162*a* of the valve body 162 of the poppet 160 is in contact with the lower end of the coil spring 170, and the valve body 162 is separated slightly upward from the valve seat 127. That is, the liquid agent suction valve is in an open state. The ball valve 180 is in contact with the valve seat portion 131 and the liquid agent discharge valve is in a closed state.

The lower end portion of the tubular portion 151 of the gas piston 150 is fitted into the valve forming groove 134 on the upper surface of the flange portion 133 of the piston guide 130, and the gas discharge valve is in a closed state. The valve body of the suction valve member 155 is in contact with the lower surface of the piston portion 152 of the gas piston 150, and the gas suction valve is in a closed state. The through hole 129 of the gas cylinder forming portion 121 is closed by the outer circumferential ring portion 153 of the gas piston 150.

By pressing the head member 30 down, the piston guide 130 and the liquid piston 140 are lowered integrally with the head member 30. In accordance with this lowering, the coil spring 170 is compressed and the volume of the liquid agent pump chamber 220 is reduced.

At the initial stage of a process of lowering the piston guide 130 and the liquid piston 140, the poppet 160 is slightly lowered following the piston guide 130 due to friction with the ribs 136 of the piston guide 130. Thereby, the valve body 162 closely contacts with the valve seat 127 in a liquid-tight manner, and the liquid agent suction valve is brought into a closed state.

After the liquid agent suction valve is brought into a closed state, by further lowering the liquid piston 140, the liquid agent 101 in the liquid agent pump chamber 220 is pressurized, and the liquid agent 101 is pressure-fed to the upper side. That is, by pressure of the liquid agent 101, the ball valve 180 is popped up from the valve seat portion 131, the liquid agent discharge valve is brought into an open state, and the liquid agent 101 flows into the adjacent liquid agent flow passage 224 of the liquid agent flow passage 22 from the liquid agent pump chamber 220 via the liquid agent discharge valve and the housing space 132.

Further, the liquid agent 101 branches and flows into eight first parts 225 from the upper end portion of the adjacent liquid agent flow passage 224.

Here, the first parts 225 are arranged at equal angle intervals in the periphery of the adjacent liquid agent flow passage 224. The widths of the first parts 225 are equal to each other. Therefore, the liquid agent 101 evenly flows into each of the first parts 225.

The liquid agent 101 passing through each of the first parts 225 respectively branches into two second parts 226 at a downstream end of the first part 225, and flows into the gas-liquid contact chamber 21 from the liquid agent opening 22*a* or the liquid agent opening 22*b* which is a downstream end of each of the second parts 226.

Here, the opening areas of the liquid agent opening 22*a* and the liquid agent opening 22*b* are equal to each other. Thus, it is possible to supply equal amounts of the liquid agent 101 to the gas-liquid contact chamber 21 from the first branch flow passage 221 and the second branch flow passage 222. That is, it is possible to supply the liquid agent 101 to the gas-liquid contact chamber 21 in a well-balanced manner from both the liquid agent openings 22*a*, 22*b*. Thus, it is possible to preferably foam the liquid agent 101 in the gas-liquid contact chamber 21.

The opening shapes of the liquid agent openings 22*a* and the liquid agent opening 22*b* are equal to each other. Thus, it is furthermore possible to supply the liquid agent 101 to the gas-liquid contact chamber 21 in a well-balanced manner from both the liquid agent openings 22*a*, 22*b*.

By pressing the head member 30 down, the gas in the gas pump chamber 210 is compressed and thereby pressure-fed to the foamer mechanism 20.

That is, at the initial stage of the process of lowering the liquid piston 140 and the piston guide 130, the gas piston 150 moves upward relatively with respect to the piston guide 130 (however, the gas piston 150 is brought into a substantially static state or slightly lowered with respect to the cylinder member 120). Thereby, the lower end portion of the tubular portion 151 of the gas piston 150 is separated upward from the valve forming groove 134 of the flange portion 133, and thereby, the gas discharge valve is brought into an open state.

After that, by bringing the upper end portion of the tubular portion 151 into contact with the upward movement regulating portion 32*a* of the inner tube portion 32, upward movement of the gas piston 150 relatively with respect to the head member 30 and the piston guide 130 is regulated, and from there onward, the gas piston 150 is lowered integrally with the head member 30 and the piston guide 130. Thereby, the gas in the gas pump chamber 210 is pressurized.

Therefore, the gas in the gas pump chamber 210 flows into the eight axial gas flow passages 234 (FIGS. 9 and 12) of the gas flow passage 23 via the gas discharge valve, the flow passage 211 (FIG. 27), the tubular gas flow passage 212 (FIGS. 3 and 28), the three axial flow passages 213 (FIGS. 3, 9, and 10), and the circulating flow passage 214 (FIGS. 9 and 11) in this order. That is, the gas is evenly distributed and supplied to the eight axial gas flow passages 234 from the circulating flow passage 214.

The gas flowing into the eight axial gas flow passages 234 further flows into the eight adjacent flow passages 231 (FIGS. 7, 9, and 14) via the eight radial gas flow passages 233 (FIGS. 7, 9, and 13), and flows into the gas-liquid contact chambers 21 from the gas openings 23*a*.

Here, as shown in FIGS. 7 and 9, the liquid agent opening 22*a* and the liquid agent opening 22*b* are arranged at the positions on the both sides sandwiching the extension region 26 of the adjacent flow passage 231 which is the part of the gas flow passage 23 adjacent to the gas opening 23*a*. The liquid agent opening 22*a* and the liquid agent opening 22*b* are respectively directed to the region 26. Thereby, it is possible to favorably mix the liquid agent 101 and the gas.

In more detail, it is possible to supply the liquid agent 101 to the gas-liquid contact chamber 21 (particularly the region 26) in a well-balanced manner from the liquid agent opening 22*a* and the liquid agent opening 22*b* on the both sides of the gas-liquid contact chamber 21. Thus, it is possible to preferably realize a state where the gas-liquid contact chamber 21 (particularly the region 26) is filled with the liquid agent 101. Therefore, it is possible to supply the gas to the gas-liquid contact chamber 21 (particularly the region 26) filled with the liquid agent 101 from the adjacent flow passage 231.

In other words, since a path of the gas introduced to the gas-liquid contact chamber 21 from the adjacent flow passage 231 is blocked by the liquid agent 101 with which the gas-liquid contact chamber 21 (particularly the region 26) is filled, a situation where the gas introduced to the gas-liquid contact chamber 21 from the adjacent flow passage 231 unavoidably passes through the liquid agent 101 of the gas-liquid contact chamber 21 (particularly the region 26) is realized. Therefore, while the gas passes through the liquid agent 101 of the gas-liquid contact chamber 21, the gas and the liquid agent 101 are favorably mixed.

Therefore, a more uniform foam body is more easily produced. For example, even when the liquid agent 101 is relatively highly viscous, it is possible to realize favorable mixing of the liquid agent 101 and the gas.

In the case of this embodiment, since the liquid agent opening 22*a* of the first branch flow passage 221 and the liquid agent opening 22*b* of the second branch flow passage 222 oppose each other across the gas-liquid contact chamber 21, the liquid agent 101 is more favorably and more easily supplied to the region 26. Thereby, it is possible to more reliably mix the liquid agent 101 and the gas in the region 26.

The liquid agent flow passage 22 includes the adjacent liquid agent flow passage 224 which is apart adjacent to upstream sides of the first branch flow passages 221 and the second branch flow passages 222. The plural gas-liquid contact chambers 21 are intermittently arranged in a periphery of a downstream side end portion of the adjacent liquid agent flow passage 224. The first branch flow passages 221 and the second branch flow passages 222 extend from the downstream side end portion of the adjacent liquid agent flow passage 224 in a radial manner. Therefore, it is possible to evenly distribute and supply the liquid agent 101 to the branch flow passages, and to mix the liquid agent 101 and the gas individually in the plural gas-liquid contact chambers 21. Thus, it is possible to finely and uniformly mix the liquid agent 101 and the gas and to avoid crude mixing of the liquid agent 101 and the gas.

In addition, rough foam produced by mixing the liquid agent 101 and the gas in the gas-liquid contact chambers 21 flows into the eight foam flow passages 24 (FIGS. 7 to 9) above the respective gas-liquid contact chambers 21 and passes through the foam flow passages 24.

Here, the foam flow passages 24 are arranged at the extension positions of the adjacent flow passages 231 across the gas-liquid contact chambers 21, and extend in the extension direction of the adjacent flow passages 231.

Thereby, it is possible to allow rough foam produced in the gas-liquid contact chambers 21 to smoothly flow into the foam flow passages 24. Furthermore, it is possible to allow the gas to smoothly flow from the adjacent flow passages 231 to the gas-liquid contact chambers 21. Thus, it is possible to produce foam at a high airflow rate to the extent possible in the gas-liquid contact chambers 21, and to enhance a ratio of mixing the liquid agent 101 and the gas in the gas-liquid contact chambers 21.

The rough foam passing through the eight foam flow passages 24 passes through the lower (upstream side) mesh 51, interflows in the mesh holding rings 50, and by further passing through the upper (downstream side) mesh 51, becomes a fine uniform foam body, and is discharged from the discharge port 41 via the flow passage 32*d* and the nozzle portion 40.

After that, when the press-down operation on the head member 30 is cancelled, the coil spring 170 is extended due to elastic return. Therefore, the liquid piston 140 is biased by the coil spring 170 and moves upward, and the piston guide 130 and the head member 30 move upward integrally with the liquid piston 140. At this time, since the liquid agent pump chamber 220 is extended, the pressure becomes negative in the liquid agent pump chamber 220. Thus, the ball valve 180 is brought into contact with the valve seat portion 131 and the liquid agent discharge valve is brought into a closed state.

In a process of the piston guide 130 moving upward, the poppet 160 follows the piston guide 130 due to friction with the ribs 136 and slightly moves upward. Thereby, the valve body 162 is separated from the valve seat 127, and the liquid agent suction valve is brought into an open state. After the spring receiving portion 162*a* of the valve body 162 is brought into contact with the lower end of the coil spring 170, the poppet 160 is stopped moving upward, and the piston guide 130 moves upward while the ribs 136 slide with respect to the poppet 160.

By the piston guide 130 and the liquid piston 140 further moving upward and the liquid agent pump chamber 220 being extended, the liquid agent 101 in the container main body 10 is suctioned into the liquid agent pump chamber 220 via the dipping tube 128.

In the process of the piston guide 130 moving upward, the piston guide 130 moves upward relatively with respect to the gas piston 150, and a lower end of the tubular portion 151 of the gas piston 150 is fitted into the valve forming groove 134 of the flange portion 133. Thereby, the gas discharge valve is brought into a closed state.

When the piston guide 130 further moves upward, the gas piston 150 moves upward integrally with the piston guide 130.

By the gas piston 150 moving upward and the gas pump chamber 210 being extended, the pressure becomes negative in the gas pump chamber 210. Thus, the valve body of the suction valve member 155 is separated from the lower surface of the piston portion 152, and the gas suction valve is brought into an open state. Thereby, the air outside the foam dispensing container 100 flows into the gas pump chamber 210 via a gap between an upper end of the standing tube portion 113 and a lower end of the outer tube portion 33, a gap between the standing tube portion 113 and the inner tube portion 32, a gap between the annular closing portion 112 and the piston portion 152, and the suction openings 154 of the piston portion 152 and the gas suction valve.

The upward movements of the head member 30, the piston guide 130, the liquid piston 140, and the gas piston 150 are stopped, for example, by regulating upward movement of the piston portion 152 by the annular closing portion 112.

By suctioning the liquid agent 101 in the container main body 10 into the liquid agent pump chamber 220 at the time of the upward movements of the head member 30, etc., after cancellation of the press-down operation, the volume of a space above a liquid surface of the liquid agent 101 in the container main body 10 is increased, and the pressure becomes negative in the space.

However, after that, pressing the head member 30 down and shifting from a state where the through hole 129 is closed by the outer circumferential ring portion 153 to a state where the through hole is not closed, the air outside the foam dispensing container 100 flows into the container main body 10 via the gap between the upper end of the standing tube portion 113 and the lower end of the outer tube portion 33, the gap between the standing tube portion 113 and the inner tube portion 32, the gap between the annular closing portion 112 and the piston portion 152, and the through hole 129. Thereby, the pressure of the space above the liquid surface of the liquid agent 101 in the container main body 10 is restored to the atmospheric pressure.

The structure and the actions of the foam dispensing cap 200 described above are just an example. There is no problem applying other widely-known structures to this embodiment within the range not departing from the gist of the present invention.

According to the second embodiment described above, the liquid agent openings 22*a*, 22*b* are respectively arranged at the positions on the both sides sandwiching the extension region 26 of the adjacent flow passage 231 which is the part of the gas flow passage 23 adjacent to the gas opening 23*a*.

Thereby, it is possible to more favorably mix the gas and the liquid in the gas-liquid contact chamber 21. Thus, a sufficiently uniform foam body is more easily produced. Therefore, it is possible to more easily foam even the liquid agent 101 which is not easily foamed such as the highly-viscous liquid agent 101.

Modified Example of Second Embodiment

Next, a modified example of the second embodiment will be described with reference to FIGS. 18 and 19.

Figure 18:
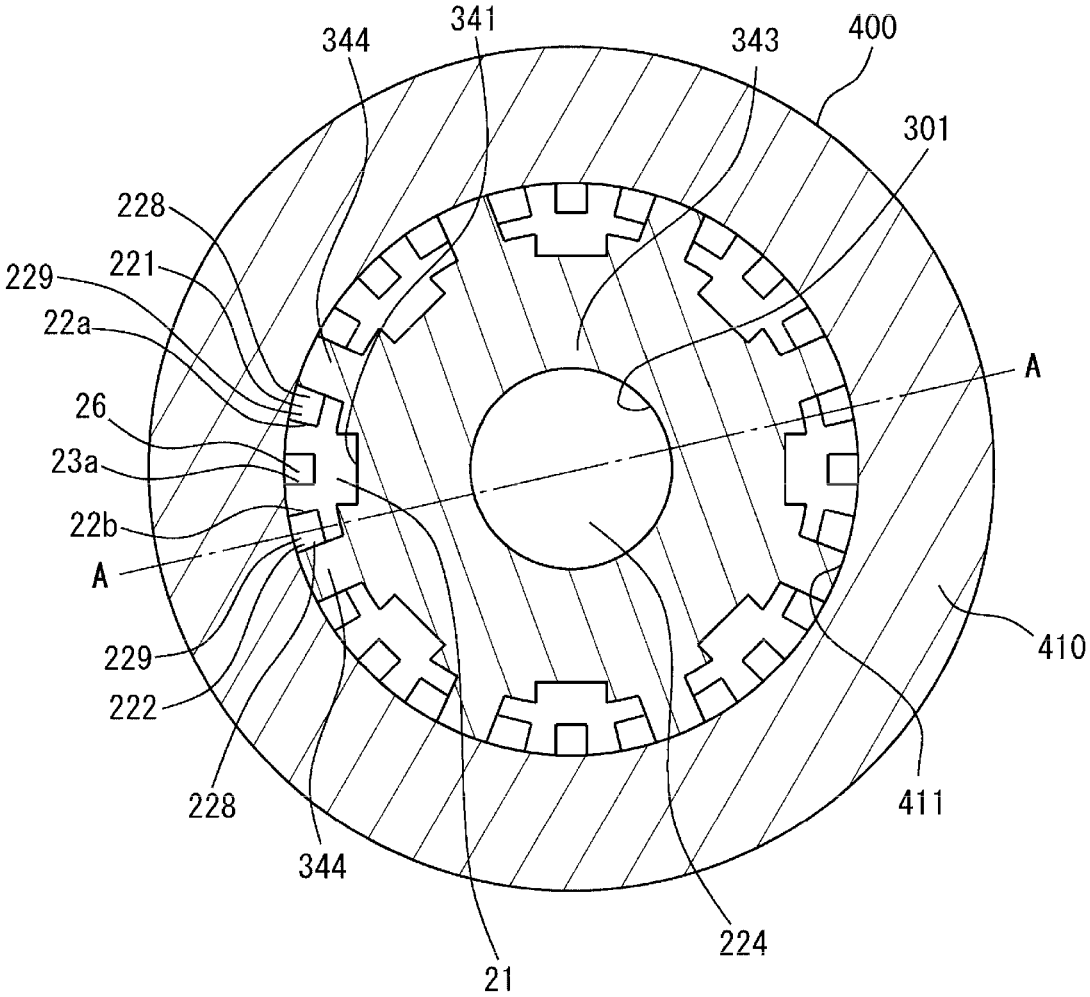
FIG. 18 is a sectional view showing part of a foam dispensing container according to a modified example of the second embodiment.

FIG. 18 is a sectional view showing part of a foam dispensing container according to this modified example. FIG. 19 is a cut end surface view showing part of the foam dispensing container according to this modified example. FIG. 18 is a horizontally sectional view taken along line A-A of FIG. 19, and shows a section at a position corresponding to FIG. 15. FIG. 19 is an end surface view taken along line A-A of FIG. 18.

The foam dispensing container and a foam dispensing cap according to this modified example are different from the foam dispensing container 100 and the foam dispensing cap 200 according to the second embodiment described above in terms of the points described below but are formed similarly to the foam dispensing container 100 and the foam dispensing cap 200 according to the second embodiment described above in the other points.

Figure 19:
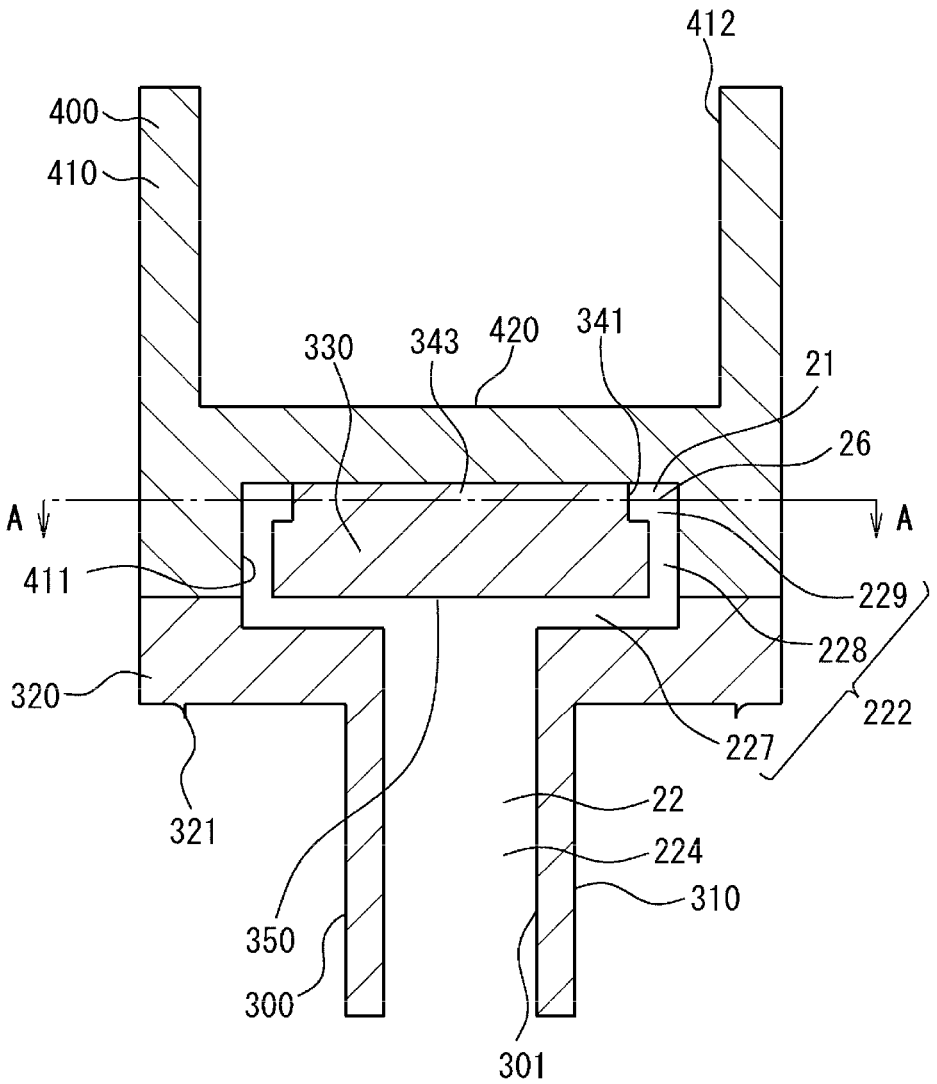
FIG. 19 is a cut end surface view showing part of the foam dispensing container according to the modified example of the second embodiment.

In the case of this modified example, as shown in FIG. 18 or 19, in the case of this embodiment, the first member 300 does not include the plural projection portions 340 but instead includes one projection portion 343 formed on the upper side of the second disc-shaped portion 330.

The projection portion 343 encloses the periphery of the downstream end of the adjacent liquid agent flow passage 224.

Eight adjacent wall portions 344 arranged at intermediate positions between the adjacent gas-liquid contact chambers 21 are formed in a periphery of the projection portion 343 integrally with the projection portion 343. Side surfaces of the adjacent wall portions 344, the side surfaces being positioned at radially outer side end portions are in close contact with the inner circumferential surface of the tube portion 410 in an airtight manner.

As shown in FIG. 19, the downstream end of the adjacent liquid agent flow passage 224 strikes conversion surface 350 on a lower surface of the second disc-shaped portion 330.

The liquid agent flow passage 22 includes plural (for example, sixteen) first parts 227 arranged in the periphery of the downstream end of the adjacent liquid agent flow passage 224, plural (for example, sixteen) second parts 228 in one-to-one correspondence with the first parts 227, and plural (for example, sixteen) third parts 229 in one-to-one correspondence with the second parts 228.

The first branch flow passage 221 is formed by a set of the first part 227, the second part 228, and the third part 229. Similarly, the second branch flow passage 222 is also formed by a set of the first part 227, the second part 228, and the third part 229. In FIG. 19, only the second branch flow passage 222 is shown but the first branch flow passage 221 is not shown.

Each of the first parts 227 extends in a radial manner in the radial direction from the downstream end of the adjacent liquid agent flow passage 224. In the case of this modified example, the liquid agent passing through the adjacent liquid agent flow passage 224 is converted at the conversion surface 350 and distributed and supplied to each of the first parts 227.

Each of the second parts 228 extends upward from an upstream end (lower end) of the corresponding first part 227.

A downstream end of each of the second parts 228 is open to the upper surface of the second disc-shaped portion 330.

Each of the third parts 229 is adjacent to an upper side of each of the second parts 228. The third parts 229 are rectangular parallelepiped regions adjacent to both sides of each of the gas-liquid contact chambers 21 in the circumferential direction.

The third part 229 is defined by a side surface of the adjacent wall portion 344, the inner circumferential surface of the tube portion 410, the lower surface of the plate portion 420, the part of the side circumferential surface of the projection portion 340 where the recessed portion 341 is not formed, the region of the upper surface of the second disc-shaped portion 330 on the radially outer side from the projection portion 343, and the downstream end of the second part 228.

An end portion of each of the third parts 229 on the gas-liquid contact chamber 2*l* side forms the liquid agent opening 22*a* or the liquid agent opening 22*b*.

Here, an escape path of the liquid agent flowing into the third part 229 from the downstream end of the second part 228 is only toward the gas-liquid contact chamber 21. The liquid agent flowing into the third part 229 moves to the region 26 of the gas-liquid contact chamber 21 from the liquid agent opening 22*a* or the liquid agent opening 22*b*.

That is, in this modified example as well, the liquid agent openings 22*a*, 22*b* are respectively arranged at the positions on the both sides sandwiching the extension region 26 of the adjacent flow passage which is the part of the gas flow passage adjacent to the gas opening 23*a*, and each of the liquid agent openings 22*a*, 22*b* is also directed to the region 26.

Therefore, in this modified example as well, similar effects to the second embodiment above are obtained.

Third Embodiment

Next, a third embodiment will be described with reference to FIGS. 20 to 44B.

A foam dispensing container 100 and a foam dispensing cap 200 according to this embodiment are different from the foam dispensing container 100 and the foam dispensing cap 200 according to the second embodiment described above in terms of the points described below but are formed similarly to the foam dispensing container 100 and the foam dispensing cap 200 according to the second embodiment described above in the other points.

In the case of this embodiment, as shown in any of FIGS. 22 to 26, a foamer mechanism 20 has gas-liquid contact chambers 21 in which a liquid agent 101 supplied from a liquid agent pump chamber 220 meets a gas supplied from a gas pump chamber 210, a liquid agent flow passage 22 through which the liquid agent 101 supplied from the liquid agent pump chamber 220 to the gas-liquid contact chambers 21 passes, and a gas flow passage 23 through which the gas supplied from the gas pump chamber 210 to the gas-liquid contact chambers 21 passes.

The gas flow passage 23 has gas openings 23*a* that are open to the gas-liquid contact chambers 21.

The liquid agent flow passage 22 branches into plural branch flow passages (for example, branches into a first branch flow passage 221 and a second branch flow passage 222). Each of the plural branch flow passages has liquid agent openings 22*a*, 22*b* that are open to the gas-liquid contact chambers 21. The liquid agent openings 22*a*, 22*b* are respectively arranged at positions on the both sides sandwiching an extension region 26 of an adjacent flow passage 231 which is a part of the gas flow passage 23 adjacent to the gas opening 23*a*, and each of these liquid agent openings 22*a*, 22*b* is directed to the region 26.

Here, the region 26 in the gas-liquid contact chamber 21 is a region overlapping with the adjacent flow passage 231 when seen in the direction of the axis AX1 (FIG. 25) of the adjacent flow passage 231. Here, it is preferable to meet the condition that no obstacles exist between the region 26 and the adjacent flow passage 231. However, some obstacles allowing part of a flow of the gas and inhibiting the remaining part may exist between the region 26 and the adjacent flow passage 231.

The description that each of the liquid agent openings 22*a* is directed to the region 26 means that a part of the liquid agent opening 22*a* overlaps with the region 26 when seen in the direction of the axis AX2 (FIG. 36B) of the liquid agent opening 22*a*. Here, it is preferable to meet the condition that no obstacles exist between the region 26 and the liquid agent opening 22*a*. However, some obstacles allowing part of a flow of the liquid agent and inhibiting the remaining part may exist between the region 26 and the liquid agent opening 22*a*.

Similarly, the description that the liquid agent opening 22*b* is directed to the region 26 means that a part of the liquid agent opening 22*b* overlaps with the region 26 when seen in the direction of the axis AX3 (FIG. 36B) of the liquid agent opening 22*b*. Here, it is preferable to meet the condition that no obstacles exist between the region 26 and the liquid agent opening 22*b*. However, some obstacles allowing part of the flow of the liquid agent but inhibiting the remaining part may exist between the region 26 and the liquid agent opening 22*b*.

In more detail, for example, the region 26 is a region on the axis AX1 (FIG. 25) of the adjacent flow passage 231 in the gas-liquid contact chamber 21. The axis AX2 (FIG. 36B) of the liquid agent opening 22*a* of the first branch flow passage 221 and the axis AX3 (FIG. 36B) of the liquid agent opening 22*b* of the second branch flow passage 222 respectively pass through the region 26.

In the case of this embodiment as well, the liquid agent openings 22*a*, 22*b* of the plural branch flow passages (the first branch flow passage 221 and the second branch flow passage 222) oppose each other across the gas-liquid contact chamber 21.

That is, when seen in the direction of the axis AX2 of the liquid agent opening 22*a*, a partial region of the liquid agent opening 22*a* overlaps with a partial region of the liquid agent opening 22*b*. When seen in the direction of the axis AX3 of the liquid agent opening 22*b*, the partial region of the liquid agent opening 22*b* overlaps with the partial region of the liquid agent opening 22*a*.

In more detail, for example, the axis AX2 of the liquid agent opening 22*a* crosses the axis AX3 of the liquid agent opening 22*b*. In further detail, for example, the axis AX2 of the liquid agent opening 22*a* matches with the axis AX3 of the liquid agent opening 22*b*.

It is preferable that the axis AX2 and the axis AX3 respectively horizontally extend (in the direction orthogonal to the axis AX4 of the first branch flow passage 221).

Figure 36A:
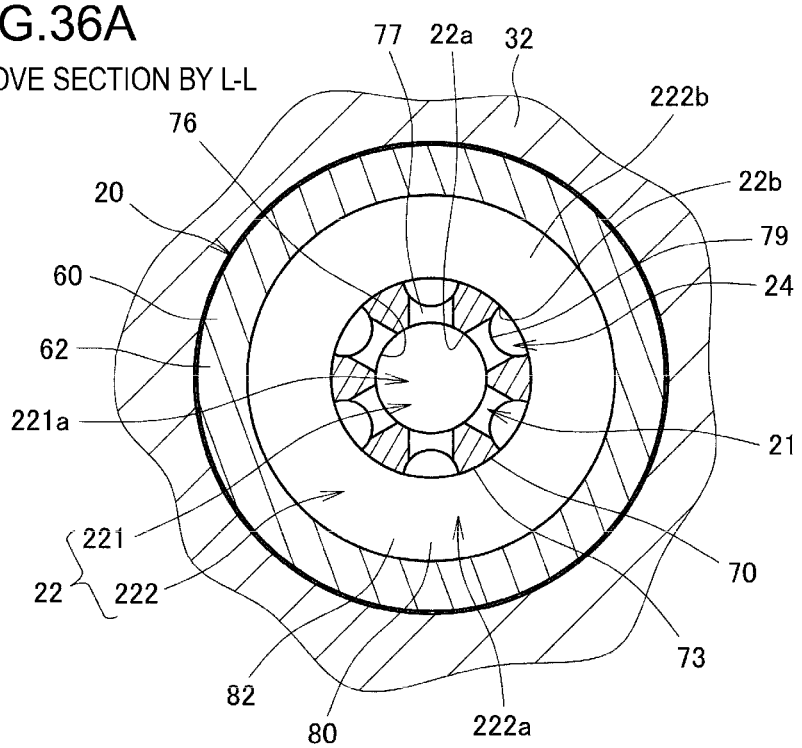
FIGS. 36A and 36B are sectional views taken along line L-L of FIG. 23.
Figure 36B:
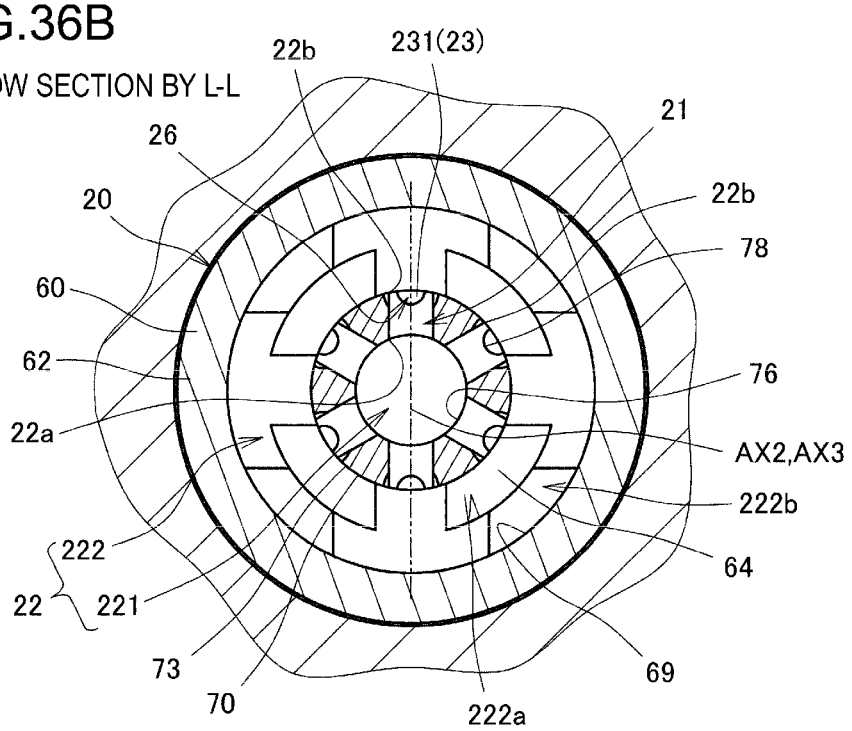
Figure 37:
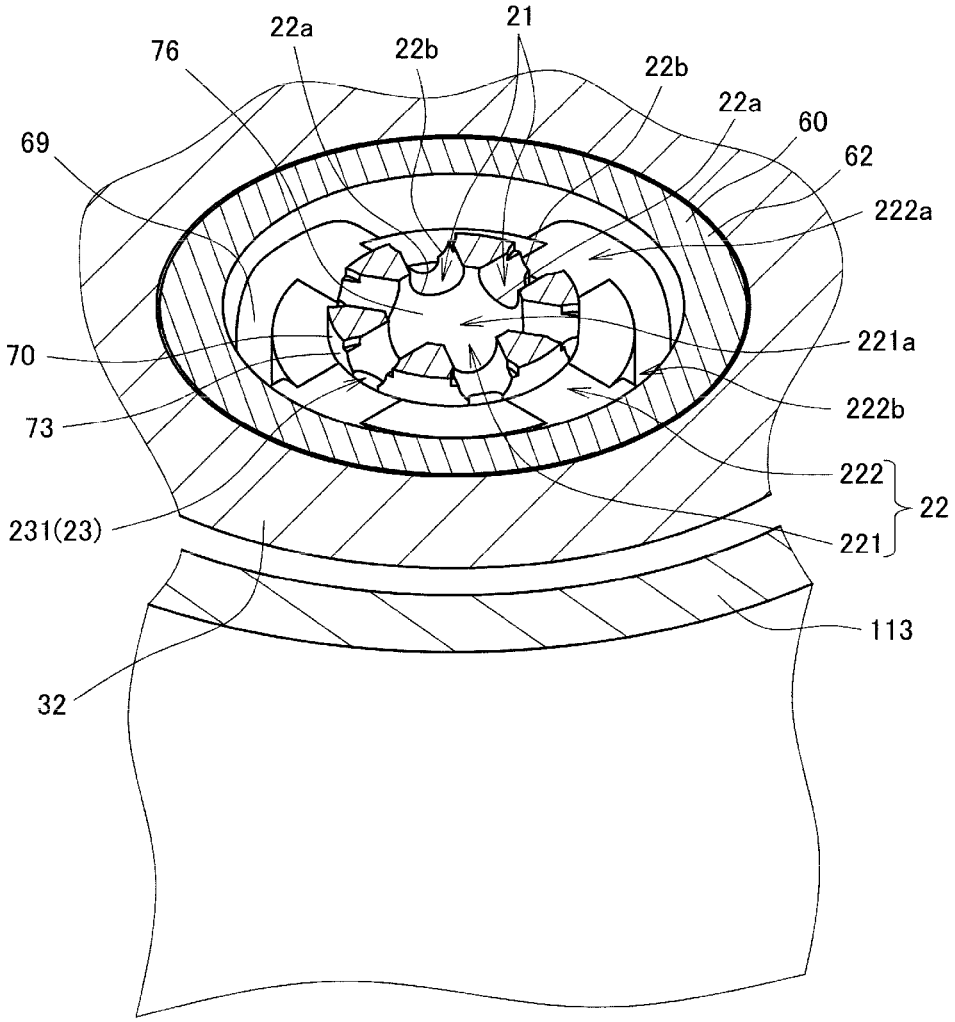
FIG. 37 is a perspective view in which a section taken along line M-M of FIG. 23 is seen from a bird's-eye view.
Figure 38:
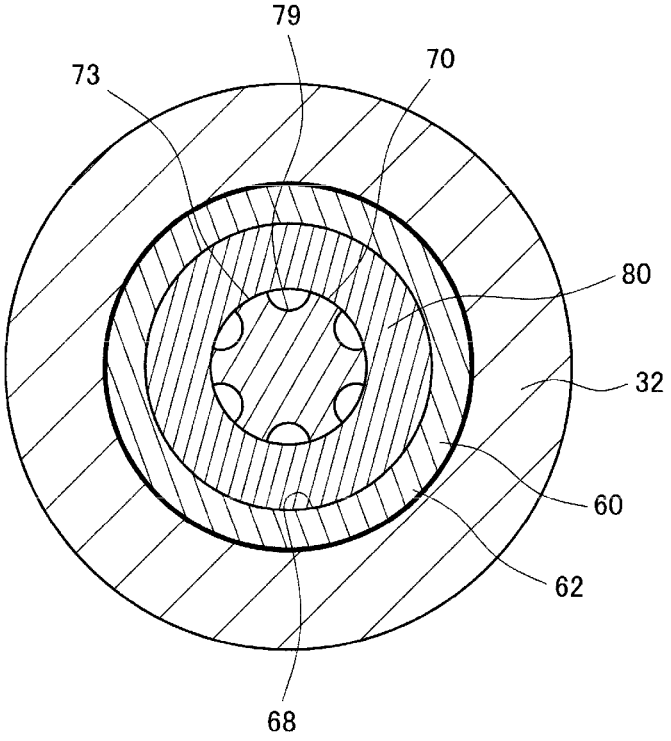
FIG. 38 is a sectional view taken along line N-N of FIG. 23.
Figure 39:
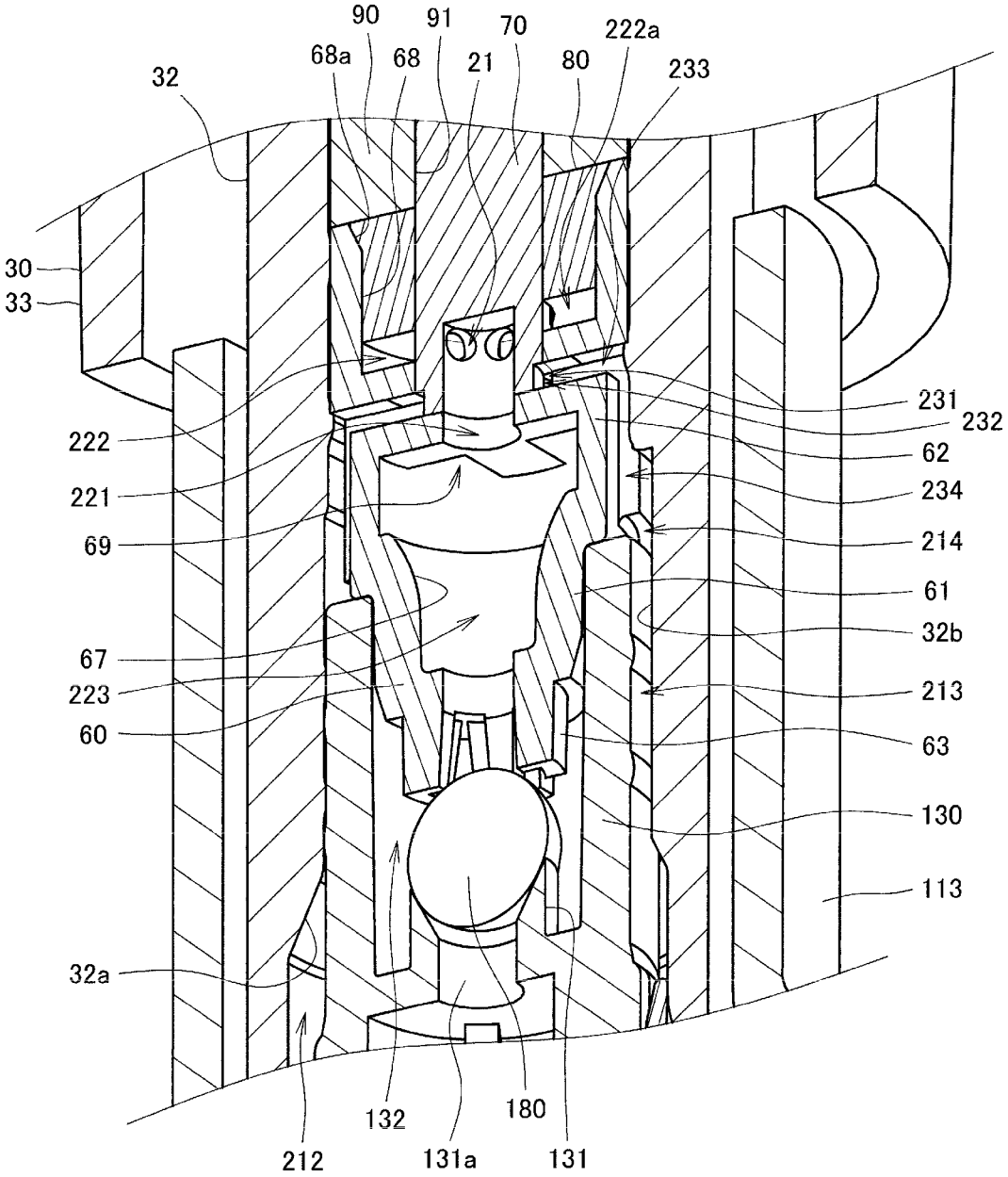
FIG. 39 is a perspective sectional view around the foamer mechanism of the foam dispensing cap according to the third embodiment (perspective sectional view taken along line A-A of FIG. 21).

As described above, the plural branch flow passages include the first branch flow passage 221 and the second branch flow passage 222. In a periphery of a downstream side end portion 221*a* of the first branch flow passage 221, the plural gas-liquid contact chambers 21 are intermittently arranged (arranged in a radial manner). In the case of this embodiment, as shown in FIGS. 37, 36A, and 36B, for example, six gas-liquid contact chambers 21 are arranged at equal angle intervals in a periphery of the downstream side end portion 221*a*.

Further, the downstream side end portion 221*a* of the first branch flow passage 221 has plural liquid agent openings 22*a* respectively corresponding to the plural gas-liquid contact chambers 21.

Meanwhile, the second branch flow passage 222 includes a circulating liquid agent flow passage 222*a* enclosing the downstream side end portion 221*a* of the first branch flow passage 221 across the plural gas-liquid contact chambers 21 in a circular manner (in an annular manner).

The circulating liquid agent flow passage 222*a* has plural liquid agent openings 22*b* respectively corresponding to the plural gas-liquid contact chambers 21.

Each of the liquid agent openings 22*b* of the circulating liquid agent flow passage 222*a* opposes the corresponding liquid agent opening 22*a* among the plural liquid agent openings 22*a* of the first branch flow passage 221 via the corresponding gas-liquid contact chamber 21.

The gas flow passage 23 branches into the plural adjacent flow passages 231 respectively corresponding to the plural gas-liquid contact chambers 21. Each of the plural adjacent flow passages 231 has the gas opening 23*a* that is open to the corresponding gas-liquid contact chamber 21.

Figure 33A:
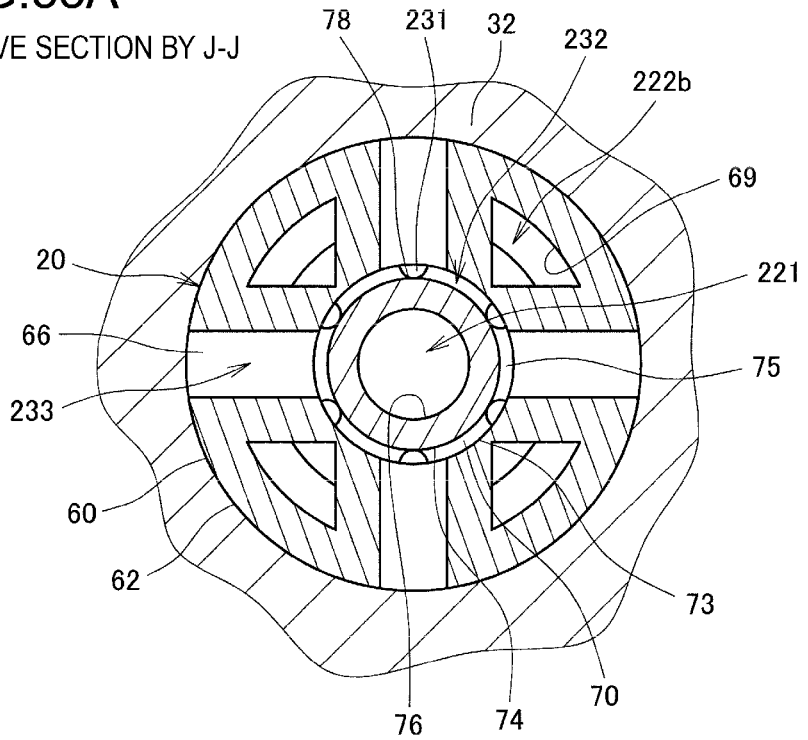
FIGS. 33A and 33B are sectional views taken along line J-J of FIG. 23.
Figure 33B:
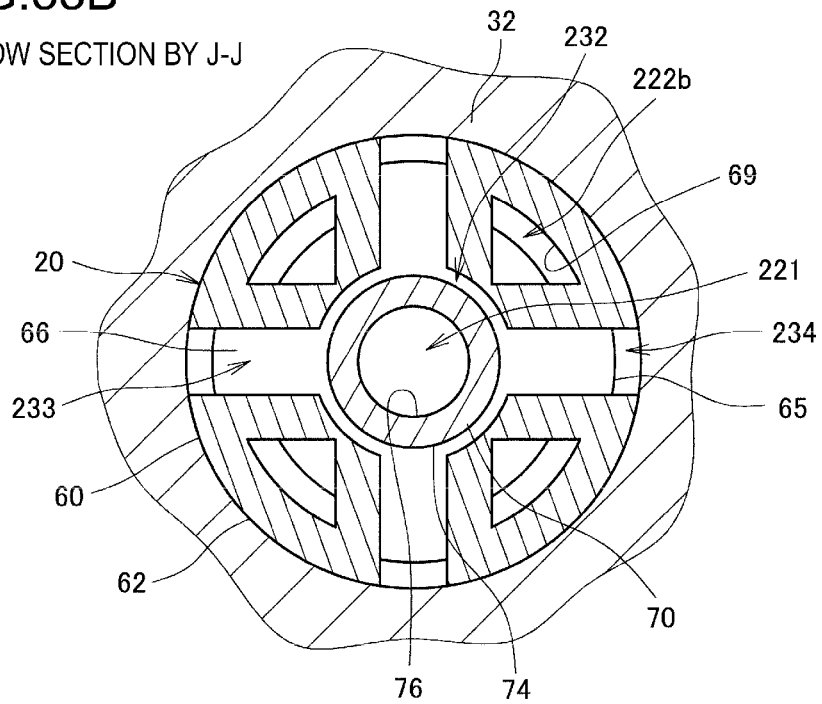
Figure 34:
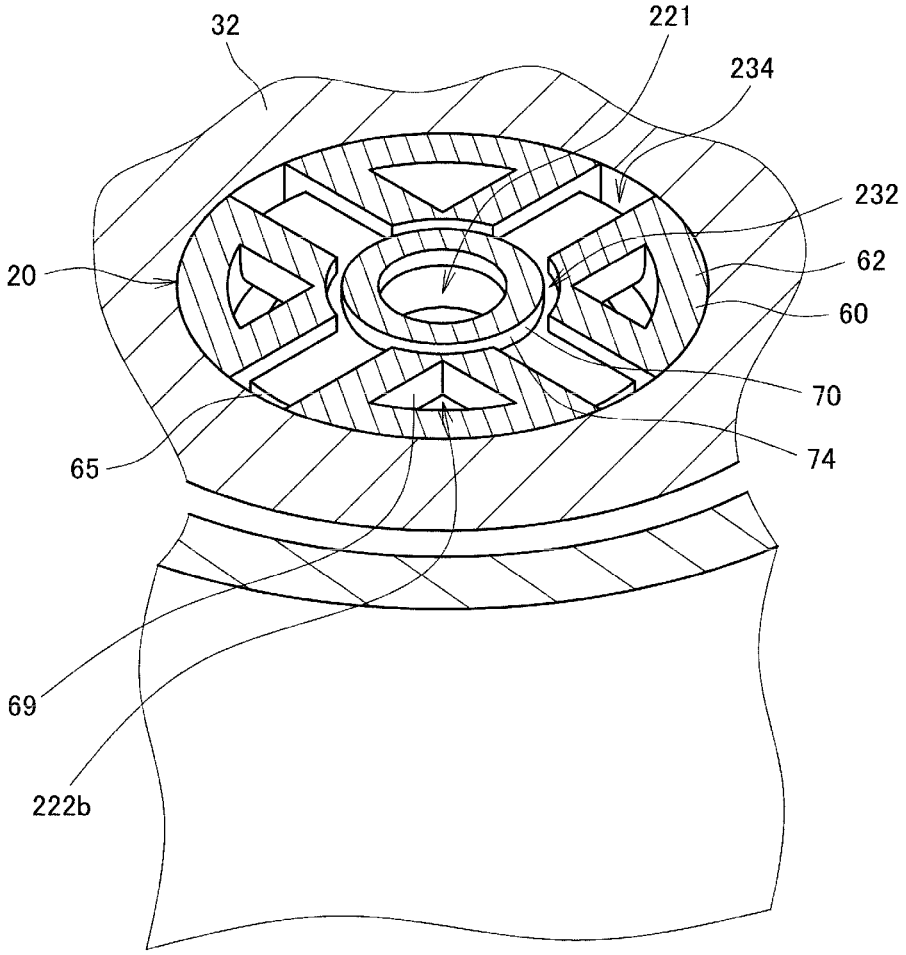
FIG. 34 is a perspective view in which a section taken along line J-J of FIG. 23 is seen from a bird's-eye view.
Figure 35:
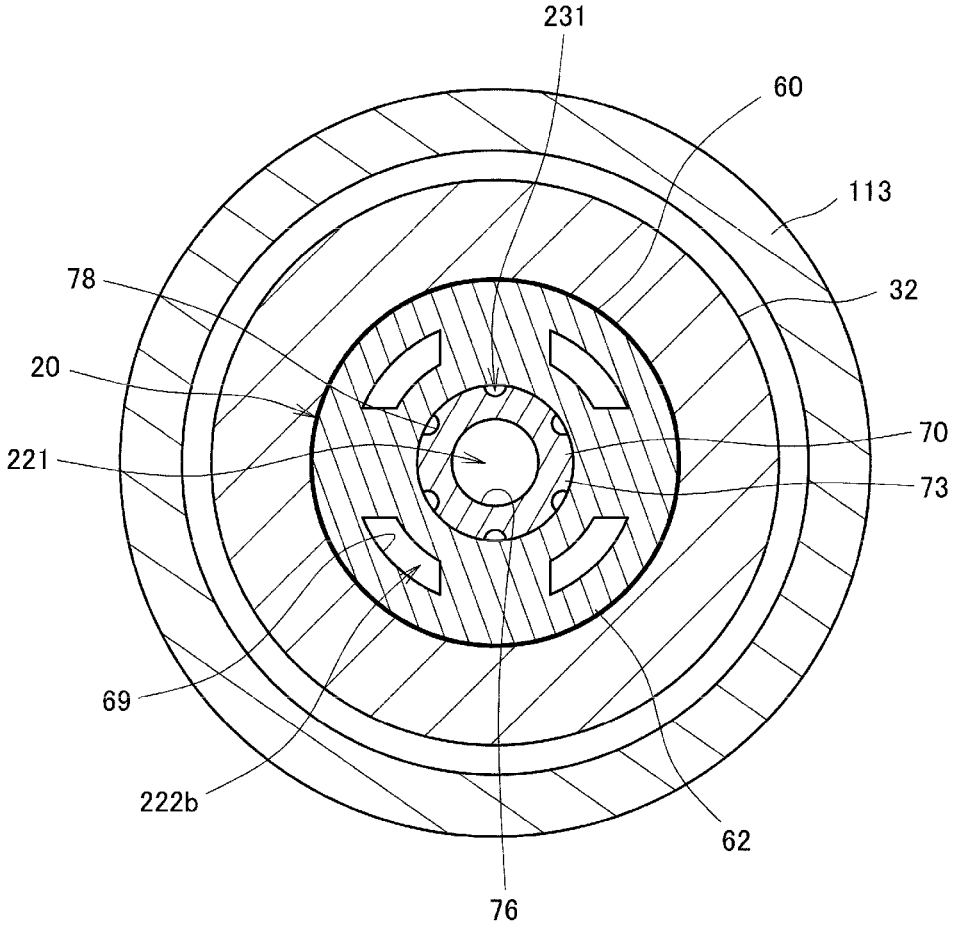
FIG. 35 is a sectional view taken along line K-K of FIG. 23.

As shown in FIGS. 34, 33A, and 33B, the gas flow passage 23 includes a circulating gas flow passage 232 enclosing the first branch flow passage 221 in a circular manner (in an annular manner). The circulating gas flow passage 232 communicates with each of the plural gas-liquid contact chambers 21 via each of the plural adjacent flow passages 231 (see FIG. 25).

The first branch flow passage 221 is a pillar-shaped space. In the case of this embodiment, the first branch flow passage 221 is a columnar space. The plural (in the case of this embodiment, six) adjacent flow passages 231 extend in parallel to the axial direction of the first branch flow passage 221 (in the direction of the axis AX4), and are intermittently arranged in a periphery of the first branch flow passage 221 (arranged in a radial manner). In more detail, for example, the plural adjacent flow passages 231 extend in parallel to the axial direction of the first branch flow passage 221, and are arranged at equal angle intervals in the periphery of the first branch flow passage 221.

The gas flow passage 23 includes the circulating gas flow passage 232 enclosing the first branch flow passage 221 in a circular manner (in an annular manner), a radial gas flow passage 233 through which the gas is supplied inward from the radially outer side of the circulating gas flow passage 232 toward the circulating gas flow passage 232, and the axial gas flow passage 234 extending in the direction parallel to the axial direction of the first branch flow passage 221, the axial gas flow passage through which the gas is supplied from the gas supply portion side (that is, the gas pump chamber 210 side) to the radial gas flow passage 233.

Figure 24:
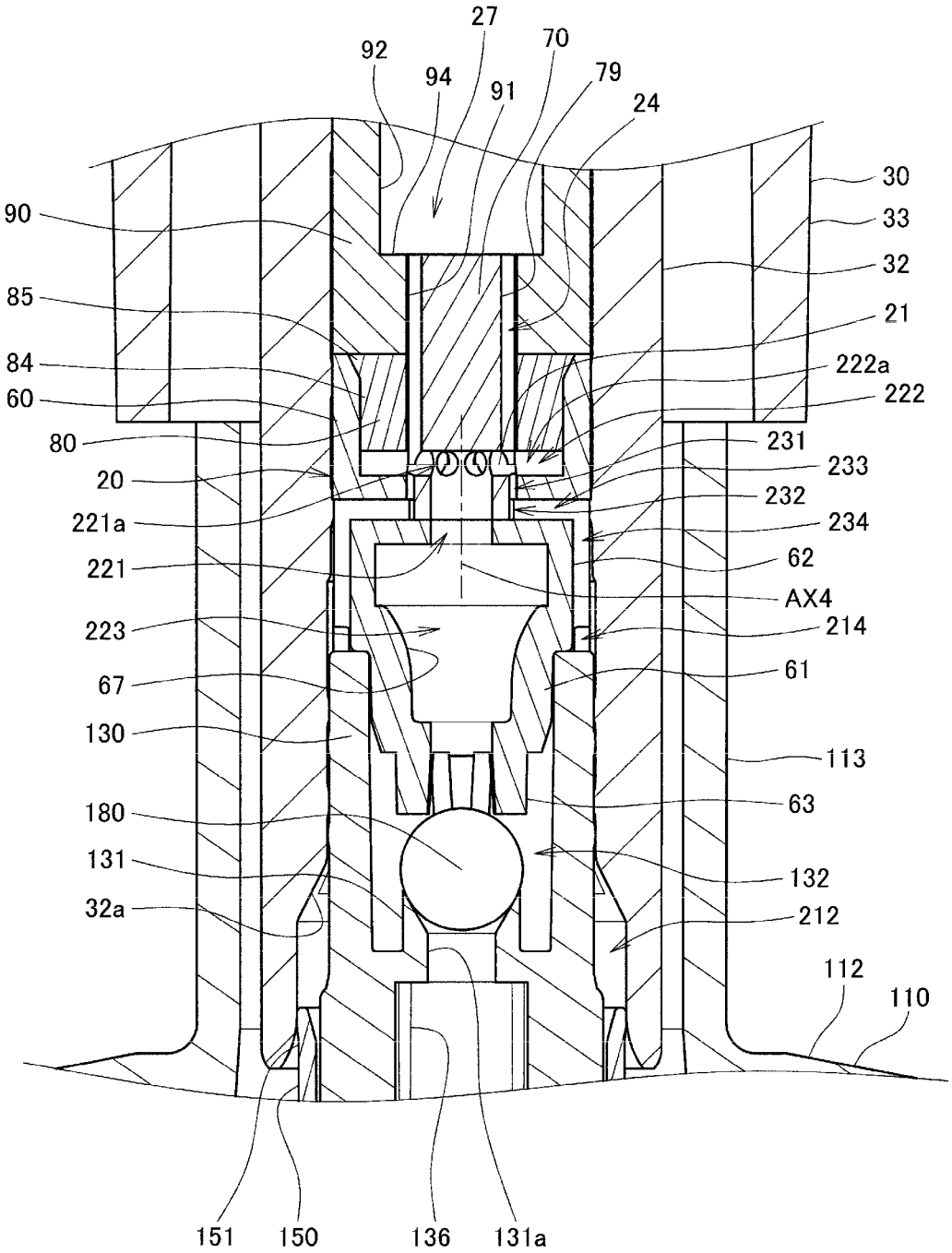
FIG. 24 is a sectional view around the foamer mechanism of the foam dispensing cap according to the third embodiment (sectional view taken along line B-B of FIG. 21).

When seen in the axial direction of the first branch flow passage 221 (in the direction of the axis AX4 of the first branch flow passage 221), the axial gas flow passage 234 is positioned at the outer side of the circulating liquid agent flow passage 222*a* in the radial direction of the first branch flow passage 221, and the circulating gas flow passage 232 is positioned at the inner side of the circulating liquid agent flow passage 222*a* in the radial direction of the first branch flow passage 221 (see FIG. 24).

Therefore, although the gas pump chamber 210 is arranged in a periphery of the liquid agent pump chamber 220 in a plan view, it is possible to arrange the circulating gas flow passage 232 and the adjacent flow passages 231 on the radially inner side from the circulating liquid agent flow passage 222*a*. Thereby, it is possible to supply the gas between the liquid agent openings 22*a* and the liquid agent openings 22*b* via the adjacent flow passages 231.

Figure 26:
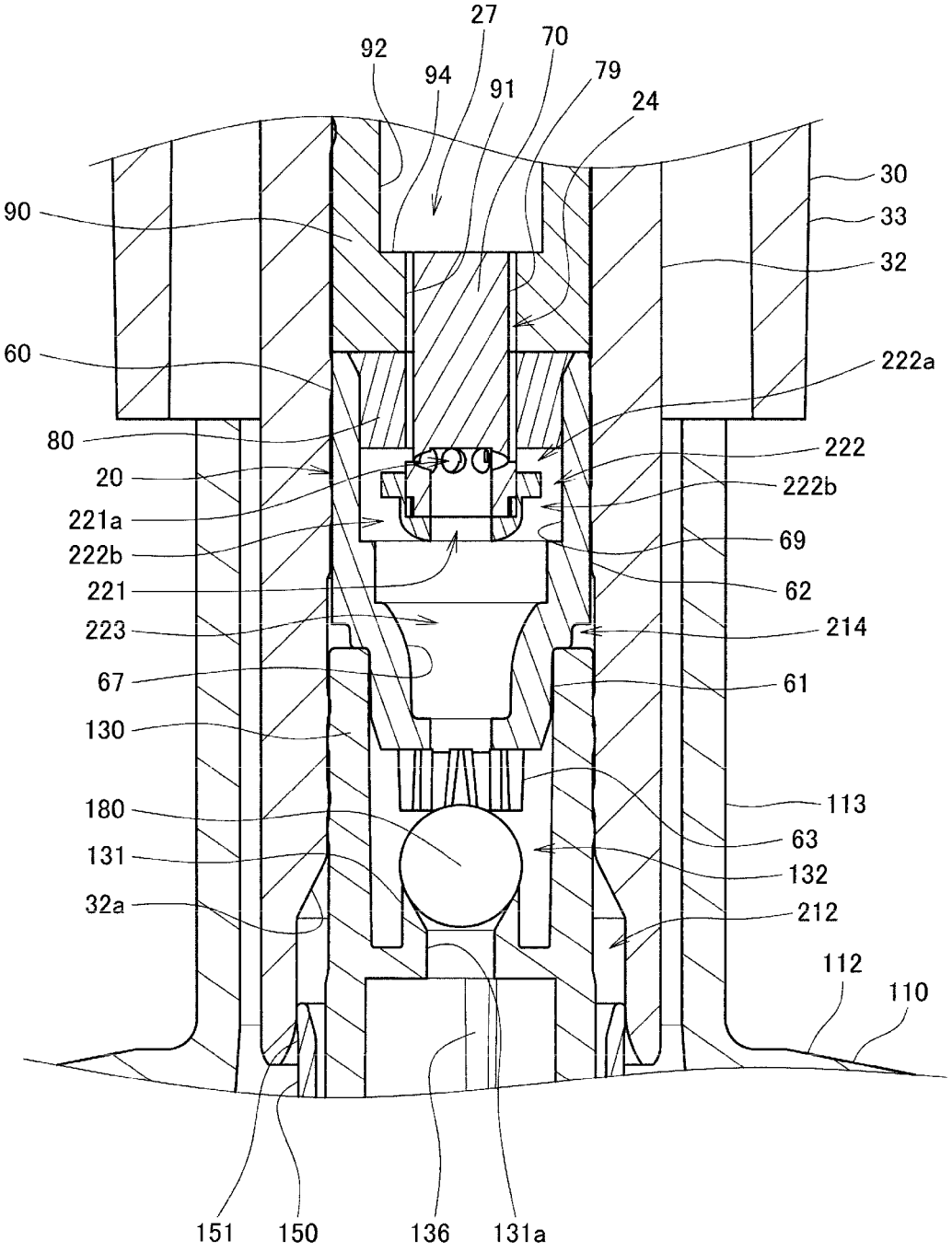
FIG. 26 is a sectional view around the foamer mechanism of the foam dispensing cap according to the third embodiment (sectional view taken along line C-C of FIG. 21).

The liquid agent flow passage 22 further includes an anterior chamber 223 into which the liquid agent 101 flows from the liquid agent supply portion side (that is, the liquid agent pump chamber 220 side). As shown in FIG. 26, the second branch flow passage 222 includes plural branch portions 222*b* arranged in the periphery of the first branch flow passage 221. The anterior chamber 223 communicates with the circulating liquid agent flow passage 222*a* via each of the plural branch portions 222*b*.

Therefore, while suppressing interference between the first branch flow passage 221 and the branch portions 222*b*, the liquid agent flow passage 22 branches into the first branch flow passage 221 and the plural branch portions 222*b*. Thus, it is possible to supply the liquid agent 101 to the circulating liquid agent flow passage 222*a* from the branch portions 222*b*.

In the following description, the axis AX4 of the first branch flow passage 221 may be called the axis AX4 of the foamer mechanism 20. In a plan view, with respect to the axis AX4 of the foamer mechanism 20, the front side may be called the zero-degree direction, the right side may be called the 90-degree direction, the rear side may be called the 180-degree direction, and the left side may be called the −90-degree direction.

In the case of this embodiment, the four radial gas flow passages 233 are intermittently arranged (for example, at equal angle intervals) in a periphery of the circulating gas flow passage 232. In more detail, for example, the radial gas flow passages 233 and the axial gas flow passages 234 are respectively arranged on the front, rear, left, and right sides (in the zero-degree direction, 180-degree direction, 90-degree direction, and −90-degree direction) of the circulating gas flow passage 232.

In the case of this embodiment, the four branch portions 222*b* are intermittently arranged (for example, at equal angle intervals) in the periphery of the first branch flow passage 221. In more detail, for example, the branch portions 222*b* are respectively arranged on the right-oblique front side (in the 45-degree direction), the right-oblique rear side (in the 135-degree direction), the left-oblique rear side (in the −135-degree direction), and the left-oblique front side (in the −45-degree direction) of the first branch flow passage 221.

In the case of this embodiment, the six gas-liquid contact chambers 21 are intermittently arranged (for example, at equal angle intervals) in the periphery of the downstream side end portion 221*a* of the first branch flow passage 221. In more detail, for example, the gas-liquid contact chambers 21 and the adjacent flow passages 231 are respectively arranged in the 30-degree direction, in the 90-degree direction, in the 150-degree direction, in the −30-degree direction, in the −90-degree direction, and in the 150-degree direction.

Figure 20:
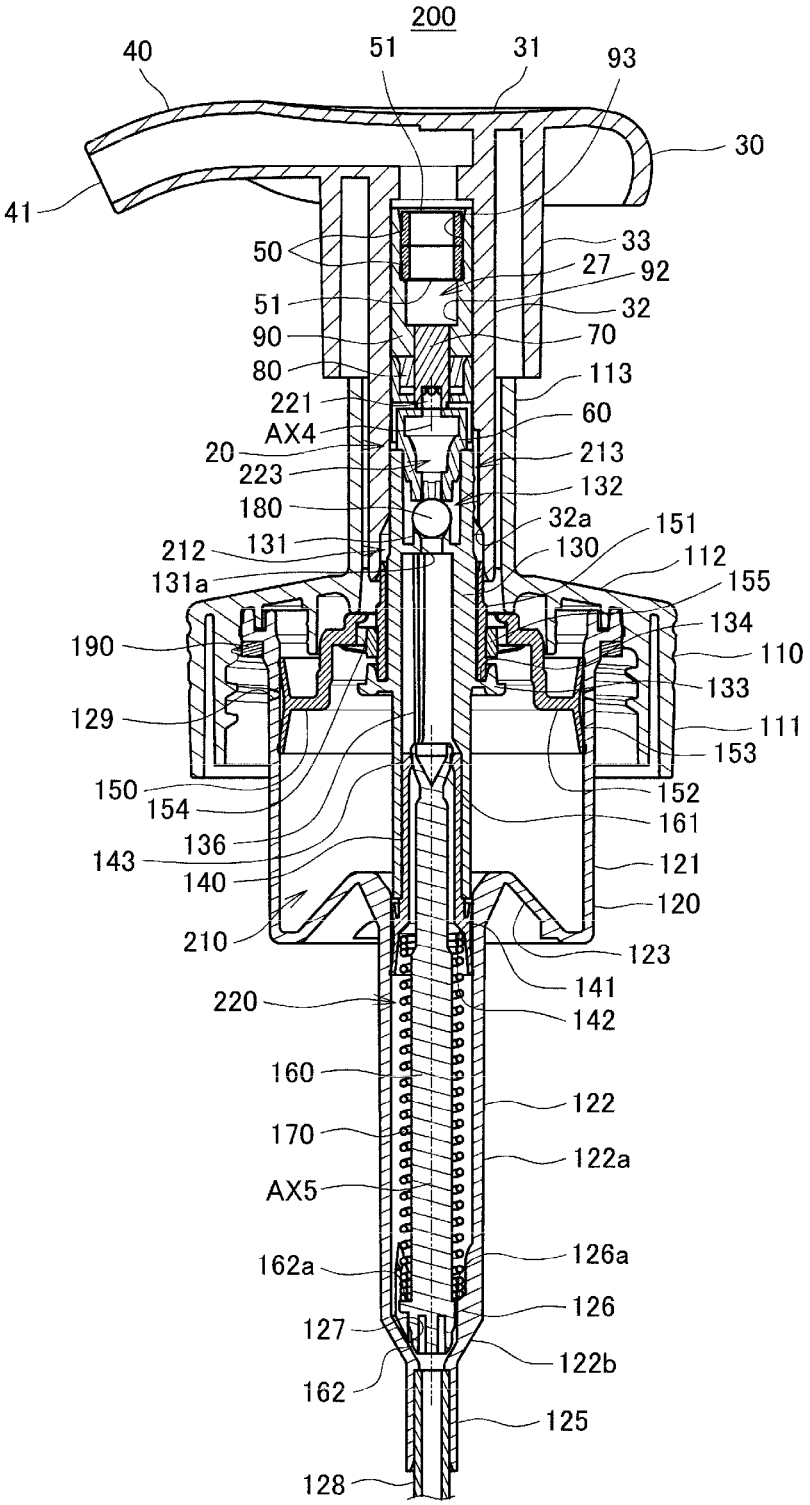
FIG. 20 is a side sectional view of a foam dispensing cap according to a third embodiment.
Figure 21:
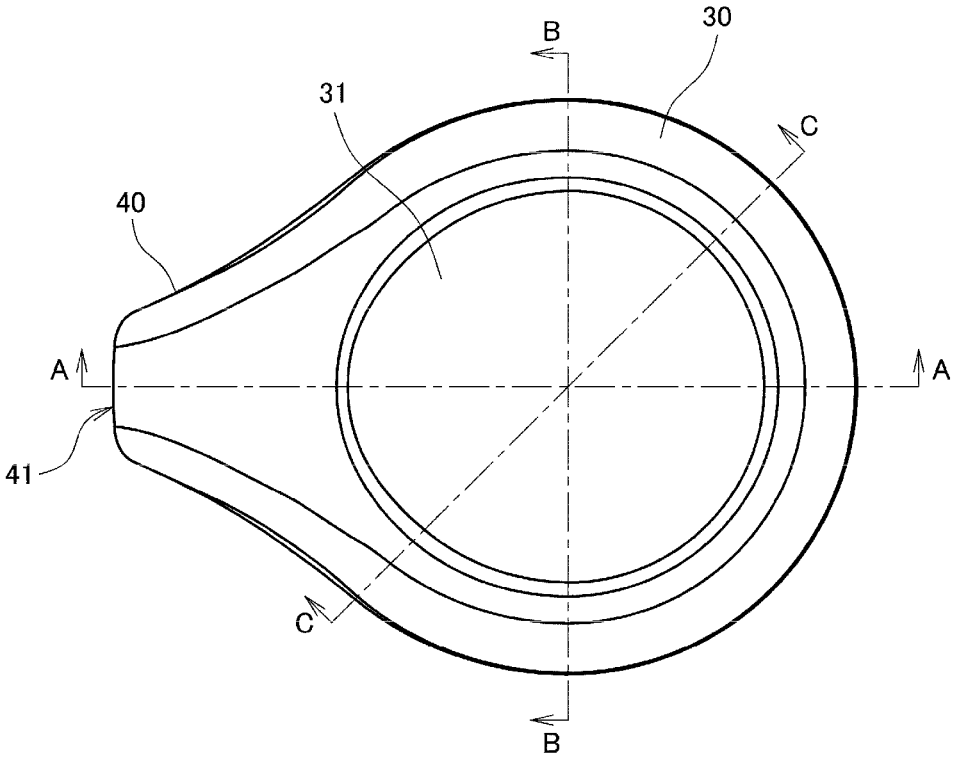
FIG. 21 is a plan view showing a head member of the foam dispensing cap according to the third embodiment.

Here, the liquid agent supply portion (liquid agent cylinder) is formed to be long in one direction (up and down direction). The first branch flow passage 221 is arranged on the same axis as the long axis direction of the liquid agent supply portion. That is, as shown in FIG. 20, the axis AX4 of the first branch flow passage 221 is arranged on an extension of the axis AX5 of the liquid agent pump chamber 220. The axis AX4 of the first branch flow passage 221 and the axis AX5 of the liquid agent pump chamber 220 are placed on the same axis (see FIG. 20).

Figure 25:
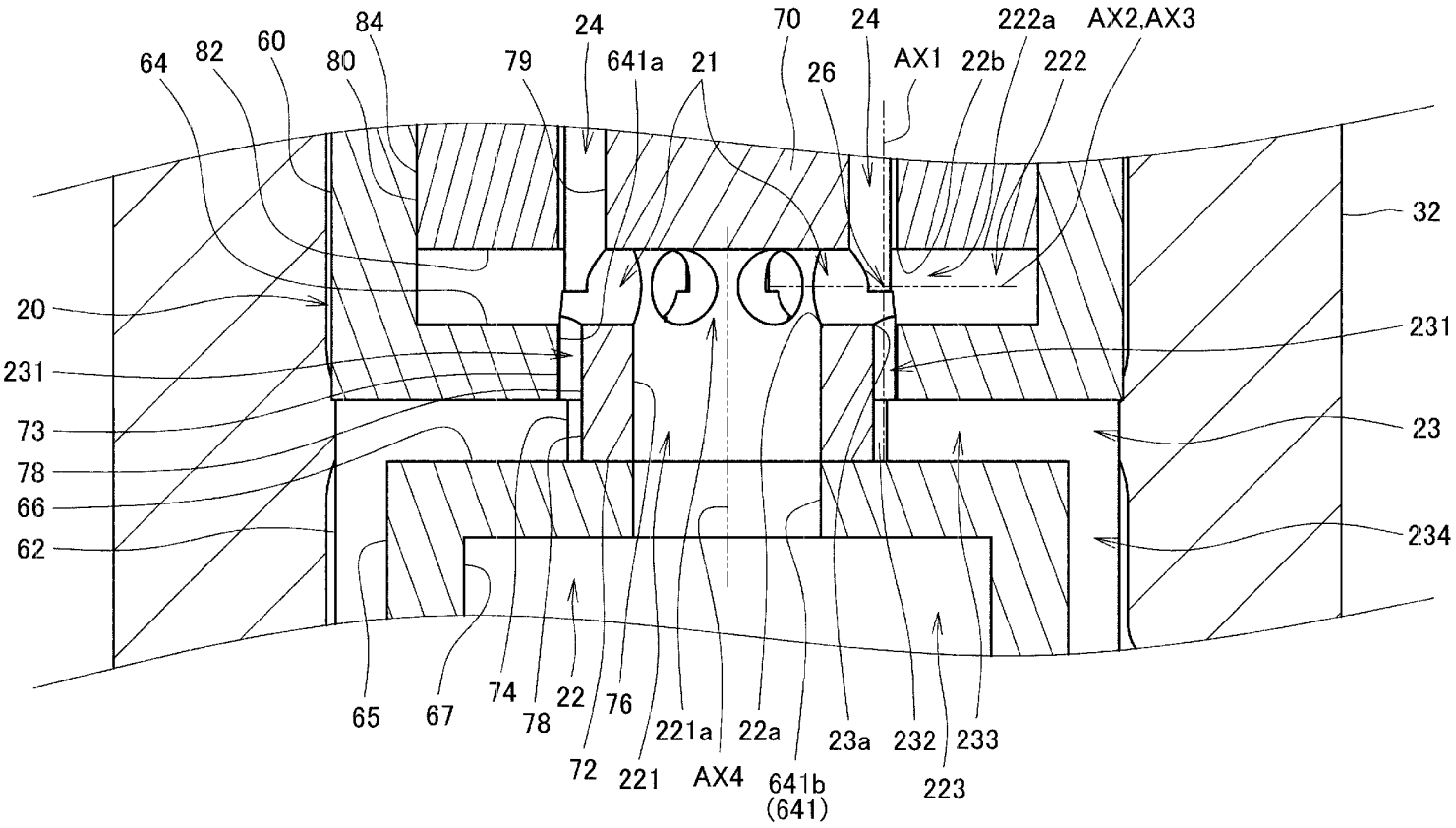
FIG. 25 is a partially enlarged view of FIG. 24.

At a position on an extension of the adjacent flow passage 231 while sandwiching the gas-liquid contact chamber 21 in between, the foam flow passage 24 communicating with the gas-liquid contact chamber 21 and extending in the extension direction of the adjacent flow passage 231 is arranged (see FIG. 25).

A parts configuration for realizing the foamer mechanism 20 formed as above is not particularly limited. However, as an example, it is possible to form the foamer mechanism 20 by combining a flow passage forming member 60, a fitting pin 70, a fitting ring 80, and a holding member 90 (see FIG. 40 respectively) to be described later, respectively.

As shown in FIGS. 41A to 41D and 42A to 42D, the flow passage forming member 60 is formed in a tubular shape, and includes a small diameter portion 61, a large diameter portion 62 positioned above the small diameter portion 61 and formed to have a larger diameter than the small diameter portion 61, and plural (for example, four) projection portions 63 projecting downward from a lower end of the small diameter portion 61.

The plural projection portions 63 are arranged at equal angle intervals along the circumferential direction of the lower end of the small diameter portion 61. Each of the projection portions 63 becomes thinner toward the lower side, and a gap between the adjacent projection portions 63 is extended toward the lower side.

An inner flange-shaped floor slab portion 64 is horizontally provided inside an up-down central portion of the large diameter portion 62. An axial through hole 641 passing through the floor slab portion 64 in the up and down direction is formed in a central portion of the floor slab portion 64 in a plan view. The axial through hole 641 includes a large diameter hole portion 641*a* forming an upper portion of the axial through hole 641, and a small diameter hole portion 641*b* forming a lower portion of the axial through hole 641 and having a smaller diameter than the large diameter hole portion 641*a*.

An inner circumferential surface of a lower portion of the large diameter hole portion 641*a* forms an outer circumferential wall of the circulating gas flow passage 232.

Plural (for example, four) axial grooves 65 respectively extending in the up and down direction are formed on an outer circumferential surface of the large diameter portion 62. These axial grooves 65 respectively form the axial gas flow passages 234 of the gas flow passage 23.

Further, plural (for example, four) radial through holes 66 passing through from upper ends of the axial grooves 65 to the inside of the large diameter hole portion 641*a* are formed in the large diameter portion 62. The radial through holes 66 extend horizontally, and are opened at lower end positions of the large diameter hole portion 641*a*. In other words, the radial through holes 66 are horizontally formed inside the floor slab portion 64.

A hollow portion 67 forming the anterior chamber 223 of the liquid agent flow passage 22 is formed in a part on the lower side of the floor slab portion 64 in the flow passage forming member 60. This hollow portion 67 includes an internal space of the large diameter portion 62 on the lower side from the floor slab portion 64, and an internal space of the small diameter portion 61.

An internal space of a part of the flow passage forming member 60 (large diameter portion 62) on the upper side of the floor slab portion 64 forms a recessed portion 68 into which the fitting ring 80 is fitted. An upper end portion of the recessed portion 68 serves as a tapered portion 68*a* whose diameter is extended upward.

Further, plural (for example, four) peripheral edge through holes 69 passing through the floor slab portion 64 in the up and down direction are formed in a part of a periphery of the axial through hole 641 in the floor slab portion 64. Each of these peripheral edge through holes 69 is arranged at an intermediate position between the adjacent radial through holes 66 in a plan view, and the radial through holes 66 and the peripheral edge through holes 69 are respectively partitioned from each other by a solid part of the floor slab portion 64.

Here, the example where the entire flow passage forming member 60 is integrated is shown. However, in order to simplify a forming property of the flow passage forming member 60, the flow passage forming member 60 may be divided into an upper part and a lower part by a division line 60*a* shown in FIG. 41A and the flow passage forming member 60 may be formed by the two members.

As shown in FIGS. 43A to 43D, 44A, and 44B, the fitting pin 70 is formed into a columnar shape. Each of an upper end surface 71 and a lower end surface 72 of the fitting pin 70 is a flat surface orthogonal to the axis direction of the fitting pin 70.

At a lower end portion of the fitting pin 70, a recessed portion 76 whose inner cavity section is formed in a columnar shape is formed concentrically to the fitting pin 70, and the recessed portion 76 is opened downward. Since the recessed portion 76 is formed in the lower end portion of the fitting pin 70, the lower end portion of the fitting pin 70 is formed in a cylindrical shape concentric to the fitting pin 70.

Figure 23:
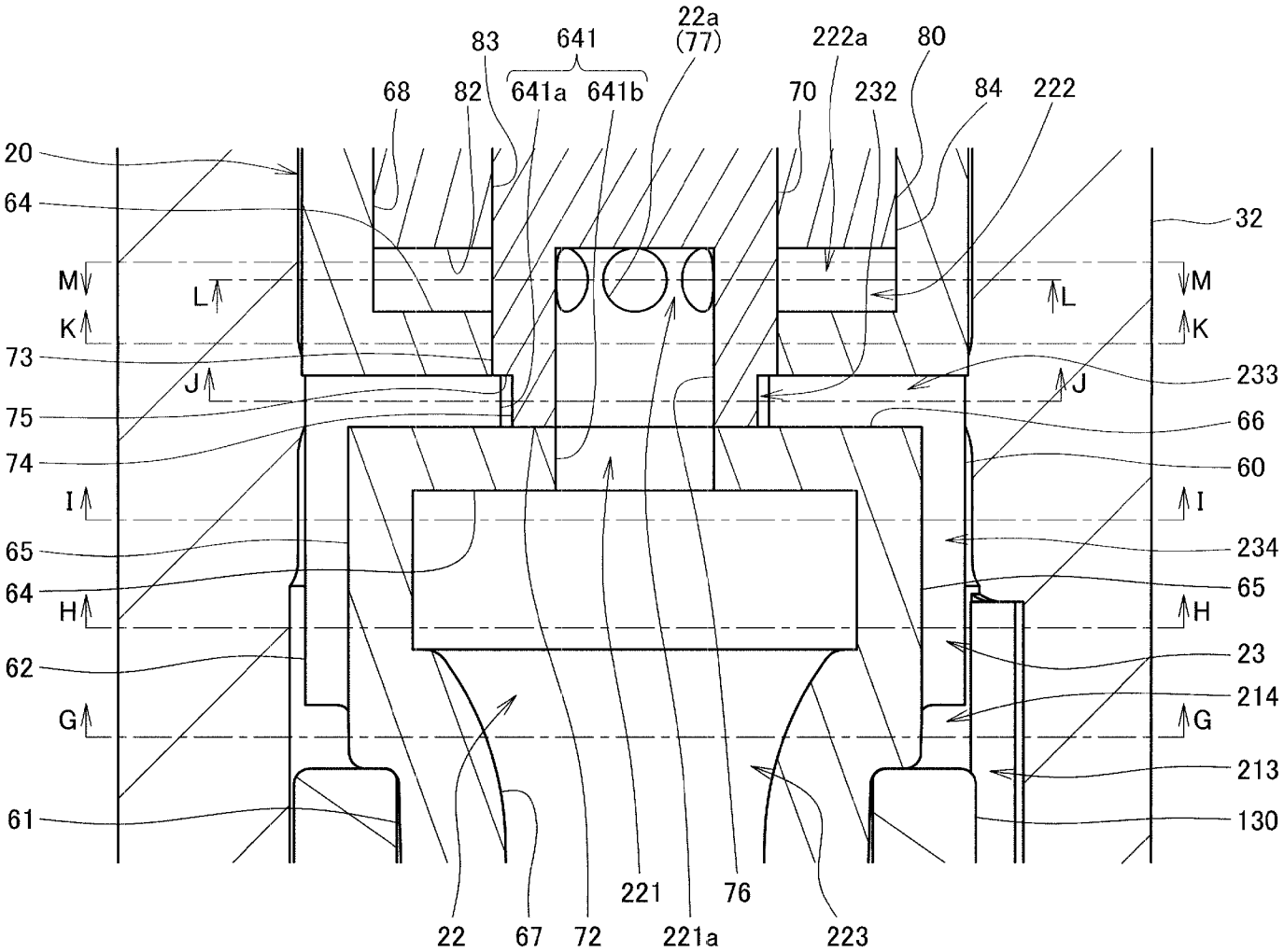
FIG. 23 is a partially enlarged view of FIG. 22.

The lowest end portion of the fitting pin 70 is a small diameter portion 74 having a smaller diameter than the other portions (hereinafter, referred to as the large diameter portion 73) in the fitting pin 70. In a border between the small diameter portion 74 and the large diameter portion 73, a downward level difference surface 75 is formed. This level difference surface 75 defines an upper end of the circulating gas flow passage 232 (FIG. 23, etc.). An outer circumferential surface of the small diameter portion 74 forms an inner circumferential wall of the circulating gas flow passage 232.

Plural through holes 77 providing communication between the vicinity of an upper end of an internal space of the recessed portion 76 and an external space of the fitting pin 70 are formed in the large diameter portion 73. The axis direction of each of the through holes 77 matches with, for example, the radial direction of the fitting pin 70. The plural through holes 77 are arranged, for example, at equal angle intervals around the axis of the fitting pin 70. In more detail, for example, six through holes 77 are arranged at 60-degree intervals. The shape of each of the through holes 77 when seen in the axis direction is, for example, a circular shape (see FIG. 43A).

Plural (for example, six) air flow passage forming grooves 78 and plural (for example, six) foam flow passage forming grooves 79 are formed on the outer circumferential surface of the large diameter portion 73. The air flow passage forming grooves 78 and the foam flow passage forming grooves 79 respectively extend in parallel to the axis of the fitting pin 70. The air flow passage forming grooves 78 and the foam flow passage forming grooves 79 are respectively arranged at positions in the same phase as the through holes 77 in the circumferential direction of the fitting pin 70. That is, one air flow passage forming groove 78 and one foam flow passage forming groove 79 are arranged corresponding to each of the through holes 77.

Each of the air flow passage forming grooves 78 forms the adjacent flow passage 231. Each of the air flow passage forming grooves 78 is formed linearly to range from a lower end of the large diameter portion 73 (the same height position as the level difference surface 75) to the through hole 77 corresponding to the air flow passage forming groove 78.

Figure 43A:
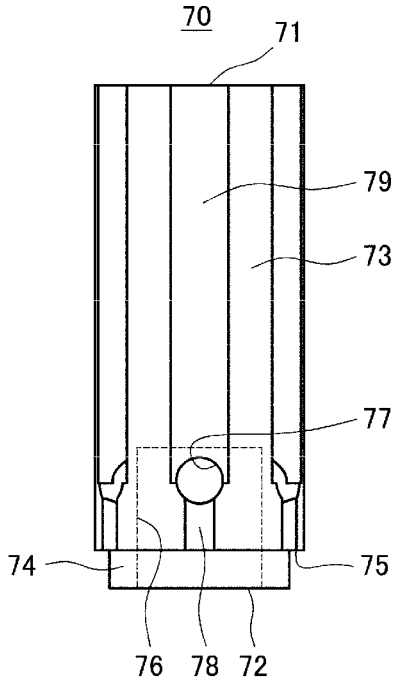
FIGS. 43A to 43D are views showing a fitting pin provided in the foam dispensing cap according to the third embodiment.
Figure 43B:
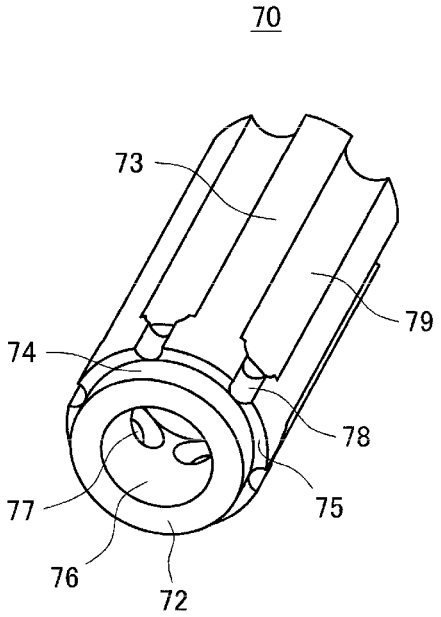
Figure 43C:
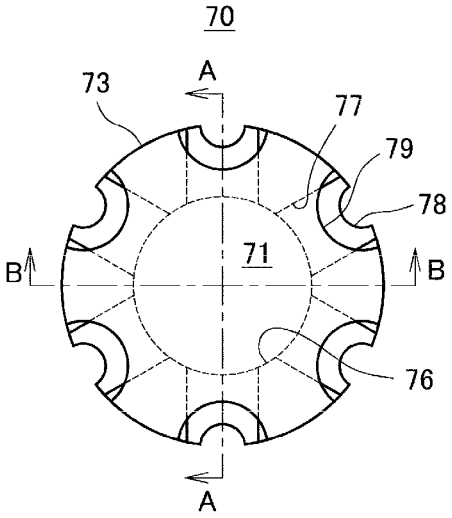
Figure 43D:
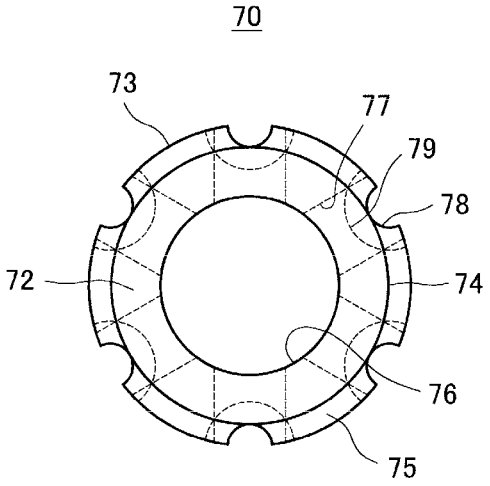
Figure 44A:
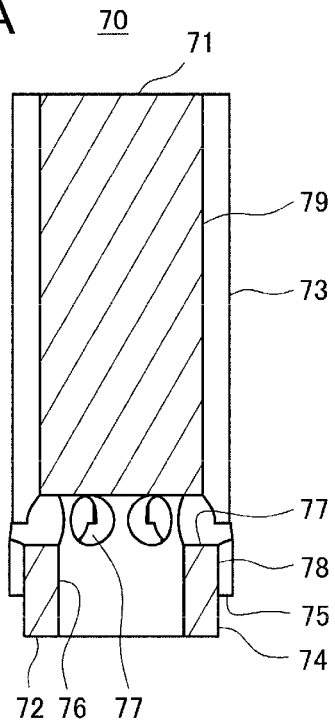
FIGS. 44A and 44B are views showing the fitting pin member provided in the foam dispensing cap according to the third embodiment.
Figure 44B:
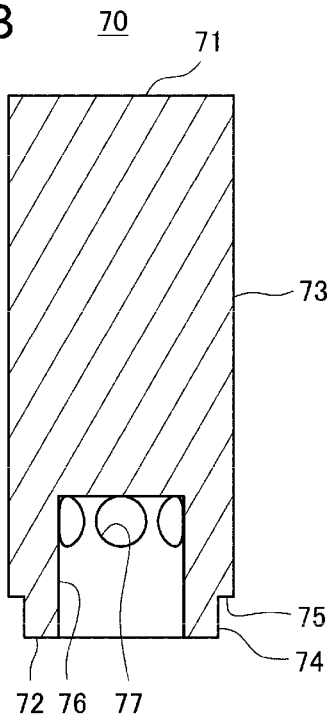

The sectional shape of the air flow passage forming groove 78 is not particularly limited but may be, for example, a fan shape (see FIGS. 43C and 43D). The opening width of the air flow passage forming groove 78 is, for example, smaller than an inner diameter of the through hole 77 (see FIG. 43A).

A position of the deepest portion of the air flow passage forming groove 78 in the radial direction of the fitting pin 70 is, for example, the same as a position of an outer surface of the small diameter portion 74 (see FIG. 43D). That is, depth of the air flow passage forming groove 78 is the same as size of a level difference in the level difference surface 75.

The foam flow passage forming grooves 79 form the foam flow passages 24. Each of the foam flow passage forming grooves 79 is formed linearly to range from the through hole 77 corresponding to each of the air flow passage forming grooves 78 to an upper end of the fitting pin 70 (the same height position as the upper end surface 71). In more detail, each of the foam flow passage forming grooves 79 is arranged on an extension of the air flow passage forming groove 78 corresponding to the foam flow passage forming groove 79.

The sectional shape of the foam flow passage forming groove 79 is not particularly limited but may be, for example, a fan shape (half-moon shape) (see FIG. 43C). The opening width of the foam flow passage forming groove 79 is, for example, greater than the opening width of the air flow passage forming groove 78. In more detail, the opening width of the foam flow passage forming groove 79 is, for example, greater than the inner diameter of the through hole 77 (see FIG. 43A).

Depth of the foam flow passage forming groove 79 is greater than depth of the air flow passage forming groove 78. A position of the deepest portion of the foam flow passage forming groove 79 is placed closer to the center in the radial direction of the fitting pin 70 than the position of the outer surface of the small diameter portion 74.

Since the foam flow passage forming grooves 79 described above are formed in the large diameter portion 73, the upper end surface 71 is formed in a circular shape in which fan-shaped (for example, half-moon-shaped) cut portions are formed at six points in an outer circumferential portion (FIG. 43C).

The lower end surface 72 is formed in a ring shape (FIGS. 43D and 43B).

Figure 40:
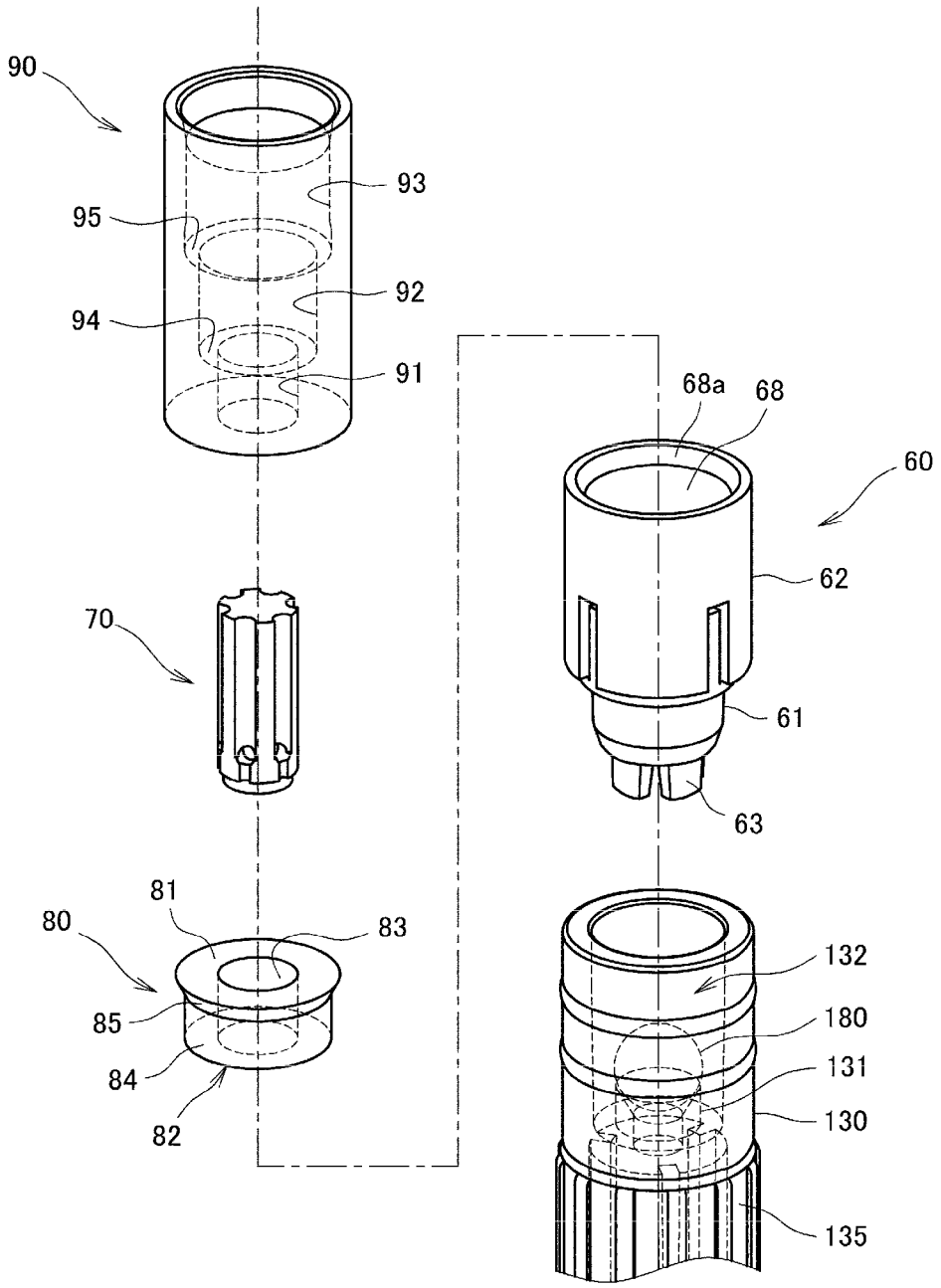
FIG. 40 is an exploded perspective view of some parts forming the foam dispensing cap according to the third embodiment, showing only an upper end portion regarding a piston guide.
Figure 41A:
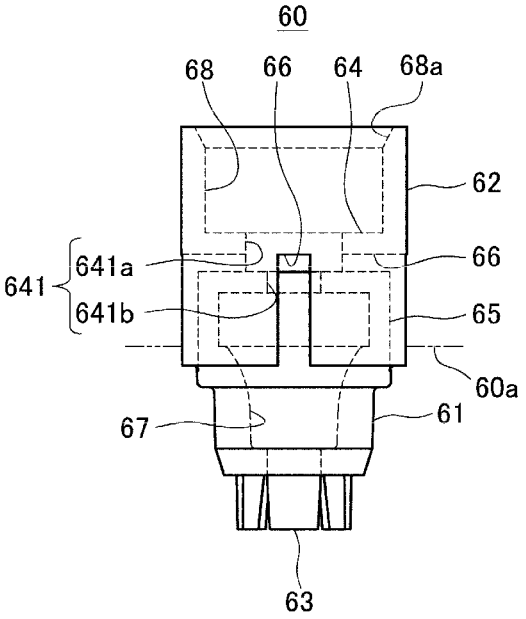
FIGS. 41A to 41D are views showing a flow passage forming member provided in the foam dispensing cap according to the third embodiment.
Figure 41B:
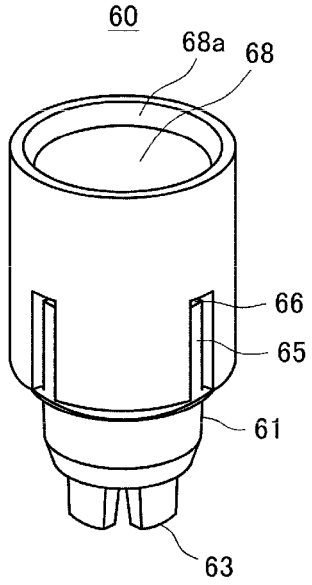
Figure 41C:
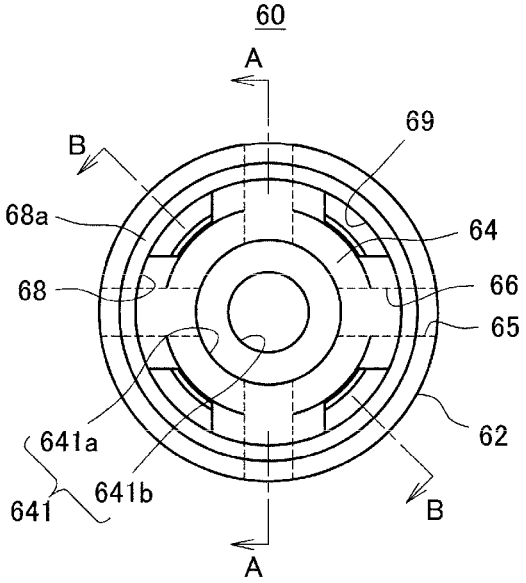
Figure 41D:
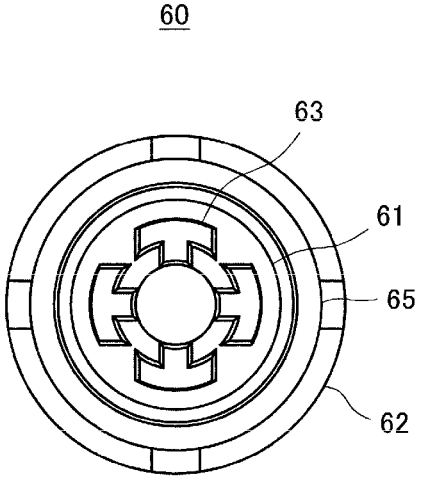
Figure 42A:
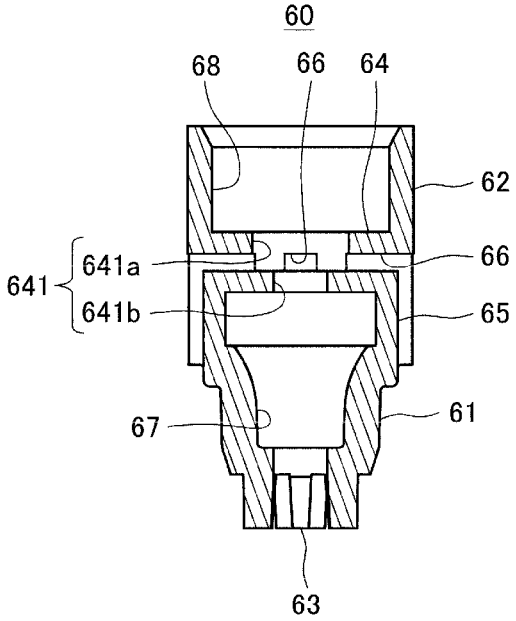
FIGS. 42A to 42D are views showing the flow passage forming member provided in the foam dispensing cap according to the third embodiment.
Figure 42B:
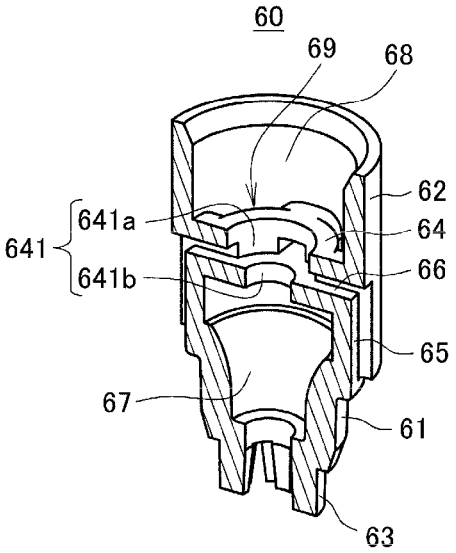
Figure 42C:
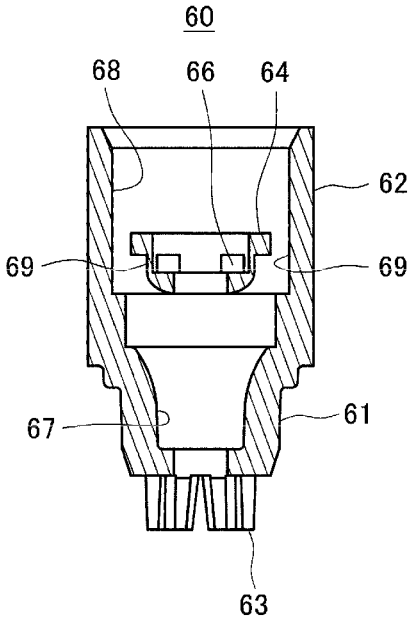
Figure 42D:
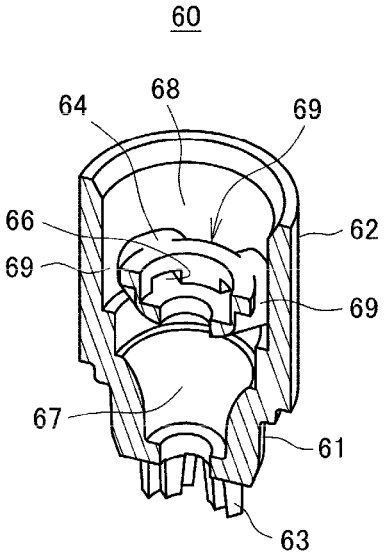

As shown in FIG. 40, the fitting ring 80 is formed in a columnar shape. A hole 83 passing through the fitting ring 80 from an upper surface 81 to a lower surface 82 in the up and down direction is formed in the axial center of the fitting ring 80. An internal space of the hole 83 is formed in a columnar shape. A diameter of an upper end portion of an outer circumferential surface of the fitting ring 80 is extended upward in a tapered shape. That is, the fitting ring 80 has a tapered portion 85 at an upper end portion, and the other portions of the fitting ring 80 is a straight portion 84 with straight shape.

An outer diameter of the large diameter portion 73 of the fitting pin 70 is set to be equal to an inner diameter of the hole 83 of the fitting ring 80 and an inner diameter of the large diameter hole portion 641*a* of the axial through hole 641 of the flow passage forming member 60.

Figure 22:
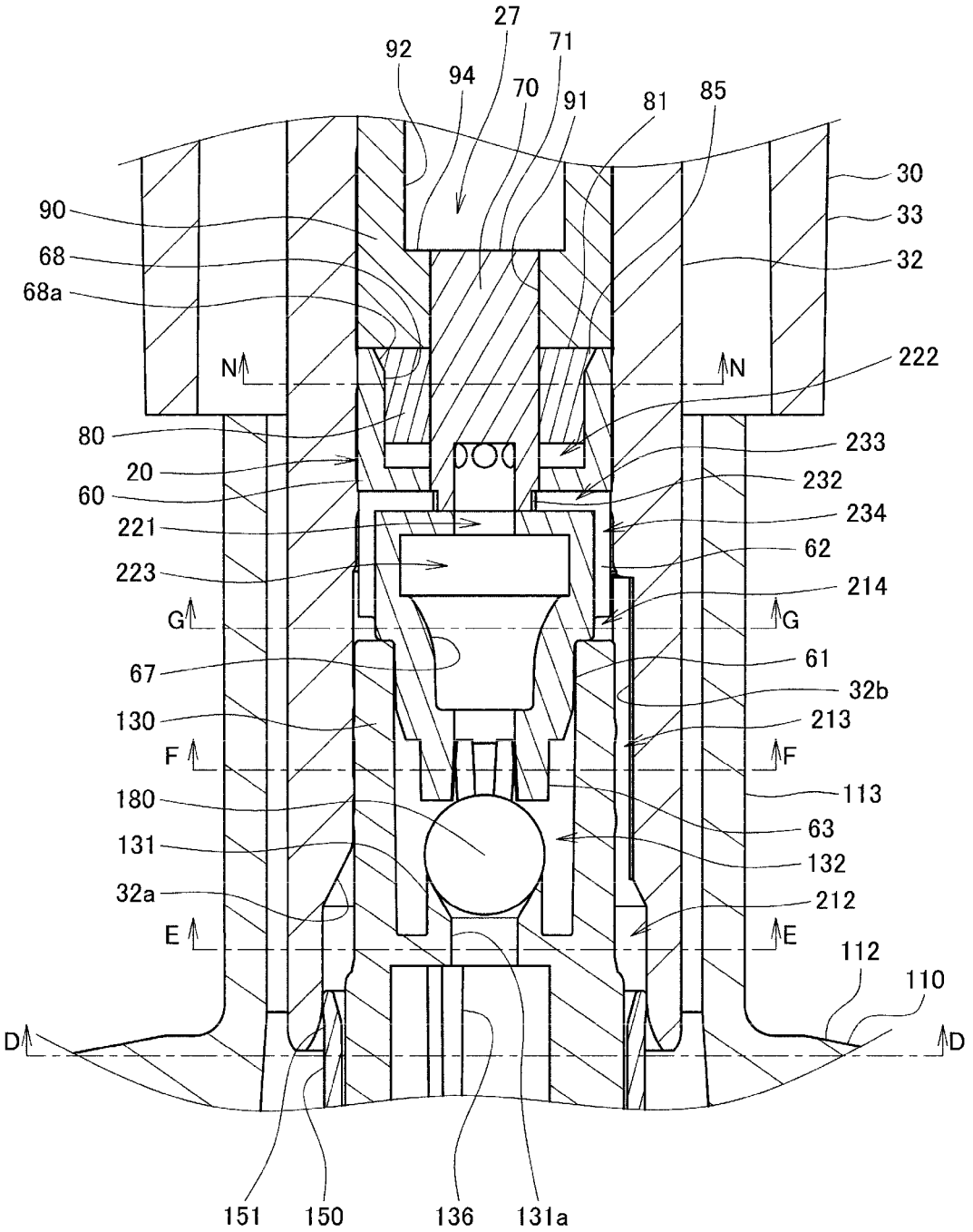
FIG. 22 is a side sectional view around a foamer mechanism of the foam dispensing cap according to the third embodiment (sectional view taken along line A-A of FIG. 21).

As shown in FIG. 40, the holding member 90 is formed in a cylindrical shape in which a through hole passing through the holding member 90 in the up and down direction is formed. In more detail, the through hole of the holding member 90 has a pin holding hole portion 91, a foam interflow chamber forming hole portion 92, and a mesh ring holding hole portion 93 in order from the bottom. An inner diameter of the pin holding hole portion 91 is set to be equal to an outer diameter of the large diameter portion 73 of the fitting pin 70, and an upper portion of the large diameter portion 73 is fitted into the pin holding hole portion 91 (FIG. 22).

The foam interflow chamber forming hole portion 92 forms a foam interflow chamber 27 positioned at the subsequent stage of the plural foam flow passages 24 and at the previous stage of meshes 51, and is formed, for example, to have a larger diameter than the pin holding hole portion 91. The upper end surface 71 of the fitting pin 70 is arranged to be flush with a level difference portion 94 at a border between the foam interflow chamber forming hole portion 92 and the pin holding hole portion (FIG. 22).

The mesh ring holding hole portion 93 forms a region where mesh holding rings 50 arranged at the subsequent stage of the foam interflow chamber 27 are housed, and is formed, for example, to have a further larger diameter than the foam interflow chamber forming hole portion 92.

As shown in FIG. 3, each of the mesh holding rings 50 is a cylindrical member, and the mesh 51 is provided in an opening on one side in the axial direction.

For example, two mesh holding rings 50 are fitted into the mesh ring holding hole portion 93 of the holding member 90 in a state where the two mesh holding rings are stacked one on top of the other. The mesh 51 of the lower mesh holding ring 50 among the two mesh holding rings 50 is positioned at a lower end of the mesh holding ring 50, and the mesh 51 of the upper mesh holding ring 50 is positioned at an upper end of the mesh holding ring 50.

By being fitted into an inner tube portion 32, the holding member 90 is fixed to a head member 30.

In the flow passage forming member 60, the small diameter portion 61 is inserted into a housing space 132 at an upper end portion of a piston guide 130, and a lower end surface of a peripheral edge of the large diameter portion 62 is supported by an upper end surface of the piston guide 130.

The fitting ring 80 is fitted into the recessed portion 68 of the flow passage forming member 60. As shown in FIG. 22, etc., the tapered portion 85 of the fitting ring 80 is fitted to the tapered portion 68*a* of the recessed portion 68. The upper surface 81 of the fitting ring 80 is arranged to be flush with an upper end surface of the flow passage forming member 60.

The large diameter portion 73 of the fitting pin 70 is fitted into the large diameter hole portion 641*a* of the axial through hole 641 of the flow passage forming member 60 from the inside of the hole 83 of the fitting ring 80 (FIGS. 22, 23, etc.). The lower end surface 72 of the fitting pin 70 is abutted with an upward level difference surface of the axial through hole 641 at a border between the large diameter hole portion 641*a* and the small diameter hole portion 641*b*.

By inserting and fixing the upper end portion of the piston guide 130 into the inner tube portion 32, the flow passage forming member 60, the fitting ring 80, and the fitting pin 70 are also inserted into the inner tube portion 32. In this state, a lower end surface of the holding member 90 is in contact with the upper surface 81 of the fitting ring 80 and the upper end surface of the flow passage forming member 60 (FIG. 22, etc.). The upper end surface 71 of the fitting pin 70 is arranged to be flush with the level difference portion 94 at the border between the pin holding hole portion 91 and the foam interflow chamber forming hole portion 92 in the holding member 90 (FIG. 22, etc.).

The flow passage forming member 60, the fitting pin 70, the fitting ring 80, and the holding member 90 are assembled to each other as described above, and housed and held in the inner tube portion 32 while being sandwiched between the piston guide 130 and the inner tube portion 32.

In the case of this embodiment, a ball valve 180 is held slightly upward/downward-movably between a valve seat portion 131 and the projection portions 63 of the flow passage forming member 60.

In the case of this embodiment, an internal space of a part of the piston guide 130 above the valve seat portion 131 forms the housing space 132 that houses the ball valve 180 and a lower end portion of the flow passage forming member 60.

In this embodiment as well, by a press-down operation on the head member 30, the liquid agent pump chamber 220 contracts. At this time, by pressurizing the liquid agent 101 in the liquid agent pump chamber 220, a liquid agent discharge valve formed by the ball valve 180 and the valve seat portion 131 is opened, and the liquid agent 101 in the liquid agent pump chamber 220 is supplied to the anterior chamber 223 of the foamer mechanism 20 via the liquid agent discharge valve.

In the case of this embodiment as well, a tubular gas flow passage 212 (FIGS. 22 and 28) formed by a gap between an inner circumferential surface of a lower end portion of the inner tube portion 32 and an outer circumferential surface of the piston guide 130 is arranged above a tubular portion 151 of a gas piston 150.

Figure 28:
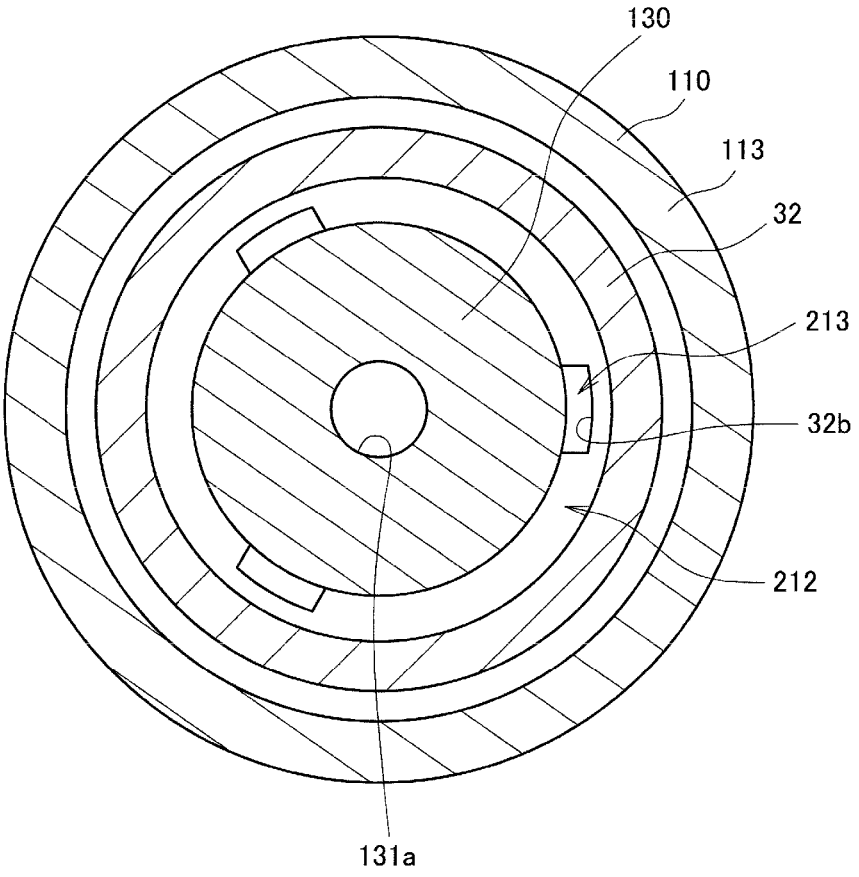
FIG. 28 is a sectional view taken along line E-E of FIGS. 3 and 22.
Figure 29:
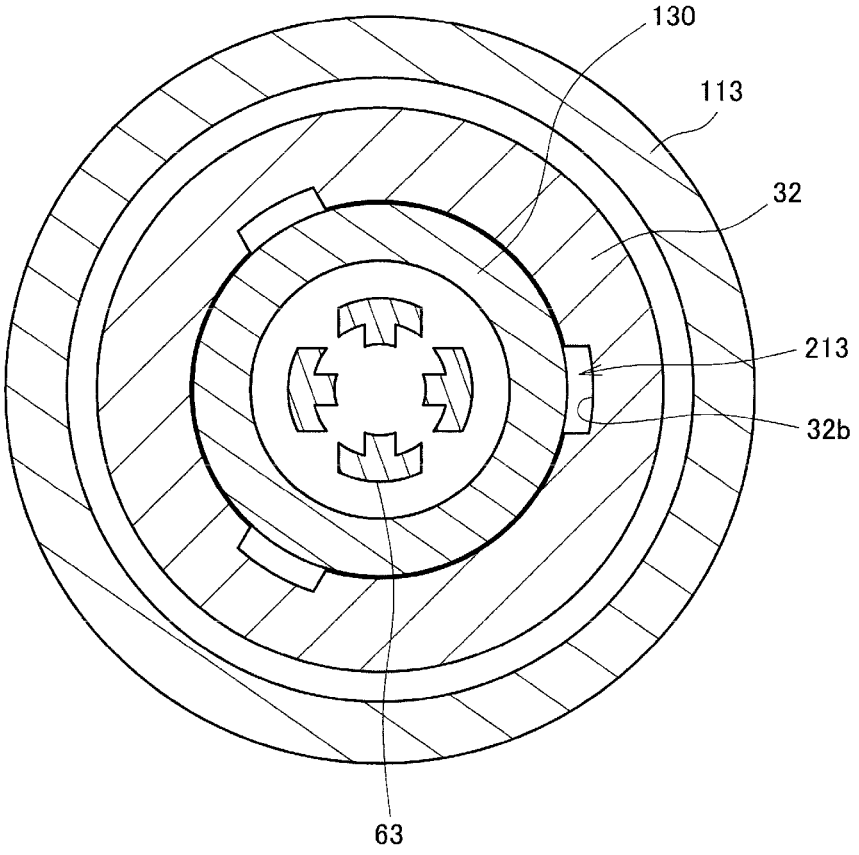
FIG. 29 is a sectional view taken along line F-F of FIG. 22.

Further, on the upper side of the tubular gas flow passage 212, plural axial flow passages 213 respectively extending in the up and down direction are intermittently formed in a periphery of the upper end portion of the piston guide 130 (FIGS. 22, 28, and 29).

The axial flow passages 213 extend to the upper side from an upper end of the piston guide 130 (for example, to a position in a periphery of the large diameter portion 62 of the flow passage forming member 60 to be described later).

Figure 30:
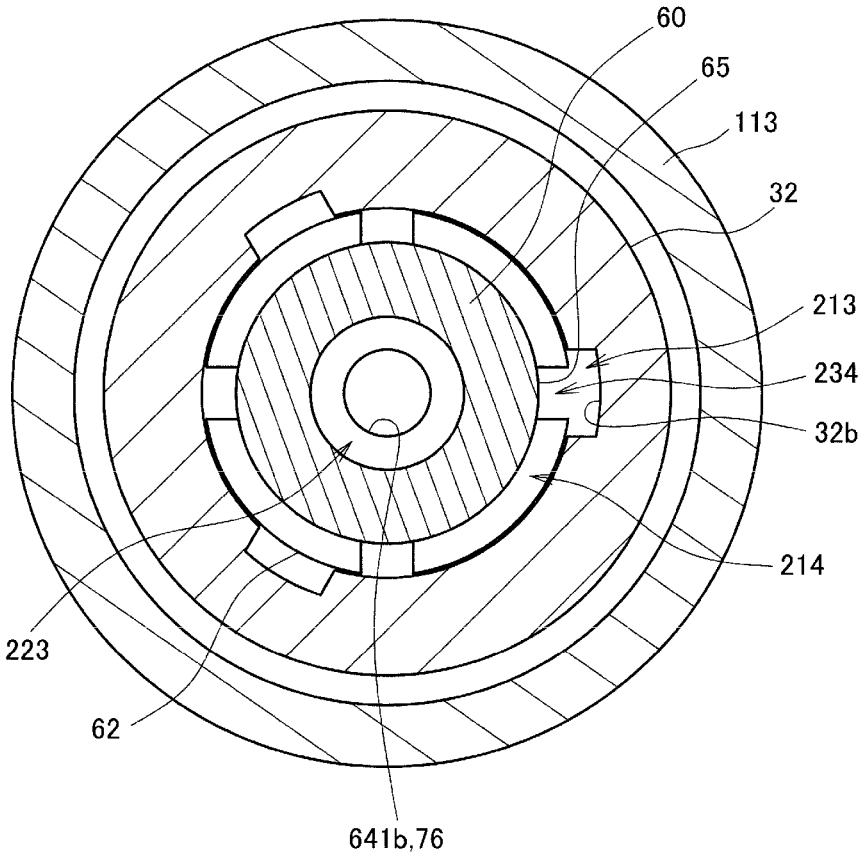
FIG. 30 is a sectional view taken along line G-G of FIG. 23.
Figure 31:
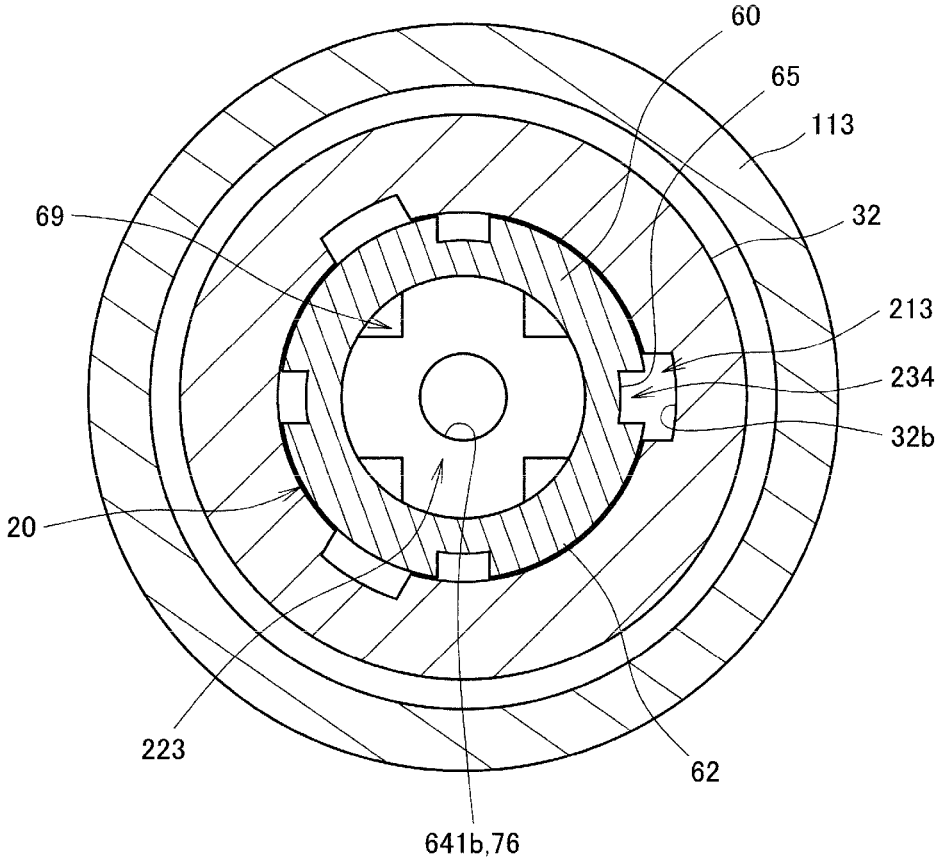
FIG. 31 is a sectional view taken along line H-H of FIG. 23.
Figure 32:
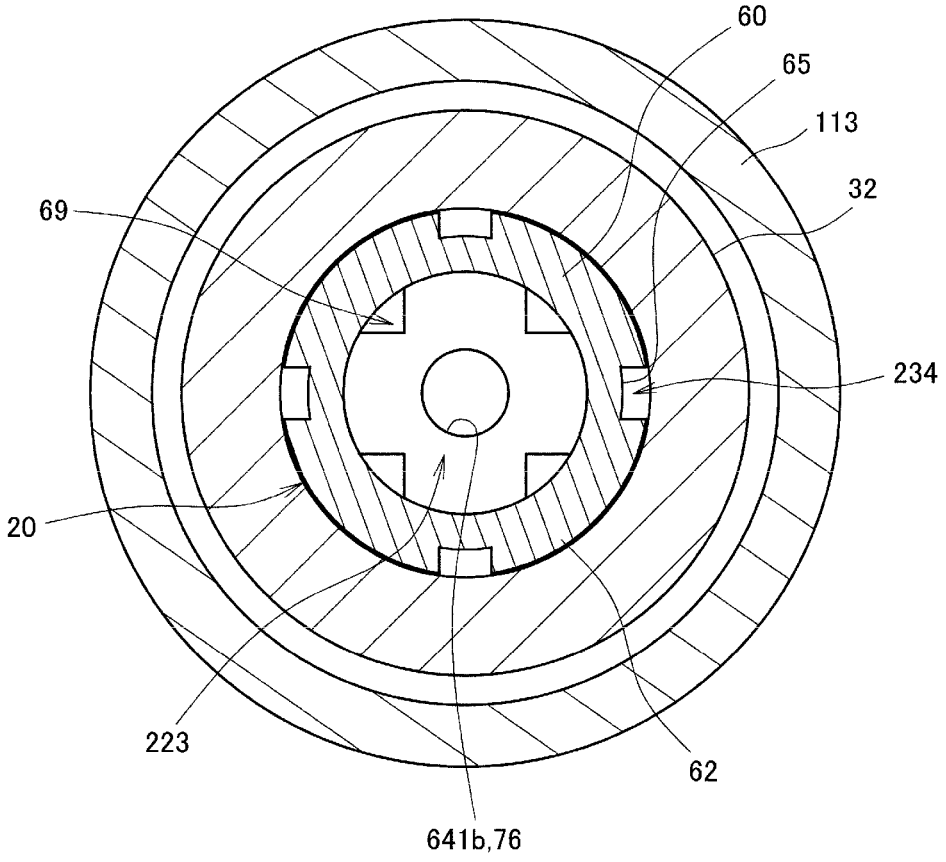
FIG. 32 is a sectional view taken along line I-I of FIG. 23.

Further, on the inner circumferential side of upper end portions of the axial flow passages 213, a circulating flow passage 214 enclosing the large diameter portion 62 of the flow passage forming member 60 in a circular manner is arranged, and the axial flow passages 213 respectively communicate with the circulating flow passage 214 (FIGS. 22, 23, and 30).

Further, on the upper side of the circulating flow passage 214, the plural axial gas flow passages 234 of the foamer mechanism 20 are arranged, and the circulating flow passage 214 communicates with each of these axial gas flow passages 234 (FIGS. 22, 23, and 30).

That is, the gas fed upward via a flow passage 211 is supplied to the axial gas flow passages 234 of the foamer mechanism 20 through the tubular gas flow passage 212, the axial gas flow passages 213, and the circulating flow passage 214 in this order.

Here, the tubular gas flow passage 212 is formed by a gap between an outer circumferential surface of the upper end portion of the piston guide 130 and the inner circumferential surface of the lower end portion of the inner tube portion 32.

On the upper side of the tubular gas flow passage 212, the axial flow passages 213 formed by gaps between the outer circumferential surface of the upper end portion of the piston guide 130 and three grooves 32*b* of the inner tube portion 32 are arranged, and the tubular gas flow passage 212 communicates with each of the axial flow passages 213.

On the upper side of these axial flow passages 213, the circulating flow passage 214 formed by a gap between an outer circumferential surface of a lower end portion of the large diameter portion 62 of the flow passage forming member 60 and an inner circumferential surface of the inner tube portion 32 is arranged, and the axial flow passages 213 respectively communicate with the circulating flow passage 214.

On the upper side of the circulating flow passage 214, the axial gas flow passages 234 formed by gaps between the four axial grooves 65 which are formed on the outer circumferential surface of the large diameter portion 62 of the flow passage forming member 60 and the inner circumferential surface of the inner tube portion 32 are arranged, and the circulating flow passage 214 communicates with each of these axial gas flow passages 234.

The axial gas flow passages 234 respectively communicate with corresponding radial gas flow passages 233. The circulating gas flow passage 232 is arranged in the center of these radial gas flow passages 233, and the radial gas flow passages 233 respectively communicate with the circulating gas flow passage 232.

This circulating gas flow passage 232 is formed by a gap enclosed by the outer circumferential surface of the small diameter portion 74 of the fitting pin 70, the inner circumferential surface of the lower portion of the large diameter hole portion 641*a* of the axial through hole 641 of the flow passage forming member 60, the level difference surface at the border between the large diameter hole portion 641*a* and the small diameter hole portion 641*b* of the axial through hole 641 of the flow passage forming member 60, and the level difference surface 75 of the fitting pin 70.

On the upper side of the circulating gas flow passage 232, the adjacent flow passages 231 formed by gaps between the six air flow passage forming grooves 78 of the fitting pin 70 and an inner circumferential surface of an upper portion of the large diameter hole portion 641*a* are arranged. The circulating gas flow passage 232 communicates with each of the adjacent flow passages 231.

On the upper side of each of the adjacent flow passages 231, the gas-liquid contact chambers 21 formed by internal spaces of the through holes 77 of the fitting pin 70 are arranged. The adjacent flow passages 231 respectively communicate with the gas-liquid contact chambers 21 at the gas openings 23*a*.

On the upper side of each of the gas-liquid contact chambers 21, the foam flow passages 24 formed by gaps between the foam flow passage forming grooves 79 of the fitting pin 70 and an inner circumferential surface of the hole 83 of the fitting ring 80 are arranged. The gas-liquid contact chambers 21 respectively communicate with the foam flow passages 24.

The hollow portion 67 of the flow passage forming member 60 forms the anterior chamber 223 of the liquid agent flow passage 22. The housing space 132 in the upper end portion of the piston guide 130 communicates with the anterior chamber 223.

The first branch flow passage 221 of the liquid agent flow passage 22 is formed by the internal space of the recessed portion 76 of the fitting pin 70 and an internal space of the small diameter hole portion 641*b* of the axial through hole 641 of the flow passage forming member 60. An inner diameter of the recessed portion 76 is set to be equal to an inner diameter of the small diameter hole portion 641*b*, and the recessed portion 76 and the small diameter hole portion 641*b* are arranged on the same axis. Thereby, the first branch flow passage 221 is formed to have a constant diameter throughout the axial direction.

An upper end of the anterior chamber 223 communicates with a lower end of the first branch flow passage 221.

The downstream side end portion 221*a* of the first branch flow passage 221 communicates with each of the gas-liquid contact chambers 21 at the liquid agent openings 22*a* formed by ends of the through holes 77.

Meanwhile, the branch portions 222*b* of the second branch flow passage 222 are respectively formed by the four peripheral edge through holes 69 formed in the floor slab portion 64 of the flow passage forming member 60 (FIG. 26, etc.).

On the upper side of these branch portions 222*b*, the circulating liquid agent flow passage 222*a* formed by a gap which is enclosed by an upper surface of the floor slab portion 64 of the flow passage forming member 60, the lower surface 82 of the fitting ring 80, an inner circumferential surface of a lower end portion of the recessed portion 68, and the outer circumferential surface of the large diameter portion 73 of the fitting pin 70 is arranged. The branch portions 222*b* respectively communicate with the circulating liquid agent flow passage 222*a*.

The through holes 77 of the fitting pin 70 are arranged at the same height positions as the circulating liquid agent flow passage 222*a*.

The circulating liquid agent flow passage 222*a* communicates with each of the gas-liquid contact chambers 21 at the liquid agent openings 22*b* formed by the other ends of the through holes 77 of the fitting pin 70.

The foam dispensing container 100 is formed as above.

In the case of this embodiment, the foam dispensing cap 200 is also formed by parts of the foam dispensing container 100 excluding a container main body 10.

Next, actions will be described.

In the case of this embodiment as well, in order to discharge the foam body from the foam dispensing container 100, the press-down operation is performed on an operation receiving portion 31 of the head member 30.

Thereby, by reducing the gas pump chamber 210, the gas in the gas pump chamber 210 is supplied (pressure-fed) to the foamer mechanism 20, and by reducing the liquid agent pump chamber 220, the liquid agent in the liquid agent pump chamber 220 is supplied (pressure-fed) to the foamer mechanism 20.

That is, the liquid agent 101 flows into the anterior chamber 223 of the liquid agent flow passage 22 from the liquid agent pump chamber 220 via the liquid agent discharge valve and the housing space 132.

Further, the liquid agent 101 branches and flows into the first branch flow passage 221 (FIG. 26) and the four branch portions 222*b* (FIG. 26) from the anterior chamber 223. That is, part of the liquid agent 101 flowing into the anterior chamber 223 is distributed and supplied to the six gas-liquid contact chambers 21 from the downstream side end portion 221*a* of the first branch flow passage 221 via the six liquid agent openings 22*a*. The remaining part of the liquid agent 101 flowing into the anterior chamber 223 flows into the circulating liquid agent flow passage 222*a* (FIG. 26) via the four branch portions 222*b* and thereby interflows at once, and then is distributed and supplied to the six gas-liquid contact chambers 21 via the six liquid agent openings 22*b*.

Meanwhile, the gas in the gas pump chamber 210 flows into the four axial gas flow passages 234 (FIGS. 22, 31, 32, and 39) of the liquid agent flow passage 22 via a gas discharge valve, the flow passage 211 (FIG. 27), the tubular gas flow passage 212 (FIGS. 22, 28, and 39), the three axial flow passages 213 (FIGS. 22, 29, and 39), and the circulating flow passage 214 (FIGS. 22, 30, and 39) in this order.

The gas flowing into the four axial gas flow passages 234 further flows into the circulating gas flow passage 232 (FIGS. 22, 33A, 33B, 34, and 39) via the four radial gas flow passages 233 (FIGS. 22, 33A, 33B, 34, and 39) and thereby interflows at once, and then is distributed and supplied to the six gas-liquid contact chambers 21 via the six adjacent flow passages 231 (FIGS. 24, 35, and 39) and the six gas openings 23*a*.

Here, as shown in FIGS. 25 and 36B, the liquid agent opening 22*a* and the liquid agent opening 22*b* are arranged at the positions on the both sides sandwiching the extension region 26 of the adjacent flow passage 231 which is the part of the gas flow passage 23 adjacent to the gas opening 23*a*. The liquid agent opening 22*a* and the liquid agent opening 22*b* are respectively directed to the region 26. Thereby, it is possible to favorably mix the liquid agent 101 and the gas.

Therefore, in this embodiment as well, a uniform foam body is more easily produced. For example, even when the liquid agent 101 is relatively highly viscous, it is possible to realize favorable mixing of the liquid agent 101 and the gas.

In the case of this embodiment as well, since the liquid agent opening 22*a* of the first branch flow passage 221 and the liquid agent opening 22*b* of the second branch flow passage 222 oppose each other across the gas-liquid contact chamber 21, the liquid agent 101 is more favorably supplied to the region 26. Thereby, it is possible to more reliably mix the liquid agent 101 and the gas in the region 26.

The plural gas-liquid contact chambers 21 are intermittently arranged in the periphery of the downstream side end portion 221*a* of the first branch flow passage 221. Thus, it is possible to mix the liquid agent 101 and the gas individually in the plural gas-liquid contact chambers 21. Therefore, it is possible to finely and uniformly mix the liquid agent 101 and the gas and to avoid crude mixing of the liquid agent 101 and the gas.

In more detail, the gas-liquid contact chambers 21 are sandwiched between the first branch flow passage 221 (downstream side end portion 221*a*) positioned at the inner side of the inside in the radial direction of the first branch flow passage 221 and the circulating liquid agent flow passage 222*a* positioned at the outer side. The liquid agent 101 is supplied to the gas-liquid contact chambers 21 from both the inside and the outside.

The gas flow passage 23 includes the circulating gas flow passage 232 enclosing the first branch flow passage 221 in a circular manner. The circulating gas flow passage 232 communicates with each of the plural gas-liquid contact chambers 21 via each of the plural adjacent flow passages 231. Thereby, it is possible to preferably realize a configuration capable of evenly distributing and supplying the gas to the plural gas-liquid contact chambers 21.

Rough foam produced by mixing the liquid agent 101 and the gas in the gas-liquid contact chambers 21 flows into the six foam flow passages 24 (FIGS. 24, 25, and 38) above the gas-liquid contact chambers 21 and flows into the foam interflow chamber 27 at the subsequent stage via the foam flow passages 24.

In this embodiment as well, the foam flow passages 24 are arranged at the extension positions of the adjacent flow passages 231 across the gas-liquid contact chambers 21, and extend in the extension direction of the adjacent flow passages 231.

Thereby, it is possible to allow rough foam produced in the gas-liquid contact chambers 21 to smoothly flow into the foam flow passages 24. Furthermore, it is also possible to allow the gas to smoothly flow from the adjacent flow passages 231 into the gas-liquid contact chambers 21. Thus, it is possible to produce foam at a high airflow rate to the extent possible in the gas-liquid contact chambers 21, and to enhance a ratio of mixing the liquid agent 101 and the gas in the gas-liquid contact chambers 21.

The rough foam flowing into the foam interflow chamber 27 from the six foam flow passages 24 interflows in the foam interflow chamber 27 and passes through the two-step meshes 51, and thereby becomes a fine uniform foam body, and is discharged from the discharge port 41 via the nozzle portion 40.

The present invention is not limited to the embodiments and the modified example described above but includes variously modified and improved modes as long as the object of the present invention is achieved.

In the above second embodiment, the example where the recessed portion 341 is formed in the projection portion 340 in order to ensure sufficient volume of the gas-liquid contact chamber 21 is described. However, a recessed portion may be formed in a part of the inner circumferential surface of the tube portion 410, the part opposing the recessed portion 341. In this case, the recessed portion 341 is not necessarily formed.

In the above embodiments, the example where the liquid agent openings 22*a*, 22*b* of the plural branch flow passages (the first branch flow passage 221 and the second branch flow passage 222) oppose each other across the gas-liquid contact chamber 21 is described. However, the liquid agent openings 22*a*, 22*b* do not necessarily oppose each other.

Modified Example 1

Figure 46B:
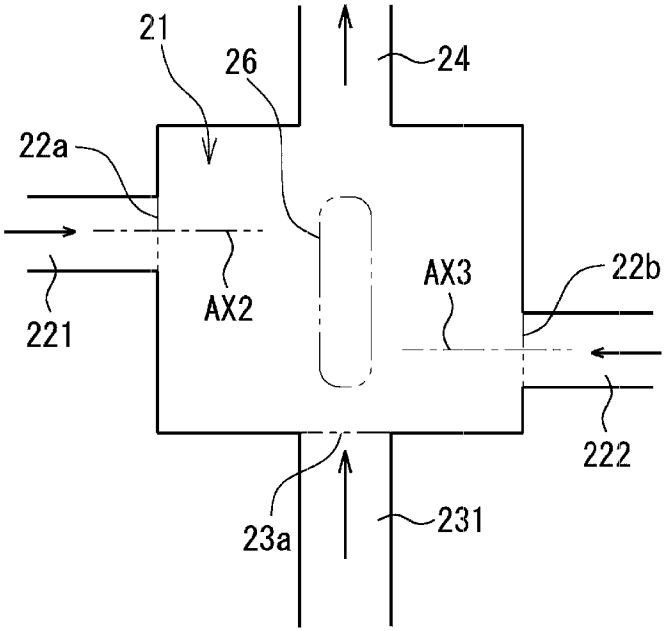
FIG. 46B is a schematic view for illustrating a foam dispensing container according to Modified Example 3.
Figure 46A:
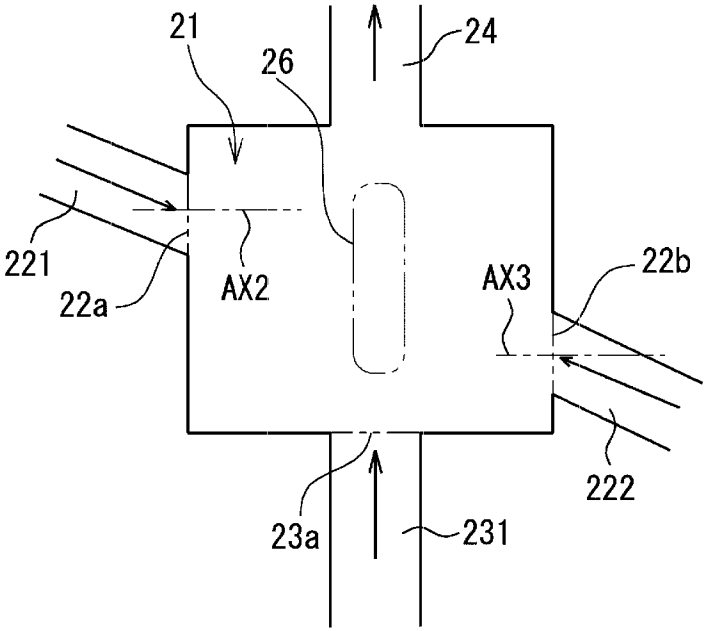
FIG. 46A is a schematic view for illustrating a foam dispensing container according to Modified Example 2.
Figure 47:
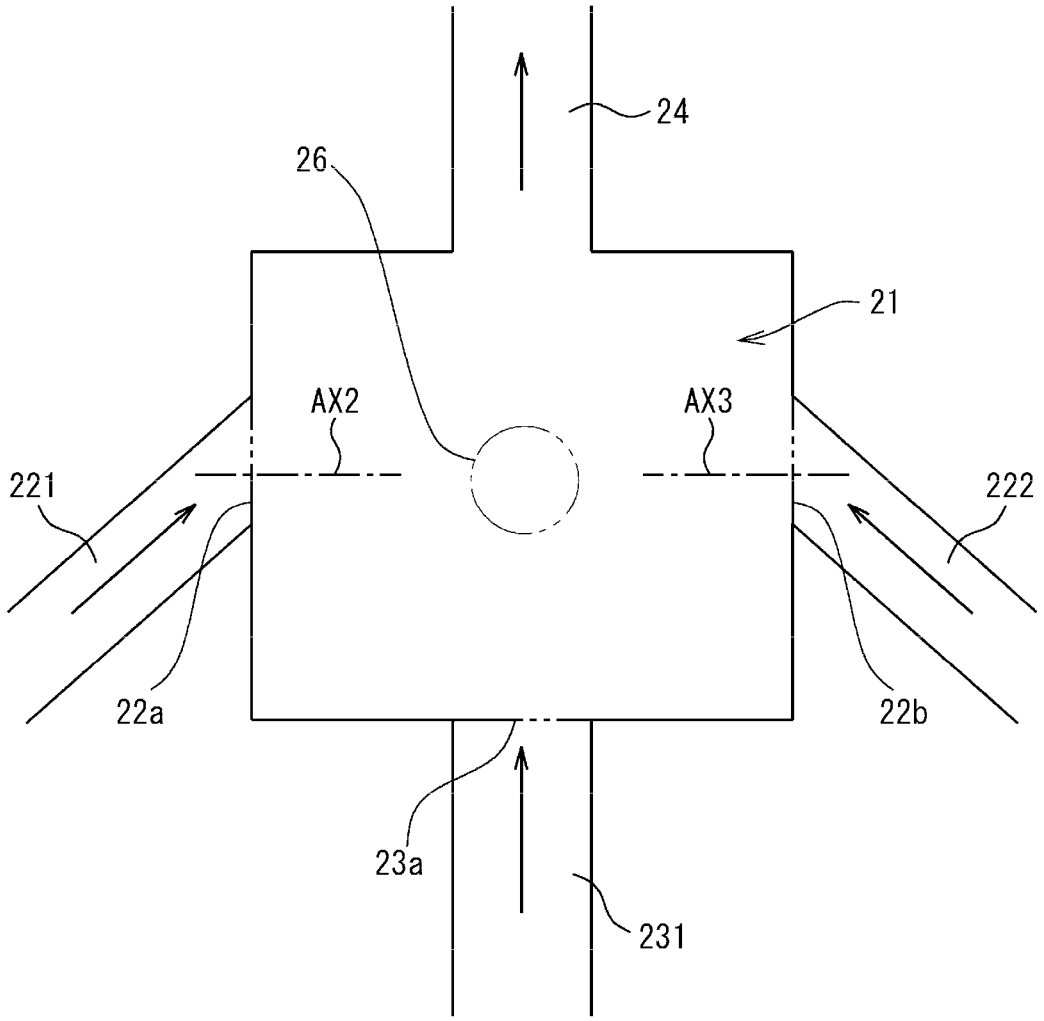
FIG. 47 is a schematic view for illustrating a foam dispensing container according to Modified Example 4.

For example, as in Modified Example 1 shown in FIG. 45, Modified Example 2 shown in FIG. 46A, Modified Example 3 shown in FIG. 46B, and Modified Example 4 shown in FIG. 47, the liquid agent opening 22*a* of the first branch flow passage 221 and the liquid agent opening 22*b* of the second branch flow passage 222 may be respectively directed to the region 26, and the liquid agent opening 22*a* and the liquid agent opening 22*b* may be set in a non-opposing positional relationship.

In Modified Example 1 shown in FIG. 45, the direction toward the region 26 in the gas-liquid contact chamber 21 among the direction of the axis AX2 of the liquid agent opening 22*a*, and the direction toward the region 26 in the gas-liquid contact chamber 21 among the direction of the axis AX3 of the liquid agent opening 22*b* respectively include a component of the direction toward the region 26 in the gas-liquid contact chamber 21 among the direction of the axis AX1 of the adjacent flow passage 231.

The direction in which the liquid agent flows via the first branch flow passage 221, that is, the direction toward the region 26 in the gas-liquid contact chamber 21 among the axis direction of a part of the first branch flow passage 221 adjacent to the liquid agent opening 22*a* includes a component of the direction in which the gas flows via the adjacent flow passage 231, that is, the direction toward the region 26 in the gas-liquid contact chamber 21 among the direction of the axis AX1 of the adjacent flow passage 231.

The direction in which the liquid agent flows via the second branch flow passage 222, that is, the direction toward the region 26 in the gas-liquid contact chamber 21 among the axis direction of a part of the second branch flow passage 222 adjacent to the liquid agent opening 22*b* also includes a component of the direction in which the gas flows via the adjacent flow passage 231.

Modified Example 2

In Modified Example 2 shown in FIG. 46A, the direction toward the region 26 in the gas-liquid contact chamber 21 among the direction of the axis AX2 of the liquid agent opening 22*a*, and the direction toward the region 26 in the gas-liquid contact chamber 21 among the direction of the axis AX3 of the liquid agent opening 22*b* both include no component of the direction toward the region 26 in the gas-liquid contact chamber 21 among the direction of the axis AX1 of the adjacent flow passage 231. In more detail, the axis AX2 of the liquid agent opening 22*a* and the axis AX3 of the liquid agent opening 22*b* are respectively orthogonal to the axis AX1 of the adjacent flow passage 231.

The direction in which the liquid agent flows via the first branch flow passage 221 includes no component of the direction in which the gas flows via the adjacent flow passage 231. In more detail, the direction in which the liquid agent flows via the first branch flow passage 221 includes a component of the direction opposite to the direction in which the gas flows via the adjacent flow passage 231. The direction in which the liquid agent flows via the second branch flow passage 222 includes a component of the direction in which the gas flows via the adjacent flow passage 231.

The liquid agent opening 22*a* and the liquid agent opening 22*b* are respectively arranged in wall portions positioned between a pair of wall portions opposing each other in the direction of the axis A1 of the adjacent flow passage 231 among wall portions forming the gas-liquid contact chamber 21.

Modified Example 3

In Modified Example 3 shown in FIG. 46B, the direction toward the region 26 in the gas-liquid contact chamber 21 among the direction of the axis AX2 of the liquid agent opening 22*a*, and the direction toward the region 26 in the gas-liquid contact chamber 21 among the direction of the axis AX3 of the liquid agent opening 22*b* both include no component of the direction toward the region 26 in the gas-liquid contact chamber 21 among the direction of the axis AX1 of the adjacent flow passage 231. In more detail, for example, the axis AX2 of the liquid agent opening 22*a* and the axis AX3 of the liquid agent opening 22*b* are respectively orthogonal to the axis AX1 of the adjacent flow passage 231.

The direction in which the liquid agent flows via the first branch flow passage 221 and the direction in which the liquid agent flows via the second branch flow passage 222 both include no component of the direction in which the gas flows via the adjacent flow passage 231. In more detail, the direction in which the liquid agent flows via the first branch flow passage 221 and the direction in which the liquid agent flows via the second branch flow passage 222 are respectively orthogonal to the direction in which the gas flows via the adjacent flow passage 231.

The liquid agent opening 22*a* and the liquid agent opening 22*b* are respectively arranged in wall portions positioned between a pair of wall portions opposing each other in the direction of the axis A1 of the adjacent flow passage 231 among wall portions forming the gas-liquid contact chamber 21.

Modified Example 4

In Modified Example 4 shown in FIG. 47, the direction toward the region 26 in the gas-liquid contact chamber 21 among the direction of the axis AX2 of the liquid agent opening 22*a*, and the direction toward the region 26 in the gas-liquid contact chamber 21 among the direction of the axis AX3 of the liquid agent opening 22*b* both include no component of the direction toward the region 26 in the gas-liquid contact chamber 21 among the direction of the axis AX1 of the adjacent flow passage 231. In more detail, for example, the axis AX2 of the liquid agent opening 22*a* and the axis AX3 of the liquid agent opening 22*b* are respectively orthogonal to the axis AX1 of the adjacent flow passage 231.

The direction in which the liquid agent flows via the first branch flow passage 221 and the direction in which the liquid agent flows via the second branch flow passage 222 respectively include a component of the direction in which the gas flows via the adjacent flow passage 231.

The liquid agent opening 22*a* and the liquid agent opening 22*b* are respectively arranged in wall portions positioned between a pair of wall portions opposing each other in the direction of the axis A1 of the adjacent flow passage 231 among wall portions forming the gas-liquid contact chamber 21.

Modified Example 5

Figure 48:
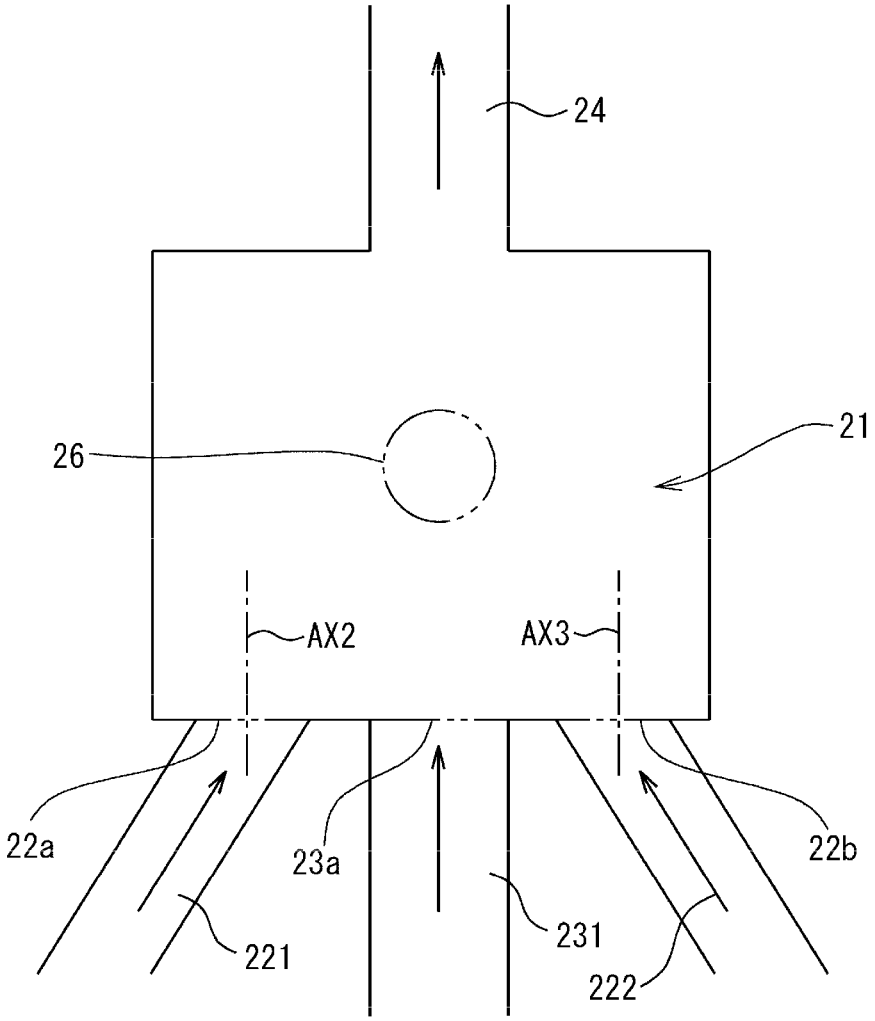
FIG. 48 is a schematic view for illustrating a foam dispensing container according to Modified Example 5.

For example, as in Modified Example 5 shown in FIG. 48, both the liquid agent openings 22*a*, 22*b* do not have to be directed to the region 26. In this modified example, the liquid agent opening 22*a* and the liquid agent opening 22*b* are set in a non-opposing positional relationship.

In more detail, in the case of Modified Example 5, the liquid agent obliquely flows into the gas-liquid contact chamber 21 via the branch flow passages (the first branch flow passage 221 and the second branch flow passage 222).

In this modified example, the direction toward the region 26 in the gas-liquid contact chamber 21 among the direction of the axis AX2 of the liquid agent opening 22*a*, and the direction toward the region 26 in the gas-liquid contact chamber 21 among the direction of the axis AX3 of the liquid agent opening 22*b* respectively include a component of the direction toward the region 26 in the gas-liquid contact chamber 21 among the direction of the axis AX1 of the adjacent flow passage 231. In more detail, for example, the axis AX2 of the liquid agent opening 22*a* and the axis AX3 of the liquid agent opening 22*b* are respectively arranged in parallel to the axis AX1 of the adjacent flow passage 231.

The direction in which the liquid agent flows via the first branch flow passage 221 and the direction in which the liquid agent flows via the second branch flow passage 222 respectively include a component of the direction in which the gas flows via the adjacent flow passage 231.

The liquid agent opening 22*a* and the liquid agent opening 22*b* are respectively arranged in a wall portion where the gas opening 23*a* is arranged among a pair of wall portions opposing each other in the direction of the axis A1 of the adjacent flow passage 231 in wall portions forming the gas-liquid contact chamber 21.

Modified Example 6

Next, Modified Example 6 will be described with reference to FIGS. 49 to 53.

A foam dispensing container and a foam dispensing cap according to this modified example are different from the foam dispensing container 100 and the foam dispensing cap 200 according to the second embodiment described above in terms of the points described below but are formed similarly to the foam dispensing container 100 and the foam dispensing cap 200 according to the second embodiment described above in the other points.

In the case of this modified example, as shown in FIG. 53, the liquid agent openings 22*a*, 22*b* are respectively directed to the region 26, and the liquid agent openings 22*a*, 22*b* oppose each other.

The width of the foam flow passage 24 is smaller than the width of the adjacent flow passage 231. When seen in the axis AX1 of the adjacent flow passage 231, the adjacent flow passage 231 contains the foam flow passage 24.

For example, the width of the foam flow passage 24 is greater than the width of each of the branch flow passages (the first branch flow passage 221 and the second branch flow passage 222).

In the case of this modified example, the first member 300 is formed as described below.

Figure 49:
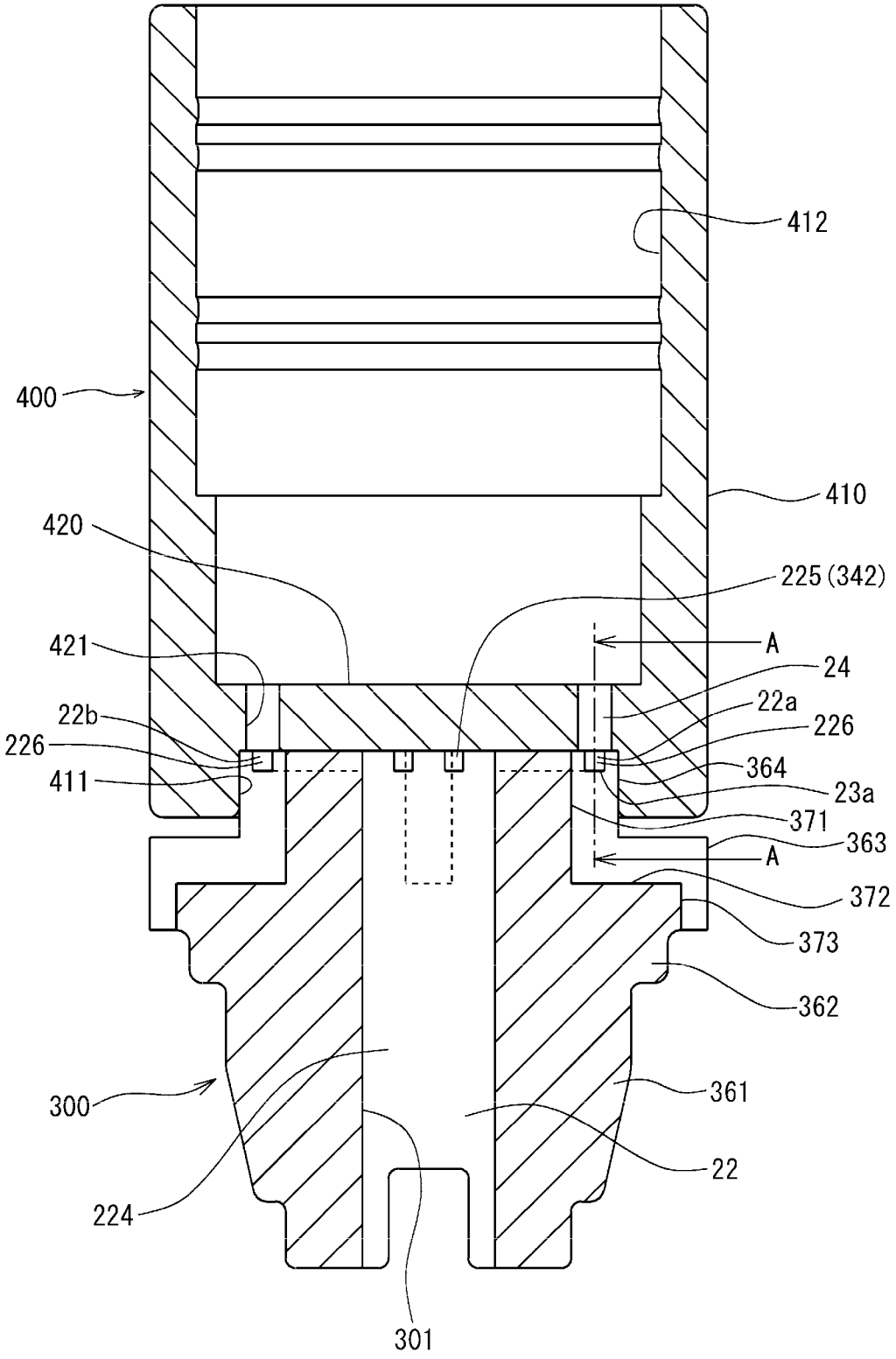
FIG. 49 is a vertically sectional view showing a state where a first member and a second member provided in a foam dispensing cap according to Modified Example 6 are assembled to each other.
Figure 51:
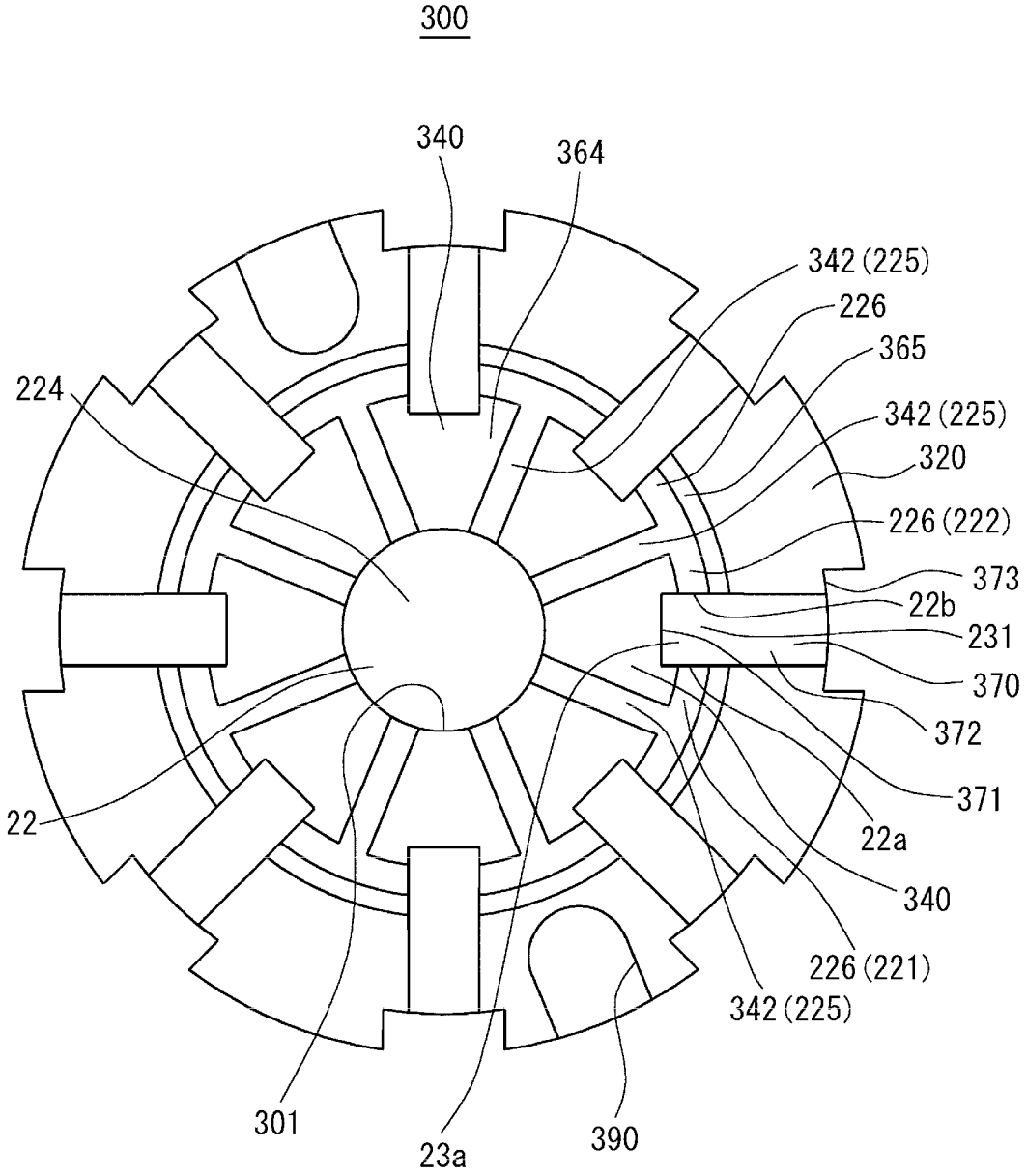
FIG. 51 is a top view of the first member provided in the foam dispensing cap according to Modified Example 6.

As shown in FIG. 49 or 51, the first member 300 includes a cylindrical first tube portion 361, a disc plate-shaped first disc-shaped portion 362 continuously connected to an upper side of the first tube portion 361, a disc plate-shaped second disc-shaped portion 363 continuously connected to an upper side of the first disc-shaped portion 362, and a cylindrical second tube portion 364 continuously connected to an upper side of the second disc-shaped portion 363.

In the case of this embodiment as well, the first member 300 has the hole 301 passing through the first member 300 from the lower end to the upper end.

An outer diameter of the first tube portion 361 is the largest at an upper end portion of the first tube portion 361. A lower end portion of the first tube portion 361 is divided into plural portions (for example, four) in the circumferential direction similarly to the lower end portion of the flow passage forming member 60 of the third embodiment having the plural projection portions 63.

An outer diameter of the first disc-shaped portion 362 is larger than the outer diameter of the upper end portion of the first tube portion 361.

An outer diameter of the second disc-shaped portion 363 is larger than the outer diameter of the first disc-shaped portion 362.

An outer diameter of the second tube portion 364 is smaller than the outer diameter of the second disc-shaped portion 363.

As shown in FIG. 51, eight grooves are formed in a radial manner on an upper surface of the second tube portion 364, and spaces in the grooves serve as gaps 342 similarly to the second embodiment.

Further, a ring-shaped groove is formed along a peripheral edge of the upper surface of the second tube portion 364. Radially outer side end portions of the eight radial grooves described above reach the ring-shaped groove.

In the case of this embodiment as well, the first member 300 includes, for example, eight projection portions 340, and these projection portions 340 are arranged side by side in a circumferential direction. Each of the gaps 342 exists between the adjacent projection portions 340 among these projection portions 340. The gap 342 forms the first part 225 of the first branch flow passage 221 and the second branch flow passage 222.

A ring-shaped wall portion 365 is formed around the outermost circumferential portion of an upper end portion of the second tube portion 364, that is, in a periphery of a region where the eight projection portions 340 are arranged. An upper surface of the wall portion 365 forms part of the upper surface of the second tube portion 364. The projection portions 340 are separated from the wall portion 365 via a ring-shaped groove.

Further, for example, eight grooves 370 are formed on a side surface of an upper portion of the first member 300. In a plan view, the direction of each of the grooves 370 with respect to the center of the first member 300 is the direction between the gaps 342 adjacent to each other.

The groove 370 includes a first part 371, a second part 372, and a third part 373 to be described later, respectively.

The first part 371 is placed along an outer circumferential surface of the second tube portion 364 and suspended down from the upper surface from the second tube portion 364 to a position below an upper surface of the second disc-shaped portion 363.

The second part 372 extends outward in the radial direction of the first member 300 along the upper surface of the second disc-shaped portion 363 from the lower end of the first part 371, and reaches an outer circumferential surface of the second disc-shaped portion 363.

The third part 373 is suspended down from a leading end (radially outer side end portion) of the second part 372 along the outer circumferential surface of the second disc-shaped portion 363, and reaches a level difference portion at a border between the second disc-shaped portion 363 and the first disc-shaped portion 362.

By upper end portions of the first parts 371 of the grooves 370, the above ring-shaped groove is divided and the ring-shaped wall portion 365 is also divided. Thereby, a gap between each of the projection portions 340 and the wall portion 365 forms the second part 226 of the first branch flow passage 221 and the second branch flow passage 222.

The grooves 370 form the gas flow passage 23. The first parts 371 of the grooves 370 form the adjacent flow passages 231.

Plural (for example, two) positioning recessed portions 390 are formed on the upper surface of the second disc-shaped portion 363 of the first member 300.

Figure 52:
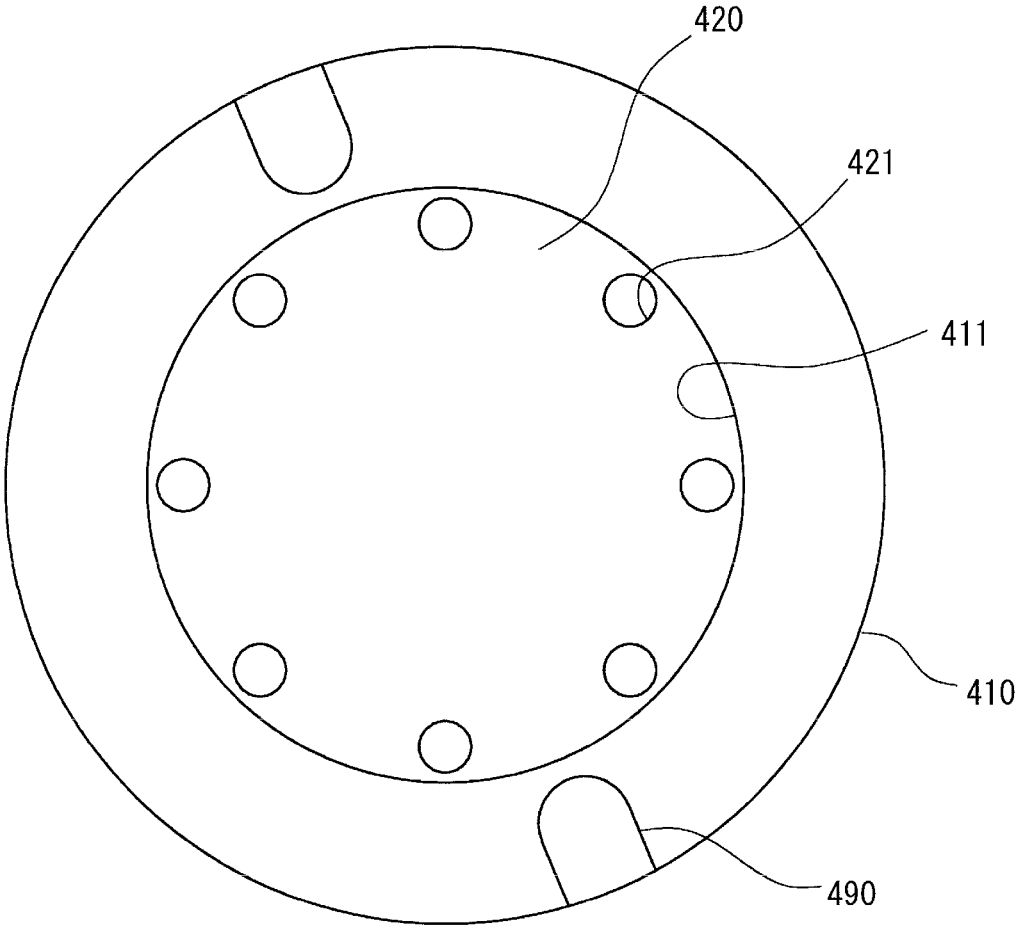
FIG. 52 is a bottom view of the second member provided in the foam dispensing cap according to Modified Example 6.

As shown in FIG. 52, plural (for example, two) positioning projections 490 to be fitted to the positioning recessed portions 390 of the first member 300 are formed on a lower surface of the tube portion 410 of the second member 400.

The planar shape of the holes 421 forming the foam flow passages 24 is, for example, a circular shape.

The other configurations of the second member 400 are similar to the second embodiment.

As shown in FIG. 49, by fitting the second tube portion 364 of the first member 300 into the recessed portion 411 of the second member 400 and fitting the positioning projections 490 of the second member 400 into the positioning recessed portions 390 of the first member 300, the first member 300 and the second member 400 are assembled to each other.

Figure 50:
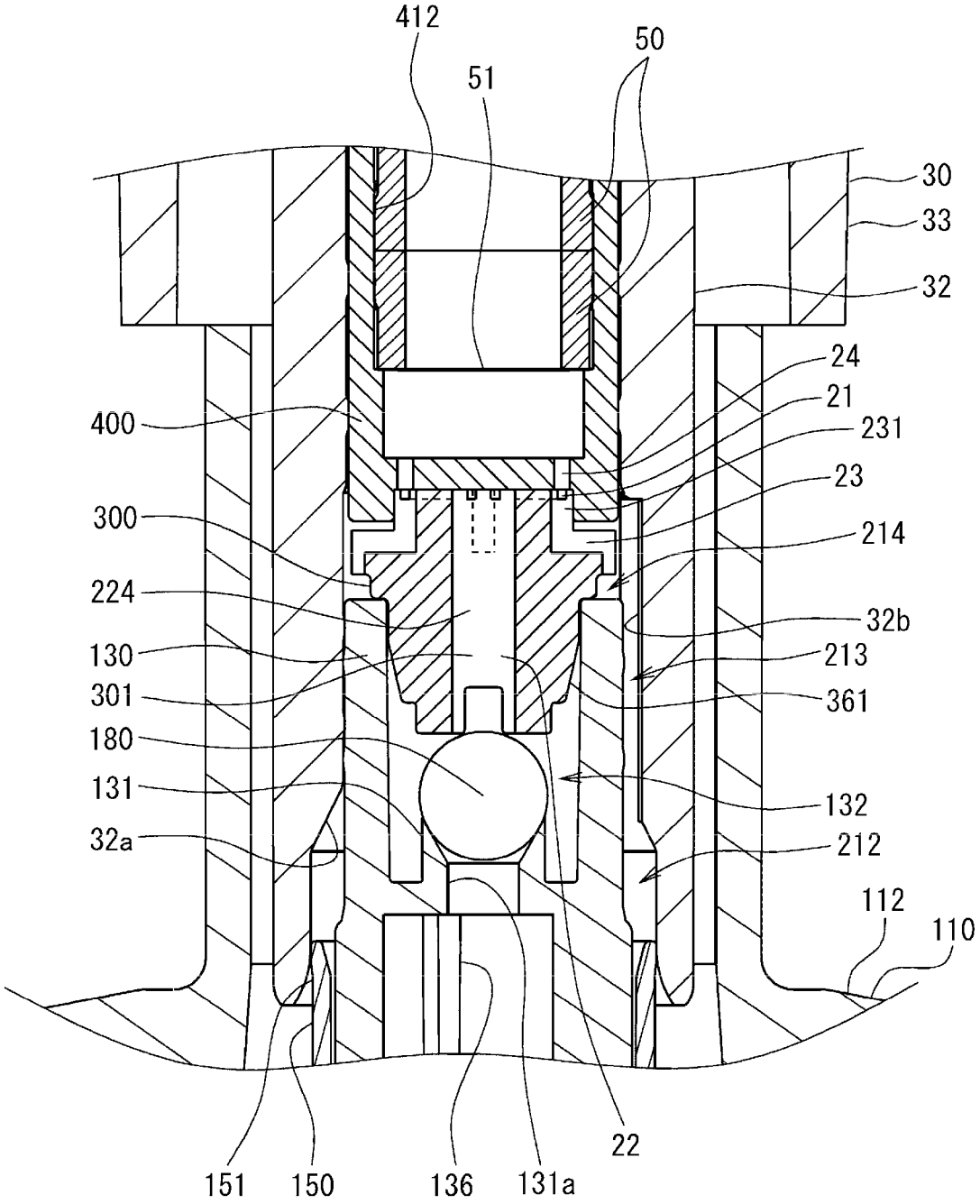
FIG. 50 is a vertically sectional view of part of the foam dispensing cap according to Modified Example 6, showing a section at a similar position to FIG. 22.

A diameter of an outer circumferential surface of the tube portion 310 of the first member 300 is extended upward. As shown in FIG. 50, an upper portion of the tube portion 310 is fitted into the upper end portion of the piston guide 130.

The first member 300 and the second member 400 are housed inside the inner tube portion 32.

Modified Examples 7, 8

In the cases of Modified Example 7 shown in FIG. 54B and Modified Example 8 shown in FIG. 55, the liquid agent openings 22*a*, 22*b* are respectively directed to the region 26, and the liquid agent openings 22*a*, 22*b* oppose each other.

In the case of Modified Example 7, the width of the foam flow passage 24 is greater than the width of the adjacent flow passage 231. When seen in the axis AX1 of the adjacent flow passage 231, the foam flow passage 24 contains the adjacent flow passage 231.

In the case of Modified Example 7, the width of each of the branch flow passages (the first branch flow passage 221 and the second branch flow passage 222) is greater than the width of the foam flow passage 24.

In the case of Modified Example 8, the width of the adjacent flow passage 231 is the same as the width of the foam flow passage 24. When seen in the axis AX1 of the adjacent flow passage 231, a position of the foam flow passage 24 matches with a position of the adjacent flow passage 231.

In the case of Modified Example 8, no wall surfaces defining the gas-liquid contact chamber 21 exist.

In the embodiments and the modified examples described above, the constituent elements of the foam dispensing container 100 and the foam dispensing cap 200 are not necessarily independent of each other. Plural constituent elements may be formed as a single member, a single constituent element may be formed by plural members, a certain constituent element may serve as part of another constituent element, or part of a certain constituent element may also be part of another constituent element.

The above embodiments include the following technical concepts.

<1> A foam dispensing container, including a foamer mechanism that foams a liquid agent and produces a foam body, a liquid agent supply portion that supplies the liquid agent to the foamer mechanism, a gas supply portion that supplies a gas to the foamer mechanism, and a discharge port that discharges the foam body produced by the foamer mechanism, wherein the foamer mechanism has a gas-liquid contact chamber in which the liquid agent supplied from the liquid agent supply portion meets the gas supplied from the gas supply portion, a liquid agent flow passage through which the liquid agent supplied from the liquid agent supply portion to the gas-liquid contact chamber passes, and a gas flow passage through which the gas supplied from the gas supply portion to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, and the liquid agent openings are respectively arranged at positions on the both sides sandwiching an extension region of an adjacent flow passage which is a part of the gas flow passage adjacent to the gas opening.

<2> The foam dispensing container according to <1>, wherein each of the liquid agent openings arranged at the positions on the both sides sandwiching the extension region of the adjacent flow passage is directed to the region.

<3> The foam dispensing container according to <1> or <2>, wherein the liquid agent openings of the plural branch flow passages oppose each other across the gas-liquid contact chamber.

<4> The foam dispensing container according to any one of <1> to <3>, wherein the liquid agent flow passage includes an adjacent liquid agent flow passage which is apart adjacent to the upstream sides of the plural branch flow passages, the plural gas-liquid contact chambers are arranged in a periphery of a downstream side end portion of the adjacent liquid agent flow passage, and the plural branch flow passages extend toward the periphery from the downstream side end portion of the adjacent liquid agent flow passage in the in-plane direction crossing the adjacent liquid agent flow passage.

<5> The foam dispensing container according to <4>, wherein corresponding to each of the plural gas-liquid contact chambers, the pair of branch flow passages and the pair of liquid agent openings in one-to-one correspondence with each of the pair of branch flow passages are arranged, and each of the pair of branch flow passages includes: a first part extending in a radial manner from the downstream side end portion of the adjacent liquid agent flow passage in the in-plane direction crossing the adjacent liquid agent flow passage; and a second part extending in the in-plane direction which is the direction crossing the first part.

<6> The foam dispensing container according to <5>, wherein one of the pair of the branch flow passages corresponding to one gas-liquid contact chamber shares the first part with one of the branch flow passages of a gas-liquid contact chamber adjacent to one side of the gas-liquid contact chamber, and the other branch flow passage shares the first part with one of the branch flow passages of a gas-liquid contact chamber adjacent to the other side of the gas-liquid contact chamber.

<7> The foam dispensing container according to any one of <4> to <6>, wherein the adjacent flow passage extends in parallel to the adjacent liquid agent flow passage.

<8> The foam dispensing container according to <3>, wherein the plural branch flow passages include a first branch flow passage and a second branch flow passage, the plural gas-liquid contact chambers are arranged in a periphery of a downstream side end portion of the first branch flow passage, and the downstream side end portion of the first branch flow passage has the plural liquid agent openings corresponding to each of the plural gas-liquid contact chambers, the second branch flow passage includes a circulating liquid agent flow passage enclosing the downstream side end portion of the first branch flow passage in a circular manner while sandwiching the plural gas-liquid contact chambers in between, the circulating liquid agent flow passage has the plural liquid agent openings corresponding to each of the plural gas-liquid contact chambers, each of the liquid agent openings of the circulating liquid agent flow passage opposes the corresponding liquid agent opening among the plural liquid agent openings of the first branch flow passage via the corresponding gas-liquid contact chamber, the gas flow passage branches into the plural adjacent flow passages respectively corresponding to the plural gas-liquid contact chambers, and each of the plural adjacent flow passages has the gas opening that is open to the corresponding gas-liquid contact chamber.

<9> The foam dispensing container according to <8>, wherein the gas flow passage includes a circulating gas flow passage enclosing the first branch flow passage in a circular manner, and the circulating gas flow passage communicates with each of the plural gas-liquid contact chambers via each of the plural adjacent flow passages.

<10> The foam dispensing container according to <8> or <9>, wherein the first branch flow passage is a pillar-shaped space, and the plural adjacent flow passages extend in parallel to the axial direction of the first branch flow passage, and are intermittently arranged in a periphery of the first branch flow passage.

<11> The foam dispensing container according to <10>, wherein the gas flow passage includes a circulating gas flow passage enclosing the first branch flow passage in a circular manner, a radial gas flow passage through which the gas is supplied inward from the radially outer side of the circulating gas flow passage toward the circulating gas flow passage, and an axial gas flow passage extending in the direction parallel to the axial direction of the first branch flow passage, the axial gas flow passage through which the gas is supplied from the gas supply portion side to the radial gas flow passage, and when seen in the axial direction of the first branch flow passage, the axial gas flow passage is positioned at the outer side of the circulating liquid agent flow passage in the radial direction of the first branch flow passage, and the circulating gas flow passage is positioned at the inner side of the circulating liquid agent flow passage in the radial direction of the first branch flow passage.

<12> The foam dispensing container according to <10> or <11>, wherein the liquid agent flow passage further includes an anterior chamber into which the liquid agent flows from the liquid agent supply portion side, the second branch flow passage includes plural branch portions arranged in the periphery of the first branch flow passage, and the anterior chamber communicates with the circulating liquid agent flow passage via each of the plural branch portions.

<13> The foam dispensing container according to any one of <8> to <12>, wherein the liquid agent supply portion is formed to be long in one direction, and the first branch flow passage is arranged on the same axis as the long axis direction of the liquid agent supply portion.

<14> The foam dispensing container according to any one of <1> to <13>, wherein opening areas of the liquid agent openings that are open to the gas-liquid contact chamber are equal to each other.

<15> The foam dispensing container according to <14>, wherein opening shapes of the liquid agent openings that are open to the gas-liquid contact chamber are equal to each other.

<16> The foam dispensing container according to any one of <1> to <15>, wherein at a position on an extension of the adjacent flow passage while sandwiching the gas-liquid contact chamber in between, a foam flow passage communicating with the gas-liquid contact chamber and extending in the extension direction of the adjacent flow passage is arranged.

<17> The foam dispensing container according to any one of <1> to <16>, including a container main body that stores the liquid agent, and a mounting portion mounted on the container main body, wherein the foamer mechanism and the discharge port are held in the mounting portion.

<18> The foam dispensing container according to <17>, wherein the liquid agent supply portion is formed to pressurize the liquid agent inside and supply the liquid agent to the foamer mechanism, and the gas supply portion is arranged in a periphery of the liquid agent supply portion, and formed to pressurize the gas inside and supply the gas to the foamer mechanism.

<19> The foam dispensing container according to <18>, including a head portion held in the mounting portion upward/downward-movably with respect to the mounting portion, the head portion to be pressed down relatively with respect to the mounting portion, wherein the foamer mechanism and the discharge port are held in the head portion, and when the head portion is pressed down relatively with respect to the mounting portion, the liquid agent inside the liquid agent supply portion and the gas inside the gas supply portion are respectively pressurized and supplied to the foamer mechanism.

<20> The foam dispensing container according to any one of <17> to <19>, further including the liquid agent charged in the container main body.

<21> A foam dispensing cap, including a mounting portion mounted on a container main body that stores a liquid agent, a foamer mechanism held in the mounting portion, the foamer mechanism that foams the liquid agent and produces a foam body, and a discharge port held in the mounting portion, the discharge port that discharges the foam body produced by the foamer mechanism, wherein the foamer mechanism has a gas-liquid contact chamber in which the supplied liquid agent meets the supplied gas, a liquid agent flow passage through which the liquid agent supplied to the gas-liquid contact chamber passes, and a gas flow passage through which the gas supplied to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the liquid agent openings are respectively arranged at positions on the both sides sandwiching an extension region of an adjacent flow passage which is a part of the gas flow passage adjacent to the gas opening, and each of the liquid agent openings is directed to the region.

The above embodiments include the following technical concepts.

[1] A foam dispensing container, including a foamer mechanism that foams a liquid agent and produces a foam body, a liquid agent supply portion that supplies the liquid agent to the foamer mechanism, a gas supply portion that supplies a gas to the foamer mechanism, and a discharge port that discharges the foam body produced by the foamer mechanism, wherein the foamer mechanism has a gas-liquid contact chamber in which the liquid agent supplied from the liquid agent supply portion meets the gas supplied from the gas supply portion, a liquid agent flow passage through which the liquid agent supplied from the liquid agent supply portion to the gas-liquid contact chamber passes, and a gas flow passage through which the gas supplied from the gas supply portion to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the liquid agent openings are respectively arranged at positions on the both sides sandwiching an extension region of an adjacent flow passage which is a part of the gas flow passage adjacent to the gas opening, and each of the liquid agent openings is directed to the region.

[2] The foam dispensing container according to [1], wherein the liquid agent openings of the plural branch flow passages oppose each other across the gas-liquid contact chamber.

[3] The foam dispensing container according to [2], wherein the plural branch flow passages include a first branch flow passage and a second branch flow passage, the plural gas-liquid contact chambers are intermittently arranged in a periphery of a downstream side end portion of the first branch flow passage, and the downstream side end portion of the first branch flow passage has the plural liquid agent openings corresponding to each of the plural gas-liquid contact chambers, the second branch flow passage includes a circulating liquid agent flow passage enclosing the downstream side end portion of the first branch flow passage in a circular manner while sandwiching the plural gas-liquid contact chambers in between, the circulating liquid agent flow passage has the plural liquid agent openings corresponding to each of the plural gas-liquid contact chambers, each of the liquid agent openings of the circulating liquid agent flow passage opposes the corresponding liquid agent opening among the plural liquid agent openings of the first branch flow passage via the corresponding gas-liquid contact chamber, the gas flow passage branches into the plural adjacent flow passages respectively corresponding to the plural gas-liquid contact chambers, and each of the plural adjacent flow passages has the gas opening that is open to the corresponding gas-liquid contact chamber.

[4] The foam dispensing container according to [3], wherein the gas flow passage includes a circulating gas flow passage enclosing the first branch flow passage in a circular manner, and the circulating gas flow passage communicates with each of the plural gas-liquid contact chambers via each of the plural adjacent flow passages.

[5] The foam dispensing container according to [3] or [4], wherein the first branch flow passage is a pillar-shaped space, and the plural adjacent flow passages extend in parallel to the axial direction of the first branch flow passage, and are intermittently arranged in a periphery of the first branch flow passage.

[6] The foam dispensing container according to [5], wherein the gas flow passage includes a radial gas flow passage through which the gas is supplied inward from the radially outer side of the circulating gas flow passage toward the circulating gas flow passage, and an axial gas flow passage extending in the direction parallel to the axial direction of the first branch flow passage, the axial gas flow passage through which the gas is supplied from the gas supply portion side to the radial gas flow passage, and when seen in the axial direction of the first branch flow passage, the axial gas flow passage is positioned at the outer side of the circulating liquid agent flow passage in the radial direction of the first branch flow passage, and the circulating gas flow passage is positioned at the inner side of the circulating liquid agent flow passage in the radial direction of the first branch flow passage.

[7] The foam dispensing container according to [5] or [6], wherein the liquid agent flow passage further includes an anterior chamber into which the liquid agent flows from the liquid agent supply portion side, the second branch flow passage includes plural branch portions arranged in the periphery of the first branch flow passage, and the anterior chamber communicates with the circulating liquid agent flow passage via each of the plural branch portions.

[8] The foam dispensing container according to any one of [3] to [7], wherein the liquid agent supply portion is formed to be long in one direction, and the first branch flow passage is arranged on the same axis as the long axis direction of the liquid agent supply portion.

[9] The foam dispensing container according to any one of [1] to [8], wherein, at a position on an extension of the adjacent flow passage while sandwiching the gas-liquid contact chamber in between, a foam flow passage communicating with the gas-liquid contact chamber and extending in the extension direction of the adjacent flow passage is arranged.

[10] The foam dispensing container according to any one of [1] to [9], including a container main body that stores the liquid agent, and a mounting portion mounted on the container main body, wherein the foamer mechanism and the discharge port are held in the mounting portion.

[11] The foam dispensing container according to [10], wherein the liquid agent supply portion is formed to pressurize the liquid agent inside and supply the liquid agent to the foamer mechanism, and the gas supply portion is arranged in a periphery of the liquid agent supply portion, and formed to pressurize the gas inside and supply the gas to the foamer mechanism.

[12] The foam dispensing container according to [11], including a head portion held in the mounting portion upward/downward-movably with respect to the mounting portion, the head portion to be pressed down relatively with respect to the mounting portion, wherein the foamer mechanism and the discharge port are held in the head portion, and when the head portion is pressed down relatively with respect to the mounting portion, the liquid agent inside the liquid agent supply portion and the gas inside the gas supply portion are respectively pressurized and supplied to the foamer mechanism.

[13] The foam dispensing container according to any one of [10] to [12], further including the liquid agent charged in the container main body.

[14] A foam dispensing cap, including a mounting portion mounted on a container main body that stores a liquid agent, a foamer mechanism held in the mounting portion, the foamer mechanism that foams the liquid agent and produces a foam body, and a discharge port held in the mounting portion, the discharge port that discharges the foam body produced by the foamer mechanism, wherein the foamer mechanism has a gas-liquid contact chamber in which the supplied liquid agent meets the supplied gas, a liquid agent flow passage through which the liquid agent supplied to the gas-liquid contact chamber passes, and a gas flow passage through which the gas supplied to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the liquid agent openings are respectively arranged at positions on the both sides sandwiching an extension region of an adjacent flow passage which is a part of the gas flow passage adjacent to the gas opening, and each of the liquid agent openings is directed to the region.

REFERENCE SIGNS LIST

10: Container main body
11: Trunk portion
13: Neck portion
14: Bottom portion
20: Foamer mechanism
21: Gas-liquid contact chamber
22: Liquid agent flow passage
22*a*, 22*b*: Liquid agent opening
221: First branch flow passage
221*a*: Downstream side end portion
222: Second branch flow passage
222*a*: Circulating liquid agent flow passage
222*b*: Branch portion
223: Anterior chamber
224: Adjacent liquid agent flow passage
225: First part
226: Second part
227: First part
228: Second part
229: Third part
23: Gas flow passage
23*a*: Gas opening
231: Adjacent flow passage
232: Circulating gas flow passage
233: Radial gas flow passage
234: Axial gas flow passage
24: Foam flow passage
25: Foam interflow chamber
26: Region
27: Foam interflow chamber
28: Liquid agent supply portion
29: Gas supply portion
30: Head member (head portion)
31: Operation receiving portion
32: Inner tube portion
32*a*: Upward movement regulating portion
32*b*: Groove
32*c*: Holding portion
32*d*: Flow passage
33: Outer tube portion
40: Nozzle portion
41: Discharge port
50: Mesh holding ring
51: Mesh
60: Flow passage forming member
60*a*: Division line
61: Small diameter portion
62: Large diameter portion
63: Projection portion
64: Floor slab portion
641: Axial through hole
641*a*: Large diameter hole portion
641*b*: Small diameter hole portion
65: Axial groove
66: Radial through hole
67: Hollow portion
68: Recessed portion
68*a*: Tapered portion
69: Peripheral edge through hole
70: Fitting pin
71: Upper end surface
72: Lower end surface
73: Large diameter portion
74: Small diameter portion
75: Level difference surface
76: Recessed portion
77: Through hole
78: Air flow passage forming groove
79: Foam flow passage forming groove
80: Fitting ring
81: Upper surface
82: Lower surface
83: Hole
84: Straight portion
85: Tapered portion
90: Holding member
91: Pin holding hole portion
92: Foam interflow chamber forming hole portion
93: Mesh ring holding hole portion
94, 95: Level difference portion
100: Foam dispensing container
101: Liquid agent
110: Cap member
111: Mounting portion
112: Annular closing portion
113: Standing tube portion
120: Cylinder member
121: Gas cylinder forming portion
122: Liquid agent cylinder forming portion
122*a*: Straight portion

122*b*: Reduced-diameter portion
123: Annular coupling portion
125: Tube holding portion
126: Rib
126*a*: Spring receiving level difference portion
127: Valve seat
128: Dipping tube
129: Through hole
130: Piston guide
131: Valve seat portion
132: Housing space
133: Flange portion
134: Valve forming groove
135: Flow passage forming groove
140: Liquid piston
141: Outer circumferential piston portion
142: Housing portion
143: Constriction portion
150: Gas piston
151: Tubular portion
152: Piston portion
153: Outer circumferential ring portion
154: Suction opening
155: Suction valve member
160: Poppet
161: Upper end portion
162: Valve body
162*a*: Spring receiving portion
170: Coil spring
180: Ball valve
190: Packing
200: Foam dispensing cap
210: Gas pump chamber
211: Flow passage
212: Tubular gas flow passage
213: Axial flow passage
214: Circulating flow passage
220: Liquid agent pump chamber
300: First member
301: Hole
310: Tube portion
320: First disc-shaped portion
321: Annular rib
330: Second disc-shaped portion
340: Projection portion
341: Recessed portion
342: Gap
343: Projection portion
344: Adjacent wall portion
350: Conversion surface
351: Groove
352: Groove
353: Groove
361: First tube portion
362: First disc-shaped portion
363: Second disc-shaped portion
364: Second tube portion
365: Wall portion
370: Groove
371: First part
372: Second part
373: Third part
390: Positioning recessed portion
400: Second member
410: Tube portion
411: Recessed portion
412: Recessed portion
420: Plate portion
421: Hole
490: Positioning projection
AX1: Axis of adjacent flow passage 231
AX2: Axis of liquid agent opening 22*a*
AX3: Axis of liquid agent opening 22*b*
AX4: Axis of first branch flow passage 221
AX5: Axis of liquid agent pump chamber 220

The invention claimed is:

1. A foam dispensing container, comprising:

a foamer mechanism that foams a liquid agent and produces a foam body;

a liquid agent supply portion that supplies the liquid agent to the foamer mechanism;

a gas supply portion that supplies a gas to the foamer mechanism; and a discharge port that discharges the foam body produced by the foamer mechanism, wherein the foamer mechanism has:

a gas-liquid contact chamber in which the liquid agent supplied from the liquid agent supply portion meets the gas supplied from the gas supply portion;

a liquid agent flow passage through which the liquid agent supplied from the liquid agent supply portion to the gas-liquid contact chamber passes; and a gas flow passage through which the gas supplied from the gas supply portion to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the foamer mechanism has a plurality of the gas-liquid contact chambers, each of the plurality of the gas-liquid contact chambers is surrounded by a plurality of wall surfaces, the gas opening and a plurality of the liquid agent openings are arranged corresponding to each of the plurality of the gas-liquid contact chambers, for each of the plurality of the gas-liquid contact chambers:

the liquid agent openings are respectively arranged at positions on both sides sandwiching an extension region of an adjacent flow passage which is a part of the gas flow passage adjacent to the gas opening; and the liquid agent openings oppose each other across the gas-liquid contact chamber, so that a partial region of one liquid agent opening overlaps with a partial region of another liquid agent opening when seen in the direction of the axis of the one liquid agent opening, and at a position on the extension region of the adjacent flow passage while sandwiching the gas-liquid contact chamber in between, a foam flow passage communicating with the gas-liquid contact chamber and extending in the extension direction of the adjacent flow passage is arranged.

2. The foam dispensing container according to claim 1, wherein each of the liquid agent openings arranged at the positions on both sides sandwiching the extension region of the adjacent flow passage is directed to the region.

3. The foam dispensing container according to claim 1, wherein the liquid agent flow passage includes an adjacent liquid agent flow passage which is a part adjacent to the upstream sides of the plural branch flow passages, the plurality of the gas-liquid contact chambers are arranged in a periphery of a downstream side end portion of the adjacent liquid agent flow passage, the plurality of wall surfaces surrounding the gas-liquid contact chamber includes an outer peripheral wall surface common to the plurality of the gas-liquid contact chambers and an inner peripheral wall surface which is individually arranged corresponding to each of the plurality of the gas-liquid contact chambers, the plural branch flow passages extend toward the periphery from the downstream side end portion of the adjacent liquid agent flow passage in the in-plane direction crossing the adjacent liquid agent flow passage, and each of the plural branch flow passages is surrounded by a plurality of wall surfaces.

4. The foam dispensing container according to claim 3, wherein corresponding to each of the plurality of the gas-liquid contact chambers, a pair of branch flow passages and a pair of liquid agent openings in one-to-one correspondence with each of the pair of branch flow passages are arranged, each of the pair of branch flow passages includes:

a first part extending in a radial manner from the downstream side end portion of the adjacent liquid agent flow passage in the in-plane direction crossing the adjacent liquid agent flow passage; and a second part extending in the in-plane direction which is the direction crossing the first part, the first part is surrounded by a plurality of wall surfaces, and the second part is surrounded by a plurality of wall surfaces.

5. The foam dispensing container according to claim 4, wherein one of the pair of the branch flow passages corresponding to one gas-liquid contact chamber shares the first part with one of the branch flow passages of a gas-liquid contact chamber adjacent to one side of the gas-liquid contact chamber, and the other branch flow passage shares the first part with one of the branch flow passages of a gas-liquid contact chamber adjacent to the other side of the gas-liquid contact chamber.

6. The foam dispensing container according to claim 3, wherein the adjacent flow passage is arranged in the periphery of the adjacent liquid agent flow passage and extends in parallel to the adjacent liquid agent flow passage.

7. The foam dispensing container according to claim 1, wherein the plural branch flow passages include a first branch flow passage and a second branch flow passage, the plurality of the gas-liquid contact chambers are arranged in a periphery of a downstream side end portion of the first branch flow passage, and the downstream side end portion of the first branch flow passage has the plural liquid agent openings corresponding to each of the plurality of the gas-liquid contact chambers, the second branch flow passage includes a circulating liquid agent flow passage enclosing the downstream side end portion of the first branch flow passage in a circular manner while sandwiching the plurality of the gas-liquid contact chambers in between, the circulating liquid agent flow passage has the plural liquid agent openings corresponding to each of the plurality of the gas-liquid contact chambers, each of the liquid agent openings of the circulating liquid agent flow passage opposes the corresponding liquid agent opening among the plural liquid agent openings of the first branch flow passage via a corresponding gas-liquid contact chamber, the gas flow passage branches into plural adjacent flow passages respectively corresponding to the plurality of the gas-liquid contact chambers, and each of the plural adjacent flow passages has the gas opening that is open to the corresponding gas-liquid contact chamber.

8. The foam dispensing container according to claim 7, wherein the gas flow passage includes a circulating gas flow passage enclosing the first branch flow passage in a circular manner, and the circulating gas flow passage communicates with each of the plurality of the gas-liquid contact chambers via each of the plural adjacent flow passages.

9. The foam dispensing container according to claim 7, wherein the first branch flow passage is a pillar-shaped space, and the plural adjacent flow passages extend in parallel to the axial direction of the first branch flow passage, and are intermittently arranged in a periphery of the first branch flow passage.

10. The foam dispensing container according to claim 9, wherein the gas flow passage includes:

a circulating gas flow passage enclosing the first branch flow passage in a circular manner;

a radial gas flow passage through which the gas is supplied inward from the radially outer side of the circulating gas flow passage toward the circulating gas flow passage; and an axial gas flow passage extending in the direction parallel to the axial direction of the first branch flow passage, the axial gas flow passage through which the gas is supplied from a gas supply portion side to the radial gas flow passage, and when seen in the axial direction of the first branch flow passage, the axial gas flow passage is positioned at the outer side of the circulating liquid agent flow passage in the radial direction of the first branch flow passage, and the circulating gas flow passage is positioned at the inner side of the circulating liquid agent flow passage in the radial direction of the first branch flow passage.

11. The foam dispensing container according to claim 9, wherein the liquid agent flow passage further comprises an anterior chamber into which the liquid agent flows from a liquid agent supply portion side, the second branch flow passage includes plural branch portions arranged in the periphery of the first branch flow passage, and the anterior chamber communicates with the circulating liquid agent flow passage via each of the plural branch portions.

12. The foam dispensing container according to claim 7, wherein the liquid agent supply portion is formed to be long in one direction, and the first branch flow passage is arranged on the same axis as the long axis direction of the liquid agent supply portion.

13. The foam dispensing container according to claim 1, wherein at a position on an extension of the adjacent flow passage while sandwiching the gas-liquid contact chamber in between, a foam flow passage communicating with the gas-liquid contact chamber and extending in the extension direction of the adjacent flow passage is arranged.

14. The foam dispensing container according to claim 1, comprising:

a container main body that stores the liquid agent; and a mounting portion mounted on the container main body, wherein the foamer mechanism and the discharge port are held in the mounting portion.

15. The foam dispensing container according to claim 14, wherein the liquid agent supply portion is formed to pressurize the liquid agent inside and supply the liquid agent to the foamer mechanism, and the gas supply portion is arranged in a periphery of the liquid agent supply portion, and formed to pressurize the gas inside and supply the gas to the foamer mechanism.

16. The foam dispensing container according to claim 15, comprising:

a head portion held in the mounting portion upward/downward-movably with respect to the mounting portion, the head portion to be pressed down relatively with respect to the mounting portion, wherein the foamer mechanism and the discharge port are held in the head portion, and when the head portion is pressed down relatively with respect to the mounting portion, the liquid agent inside the liquid agent supply portion and the gas inside the gas supply portion are respectively pressurized and supplied to the foamer mechanism.

17. The foam dispensing container according to claim 14, wherein the liquid agent charged in the container main body.

18. A foam dispensing cap, comprising:

a mounting portion mounted on a container main body that stores a liquid agent;

a foamer mechanism held in the mounting portion, wherein the foamer mechanism foams the liquid agent and produces a foam body; and a discharge port held in the mounting portion, the discharge port that discharges the foam body produced by the foamer mechanism, wherein the foamer mechanism has:

a gas-liquid contact chamber in which supplied liquid agent meets supplied gas;

a liquid agent flow passage through which the liquid agent supplied to the gas-liquid contact chamber passes; and a gas flow passage through which the gas supplied to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the foamer mechanism has a plurality of the gas-liquid contact chambers, each of the plurality of the gas-liquid contact chambers is surrounded by a plurality of wall surfaces, the gas opening and a plurality of the liquid agent openings are arranged corresponding to each of the plurality of the gas-liquid contact chambers, for each of the plurality of the gas-liquid contact chambers:

the liquid agent openings are respectively arranged at positions on both sides sandwiching an extension region of an adjacent flow passage which is a part of the gas flow passage adjacent to the gas opening; and the liquid agent openings oppose each other across the gas-liquid contact chamber, so that a partial region of one liquid agent opening overlaps with a partial region of another liquid agent opening when seen in the direction of the axis of the one liquid agent opening, and at a position on the extension region of the adjacent flow passage while sandwiching the gas-liquid contact chamber in between, a foam flow passage communicating with the gas-liquid contact chamber and extending in the extension direction of the adjacent flow passage is arranged.

19. A foam dispensing container, comprising:

a foamer mechanism that foams a liquid agent and produces a foam body;

a liquid agent supply portion that supplies the liquid agent to the foamer mechanism;

a gas supply portion that supplies a gas to the foamer mechanism; and a discharge port that discharges the foam body produced by the foamer mechanism, wherein the foamer mechanism has:

a gas-liquid contact chamber in which the liquid agent supplied from the liquid agent supply portion meets the gas supplied from the gas supply portion;

a liquid agent flow passage through which the liquid agent supplied from the liquid agent supply portion to the gas-liquid contact chamber passes; and a gas flow passage through which the gas supplied from the gas supply portion to the gas-liquid contact chamber passes, the gas flow passage has a gas opening that is open to the gas-liquid contact chamber, the liquid agent flow passage branches into plural branch flow passages, each of the plural branch flow passages has a liquid agent opening that is open to the gas-liquid contact chamber, the foamer mechanism has a plurality of the gas-liquid contact chambers, each of the plurality of the gas-liquid contact chambers is surrounded by a plurality of wall surfaces, the gas opening and a plurality of the liquid agent openings are arranged corresponding to each of the plurality of the gas-liquid contact chambers, for each of the plurality of the gas-liquid contact chambers:

the liquid agent openings are respectively arranged at positions on both sides sandwiching an extension region of an adjacent flow passage which is a part of the gas flow passage adjacent to the gas opening; and the liquid agent openings oppose each other across the gas-liquid contact chamber, so that a partial region of one liquid agent opening overlaps with a partial region of another liquid agent opening when seen in the direction of the axis of the one liquid agent opening.

* * * * *